US010624438B2

(12) United States Patent
Hoskins

(10) Patent No.: US 10,624,438 B2
(45) Date of Patent: Apr. 21, 2020

(54) FLUID BLADDERS WITH CLOSURES AND HANDLES

(71) Applicant: TSI Manufacturing, LLC, Bend, OR (US)

(72) Inventor: Matthew Hoskins, Bend, OR (US)

(73) Assignee: TSI Manufacturing, LLC, Bend, OR (US)

( * ) Notice: Subject to any disclaimer, the term of this patent is extended or adjusted under 35 U.S.C. 154(b) by 105 days.

(21) Appl. No.: 15/613,571

(22) Filed: Jun. 5, 2017

(65) Prior Publication Data

US 2017/0347778 A1 Dec. 7, 2017

Related U.S. Application Data

(60) Provisional application No. 62/345,226, filed on Jun. 3, 2016.

(51) Int. Cl.
*A45F 3/20* (2006.01)
*A45F 3/16* (2006.01)

(52) U.S. Cl.
CPC ..... *A45F 3/20* (2013.01); *A45F 2003/166* (2013.01)

(58) Field of Classification Search
CPC . A45F 3/20; A45F 2003/166; B65D 33/1666; B65D 33/1675; B65D 33/24; B65D 33/02; B65D 33/06; B65D 41/02; B65D 53/02; B65D 33/16; B65D 33/1658; A45C 11/22; A45C 13/06; A45C 13/008
USPC ..... 224/148.4; 383/68, 33–34.1, 13, 21, 17; 24/30.5 R; 150/123
See application file for complete search history.

(56) References Cited

U.S. PATENT DOCUMENTS

| | | | |
|---|---|---|---|
| 393,360 | A | 11/1888 | Cook |
| 1,589,074 | A | 6/1924 | Harris |
| 1,625,605 | A | 4/1927 | Hiering |
| 1,973,255 | A | 5/1932 | Henriot |
| 1,902,764 | A | 3/1933 | De Give |
| 1,948,329 | A | 2/1934 | Burkhardt |
| 2,055,695 | A | 3/1936 | Macdonald et al. |
| 2,304,528 | A | 12/1942 | Bafia et al. |
| 2,317,545 | A | 4/1943 | Madsen et al. |
| 2,544,929 | A | 3/1951 | Madsen et al. |
| 2,599,738 | A | 6/1952 | Ames |
| 2,606,587 | A | 8/1952 | Porter et al. |
| 2,622,647 | A | 12/1952 | Arnthal |
| 2,678,671 | A | 5/1954 | Rifkin |
| 2,789,781 | A | 4/1957 | Miller |
| 3,727,829 | A | 4/1973 | Hüni |
| 5,116,139 | A | 5/1992 | Young et al. |
| 5,797,683 | A | 8/1998 | Gunzi et al. |

(Continued)

*Primary Examiner* — Nathan J Newhouse
*Assistant Examiner* — Matthew T Theis
(74) *Attorney, Agent, or Firm* — Klarquist Sparkman, LLP

(57) ABSTRACT

A fluid container can comprise a flexible bladder having an internal region for storing a fluid, a bladder opening at an upper end portion of the bladder for allowing passage of fluid in or out of the internal region, a lower rigid member secured to an outer surface of the bladder at a lower end portion of the bladder, an upper closure secured to the bladder over the bladder opening for selectively closing and opening the bladder opening, and a rigid, removable handle, wherein the handle has an upper end portion that is detachably coupled to the upper closure and a lower end portion that is detachably coupled to the lower rigid member.

19 Claims, 47 Drawing Sheets

(56) References Cited

U.S. PATENT DOCUMENTS

| | | | | |
|---|---|---|---|---|
| 5,864,880 | A * | 2/1999 | Adam | A41D 1/04 2/108 |
| D452,377 | S | 12/2001 | Cooke et al. | |
| D489,180 | S | 5/2004 | Kramer | |
| 6,821,018 | B1 | 11/2004 | Denko | |
| 7,648,276 | B2 | 1/2010 | Gill | |
| 7,757,384 | B2 | 7/2010 | MacAuley et al. | |
| 8,186,881 | B2 | 5/2012 | Lyon et al. | |
| 8,550,714 | B2 | 10/2013 | Ben-Shushan et al. | |
| 9,302,822 | B2 | 4/2016 | Hoskins | |
| 2011/0006084 | A1 * | 1/2011 | Staton | A45F 3/20 222/175 |
| 2011/0091136 | A1 | 4/2011 | Danch et al. | |
| 2014/0144944 | A1 | 5/2014 | Rogers et al. | |
| 2015/0093052 | A1 | 4/2015 | Hoskins | |
| 2016/0113379 | A1 * | 4/2016 | Marui | A45F 3/18 224/148.1 |

* cited by examiner

FLUID BLADDERS WITH CLOSURES AND HANDLES

CROSS-REFERENCE TO RELATED APPLICATION

This application claims the benefit of U.S. Provisional Patent Application No. 62/345,226, filed Jun. 3, 2016, which is incorporated by reference herein in its entirety.

FIELD

The application is related to fluid bladders and closures and handles therefor, such as for personal hydration systems or other fluid handling purposes.

BACKGROUND

Sufficient hydration is important for replacing bodily fluids during extended periods of aerobic activity, such as cycling. Currently, several methods are known for getting fluids to a person engaged in aerobic activity and in need of fluid replenishment. In an attempt to overcome the deficiencies of water bottles, personal hydration systems have been developed that include a reservoir for holding fluid, a flexible drink tube for conveying the fluid from the reservoir to the person engaged in aerobic activity, and a mouth-operated valve attached to the end of the tube. Reservoirs for hydration systems are generally made from sheets of flexible materials that have been sealed at their edges to provide a watertight container. Soft-side reservoirs or bladders are relatively inexpensive, can be comfortably worn within in a back pack or waist pack, and withstand impact well.

Hydration system bladders typically include a closeable fill port and a drain port that connects to the drink tube. Configurations for the hydration bladder fill ports include screw cap ports welded to one side of the bladder or into the bladder seam. Another approach is to fill through an open seam at the top of the bladder and employ a zipper type or roll-top closure that seals in the fluid.

The various types of fill ports are designed meet certain needs of bladder-based hydration systems. Screw top ports offer secure, robust closing method that is familiar to users. Welding ports to the bladder material is a low-cost manufacturing method that integrates into the processes employed in forming and sealing the bladder edges. Roll and zip top closures offer a wide opening for filling and adding ice to the bladder and facilitate cleaning and drying.

Despite the capabilities of current bladder fill port designs, there remain problems associated with their use. For example, screw-ports welded to the bladder's side can be oversized to offer easier filling, but their side-facing orientation can make them difficult to fill under a faucet. Side-mounted ports can require that the bladder be removed from its hydration pack for filling. Cleaning and drying bladders made with side-mounted fill ports can be troublesome due to the size of the port opening and the tendency of the bladder sides to collapse together. Seam-welded ports can be placed at the top of the bladder, but can be more difficult to weld reliably and can become bulky when made with oversized openings. Roll and zip top closures may not seal as reliably as screw-top closures and may require extra effort to keep them opened during filling.

SUMMARY

Disclosed herein are embodiments of bladders assemblies having closures for sealing an upper opening of the bladder.

The disclosed bladder assemblies can provide reliable sealing, top-mounted orientation, easy filling, and/or can facilitate easy clean-up and drying of the bladder.

In some embodiments, a bladder closure comprises a first rigid member adapted to be secured to a first side of an upper bladder opening and a second rigid member adapted to be secured to a second side of the upper bladder opening opposite from the first side. At least one fastener is included for clamping the first and second rigid members together to seal the bladder opening. The fastener is rotatably mounted in a fastener mounting opening of the first rigid member and comprises a latch positioned on an outer side of the first rigid member and a shaft that passes through the fastener mounting opening and extends from an inner side of the first rigid member. The shaft includes at least one tab or flange that projects from an end of the shaft on the inner side of the first rigid member to engage with a portion of the second rigid member when the latch is rotated. The latch extends radially from an end of the shaft on the outer side of the first rigid member and includes locking portion that pivots at least partially around the shaft to engage with a projection of the second rigid member that extends through a hole in the first rigid member to the outer side of the first rigid member.

When the bladder closure is in a closed position, the latch is rotated such that the tab that projects from the fastener shaft is engaged with the second rigid member to provide a clamping force that clamps the first and second rigid members together to seal a bladder opening, and the locking portion of the latch is engaged with the projection on the outer side of the first rigid member to lock the fastener in the closed position.

In other embodiments, the first and second rigid members can be hinged to each other and only one of the rigid members is adapted to be fixed to one side of an upper bladder opening. In an open position, the opposite side of the bladder opening is free to open away from the first side and the bladder closure fixed to the first side. In the closed position, the two sides of the bladder opening are brought together and the second rigid member is pivoted relative to the first rigid member to be positioned on the outer side of the second side of the upper bladder opening. In this position, the fastener shaft can be rotated to engage the tab of the fastener shaft with the second rigid portion to clamp the bladder opening closed and the latch can lockingly engage with the projection of the second rigid member to keep the fastener from rotating.

In some embodiments, the tab on the fastener shaft can engage with a ramped surface on the second rigid member such that the clamping force is gradually increased as the shaft is rotated and the tab moves up the ramp. Two or more tabs can be included around the shaft that each engage with their own inclined ramps on the second rigid member.

In some embodiments, the bladder closure includes two or more of said fasteners and/or two or more of said projections to provide a more even clamping force distribution across the bladder opening.

In another representative embodiment, a fluid container can comprise a flexible bladder having an internal region for storing a fluid, a bladder opening at an upper end portion of the bladder for allowing passage of fluid in or out of the internal region, a lower rigid member secured to an outer surface of the bladder at a lower end portion of the bladder, an upper closure secured to the bladder over the bladder opening for selectively closing and opening the bladder opening, and a rigid, removable handle. The handle can have an upper end portion that is detachably coupled to the upper closure and a lower end portion that is detachably coupled to the lower rigid member.

In some embodiments, the upper closure can comprise a first coupling feature and the upper end portion of the handle can comprise a second coupling feature. In these embodiments, the first coupling feature and the second coupling feature can be operable to couple together to secure the upper closure to the handle.

In some embodiments, the handle can have a convex surface that faces the bladder.

In some embodiments, the handle can have a concave surface that faces the bladder.

In some embodiments, the rigid member can comprise a fluid exit port.

In some embodiments, the fluid container can also include a straw having a first end that is operable to be detachably coupled to the fluid exit port. In these embodiments, the straw can be disposed between the bladder and the handle.

In some embodiments, the straw can be disposed under the handle and the handle can include a straw opening such that a second end of the straw opposite the first end can protrude out of the straw opening.

In some embodiments, the upper closure can include a base secured to the bladder around the bladder opening, the base having a port to allow passage of fluid through the base in or out of the bladder through the bladder opening, an annular cap retainer secured to the base around the port, and a cap hingedly coupled to the cap retainer and pivotable between a closed position where the cap seals the port closed and an open position where the port is open for passage of fluid in or out of the bladder.

In some embodiments, the upper closure can include a first rigid member adapted to be secured to a first side of the bladder opening, a second rigid member adapted to be secured to a second side of the bladder opening opposite from the first side, and at least one fastener for securing the first and second rigid members together to seal the bladder opening. In these embodiments, the first rigid member can comprise at least one fastener mounting opening and at least one hole spaced from the fastener mounting opening. The second rigid member can comprise at least one fastener engagement opening and at least one projection spaced from the fastener engagement opening. The fastener can be rotatably mounted in the fastener mounting opening of the first rigid member. The fastener can comprise a latch positioned on an outer side of the first rigid member and a shaft that passes through the fastener mounting opening and extends from an inner side of the first rigid member. The shaft can include at least one tab that projects from a portion of the shaft on the inner side of the first rigid member. The latch can extend radially from a portion of the shaft on the outer side of the first rigid member and the latch can include a locking portion that pivots with the shaft at least partially around an axis of the shaft. In these embodiments, when the bladder closure is in an open position, the first rigid member can be spaced apart from the second rigid member. In these embodiments, when the bladder closure is in a closed position, the tab that projects from the fastener shaft can be engaged with the fastener engagement opening in the second rigid member to provide a clamping force that clamps the first and second rigid members together to seal the bladder opening, and the projection of the second rigid member can extend through the hold in the first rigid member and the locking portion of the latch can be engaged with the projection on the outer side of the first rigid member to lock the fastener in the closed position.

In some embodiments, the handle can comprise a connecting slot that is operable to couple to a buckle.

In some embodiments, the fluid container can also include a buckle coupled to the connecting slot and a strap secured to a first end portion of the buckle.

In some embodiments, the fluid container can also include a buckle coupled to the connecting slot that is securable to a pack to secure the fluid container to the pack.

In some embodiments, the fluid container can also include a first buckle secured to the upper closure and a second buckle secured to the lower end portion of the handle.

In some embodiments, the first buckle can couple to a third buckle secured to a pack and the second buckle can couple to a fourth buckle secured to the pack to secure the fluid container to the pack.

In some embodiments, the fluid container can also include a back plate secured to a rear side of the bladder. In these embodiments, the handle can be secured to a front side of the bladder.

In another representative embodiment, a system can comprise a fluid container and a pack. In these embodiments, the fluid container can include a flexible bladder having an internal region for storing a fluid, a bladder opening at an upper end portion of the bladder for allowing passage of fluid in or out of the internal region, and at least a first buckle. In these embodiments, the pack can include at least a second buckle. In these embodiments, the first buckle and the second buckle can be operable to couple together to secure the fluid container within the pack.

In some embodiments, the system can also include a third buckle secured to the fluid container and a fourth buckle secured to the pack. In these embodiments, the third buckle and the fourth buckle can be operable to couple together to further secure the fluid container within the pack.

In some embodiments, the fluid container can also include a lower rigid member secured to an outer surface of the bladder at a lower end portion of the bladder, an upper closure secured to the bladder over the bladder opening for selectively closing and opening the bladder opening, a rigid, removable handle, and a third buckle. In these embodiments, the handle can have an upper end portion that is detachably coupled to the upper closure and a lower end portion that is detachably coupled to the lower rigid member. In these embodiments, the pack can further include a fourth buckle. In these embodiments, the third buckle and the fourth buckle can be operable to couple together to further secure the fluid container within the pack.

In some embodiments, the first, second, third, and fourth buckles can be side release buckles.

In some embodiments, the pack can include a reservoir sleeve to receive the fluid container.

The foregoing and other objects, features, and advantages of the disclosed technology will become more apparent from the following detailed description, which proceeds with reference to the accompanying figures.

DETAILED DESCRIPTION

Figure 1:
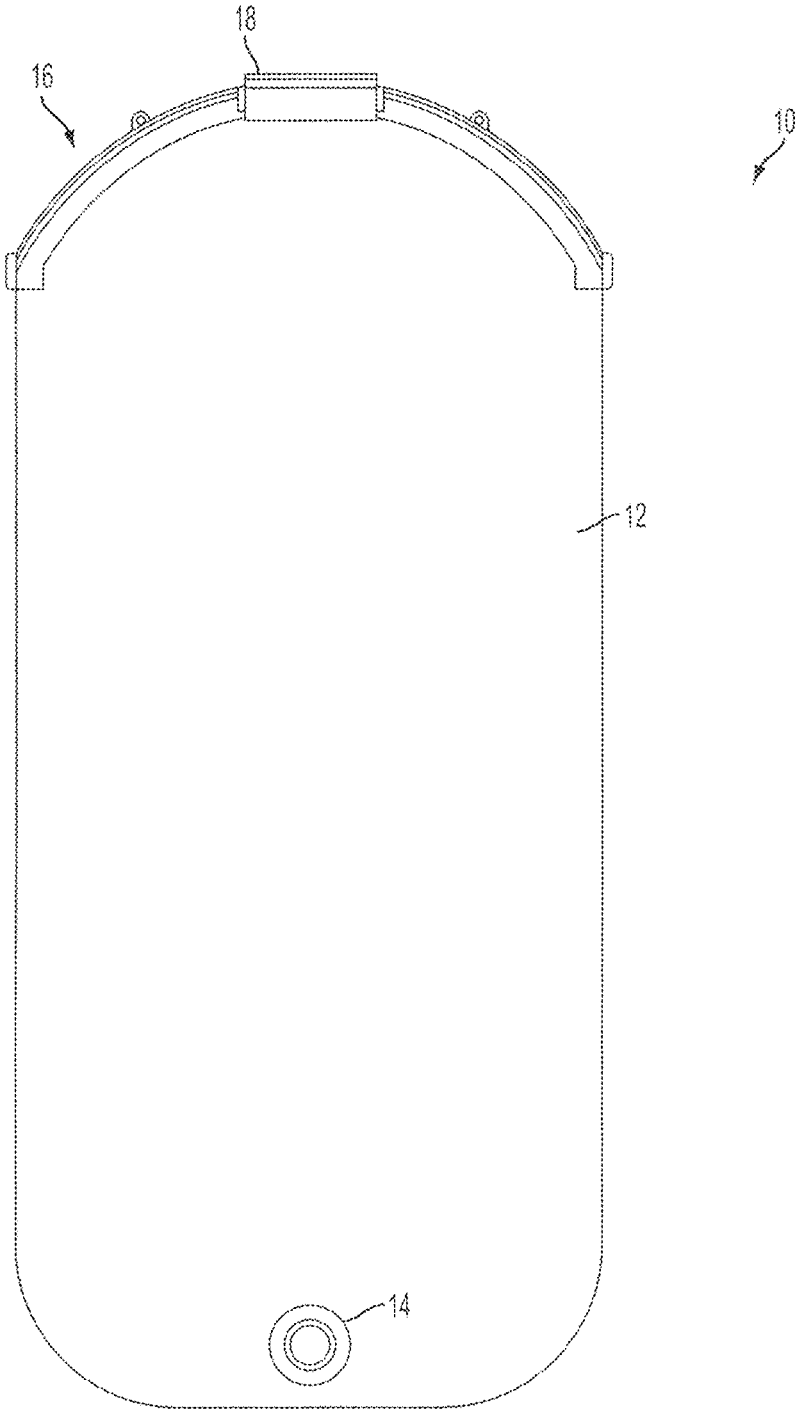
FIG. 1 is a front elevation view of an exemplary fluid bladder having an upper closure.

Disclosed herein are embodiments of fluid bladders and closures therefor that offer reliable sealing, top-mounted orientation, easy filling, and/or that facilitate clean-up and drying of the bladder. Various fill port embodiments for use in a fluid bladder are disclosed. Some disclosed bladders include a re-sealable closure located at the top of a bladder that can provide a generous passageway for cleaning and drying out of the bladder's interior. In certain embodiments, the closure is designed such that when it is in an open position, the closure holds the bladder walls away from one another to further facilitate drying.

In some embodiments, the bladder closure comprises a pair of rigid frames sealed to the bladder and arranged in a clamshell configuration. Pivoting of the frames relative to each other opens or closes that bladder top. The closure can be configured so that the closure's frames can be set in an open position opening up the bladder's interior and allowing for extended drying. A locking mechanism built into the closure assembly can be actuated to lock the assembly into a closed state, sealing off the bladder.

Other embodiments can have a dual fill port configuration that offers filling through a smaller side fill port and/or via the bladder's sealable open end. Some dual port embodiments include a rigid plate with a central fill port and locking member. A rigid, elongated, slightly curved plate featuring a fill port can be attached to one side of the bladder at the bladder's top end. The plate may be located so that the top edge of the bladder can be folded over or under the top edge of the plate effectively sealing the bladder's top end. A locking member can be employed to secure or release the bladder top fold. In such embodiments, the bladder interior can be accessed by opening the fill port or by releasing the locking member and opening the bladder's top edge. The fill port can comprise a screw top port and cap, a self-sealing elastomeric port, and/or a fill port with an integrated, closeable plug.

In some embodiments, a self-sealing fill port can be included within the bladder, such as by adding a filling conduit inside the bladder. Such a filling conduit can comprise a flattened tube that is attached to the top seam of the bladder at one of its open ends, while the other open end is attached within the bladder such that inadvertent eversion of the conduit from within the bladder is restricted. The flattened tube shape of the conduit can naturally impede fluid flow due to its tendency to collapse on itself and the surface tension that exists between the sides of the tube when it is collapsed. Furthermore, the end of the filling conduit that is inside the bladder is subject to the fluid pressure within the filled bladder. The internal bladder pressure pushes the sides of the conduit together to restrict fluid flow. To fill the bladder, the conduit's top end can be manually spread open to receive fluid from a fluid source. The flattened conduit can be attached to the bladder in such a way that if desired, the conduit may be unfolded from the bladder to allow for bladder cleaning and drying out. A drain port can be attached to the bladder in the conventional fashion.

Figure 2:
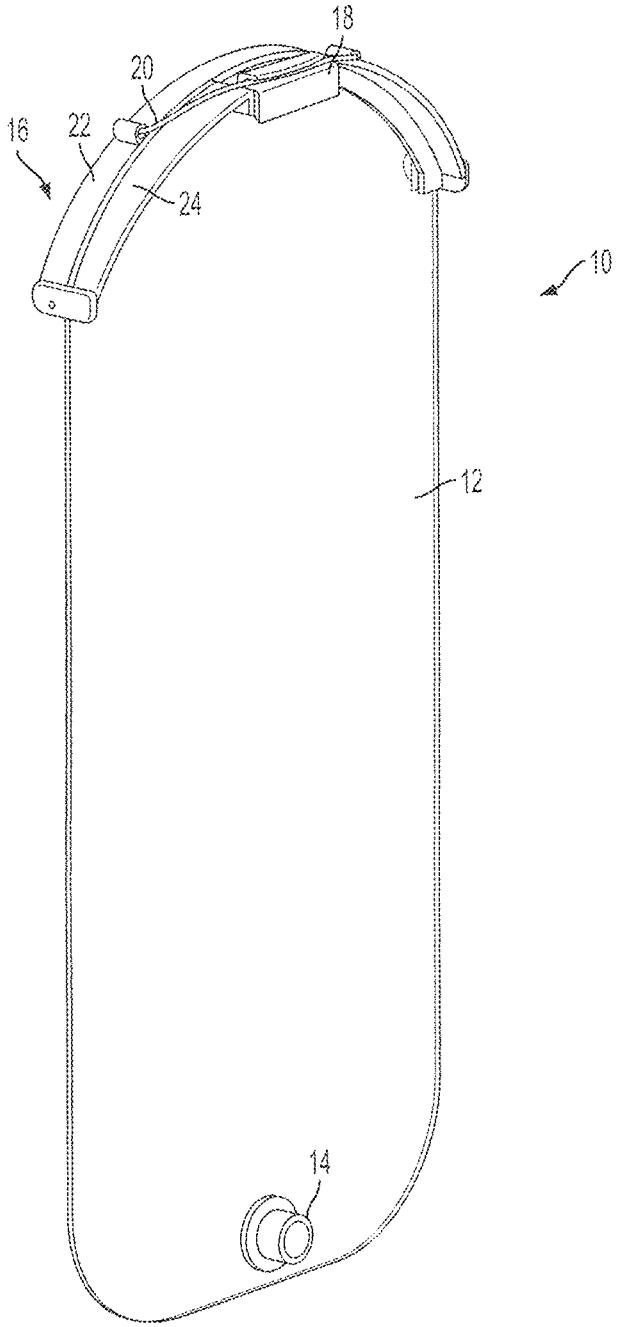
FIG. 2 is perspective view of the fluid bladder of FIG. 1.

FIG. 1 shows a bladder assembly 10 comprising bladder 12, exit port 14, clamshell closure 16, and draw latch 18. FIG. 2 is a perspective view of bladder assembly 10 comprising bladder 12, exit port 14, clamshell closure 16 having jaws 22 and 24, draw latch 18, and an engaging loop 20.

Figure 3A:
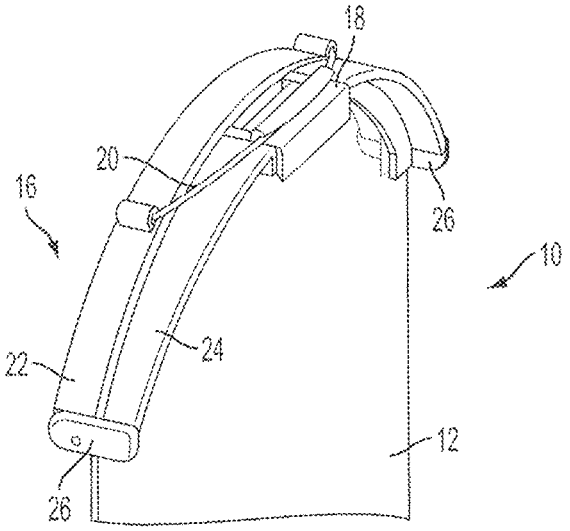
FIG. 3A shows the upper closure of the fluid bladder of FIG. 1 in a closed position.

FIG. 3A is a detailed view of clamshell closure 16 in a closed and locked position. Draw latch 18 captures engaging loop 20 to hold the jaws 22, 24 of clamshell closure 16 together with sufficient force to prevent fluid from leaking from bladder 12. Draw latch 18 and engaging loop 20 are just one example of a locking mechanism for sealing clamshell closure 16. A number of other clamping type mechanisms can be employed including, but not limited to, screw-type clamps, spring clamps, locking straps, quick-release cams, and keeper arrangements which slide over the top of the clamshell.

Figure 3B:
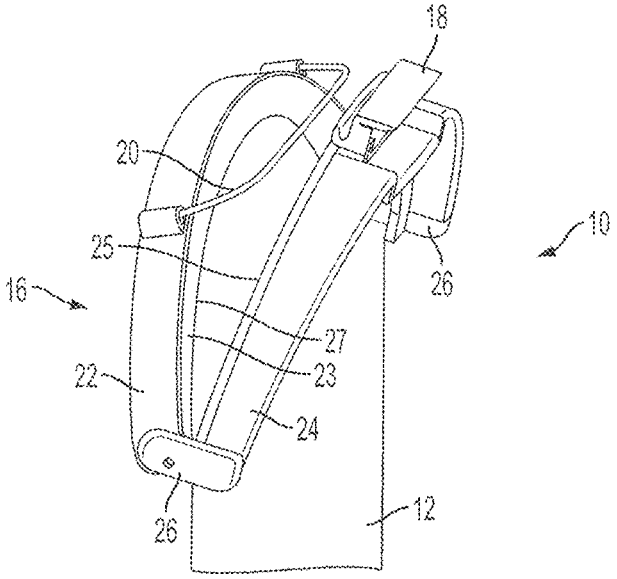
FIG. 3B shows the upper closure of the fluid bladder of FIG. 1 in an open position.

FIG. 3B shows clamshell closure 16 in its open position. Draw latch 18 is in a raised position releasing engaging loop 20 and acts as a handle for the user to grasp as bladder 12 is filled with fluid. First clamshell jaw 22 connects to second clamshell jaw 24 at hinge 26 on both sides. First clamshell jaw 22 features first sealing surface 23 which acts against second sealing surface 25 on the face of second clamshell jaw 24. Bladder 12 is sealed along its two top edges to first sealing surface 23 and second sealing surface 25 respectively. Gasket 27, runs along the length of sealing surface 23 to help seal bladder 12 when it is in the closed position. Hinge 26 can be constructed with sufficient friction to allow first and second clamshell jaws 22 and 24 to be fixed in an open position if desired.

Figure 4:
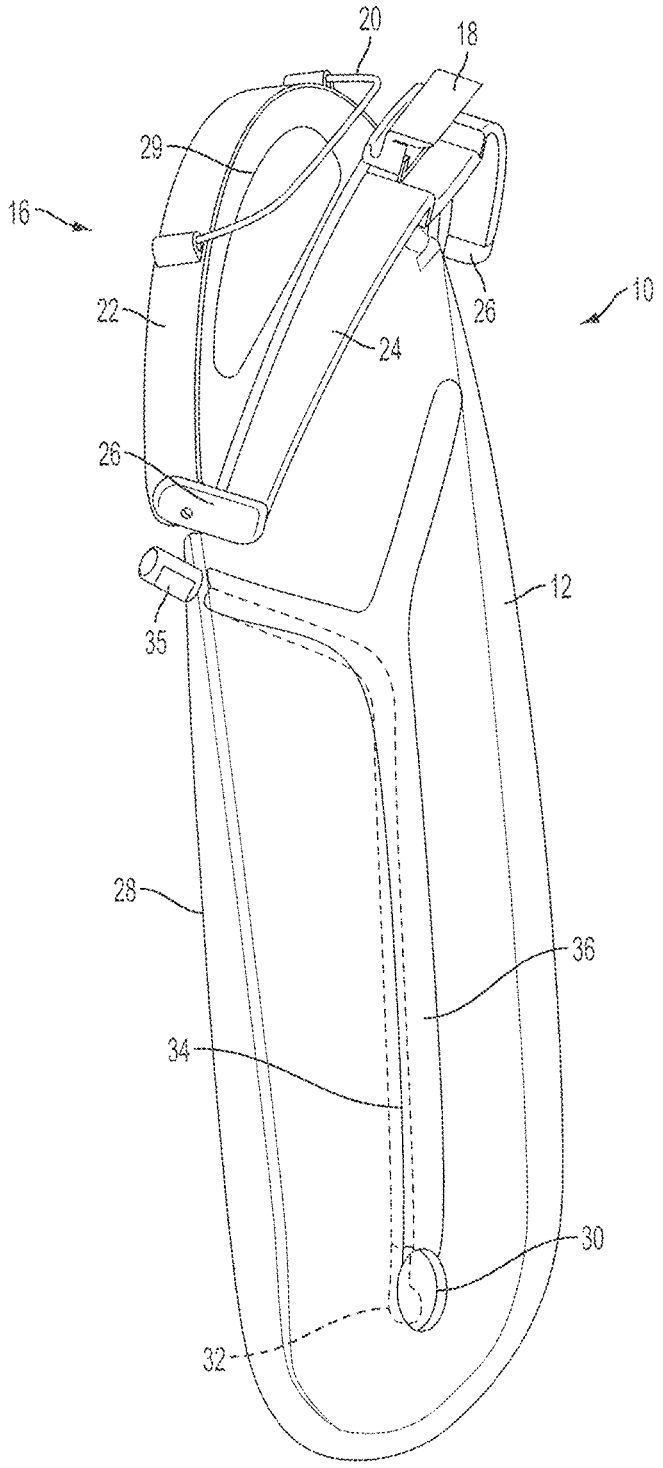
FIG. 4 shows another exemplary fluid bladder having a stabilizing plate.

FIG. 4 shows an alternative embodiment of clamshell closure 16 and bladder assembly 10. In this embodiment, first clamshell jaw 22 is connected to stabilizing plate 28. Stabilizing plate 28 is attached to the back of bladder 12. When attached in this fashion, stabilizing plate provides column strength to bladder assembly 10 during pack loading. Additionally, the bonding of bladder 12 to stabilizing plate 28 prevents bladder 12 from fully expanding into a cylindrical shape during filling, thus bladder 12 maintains a lower profile for pack loading and does not bulge unnecessarily into the user's back. Stabilizing plate 28 features top handle 29 which is accessed from the back of bladder assembly 10. Stabilizing plate 28 features hole 30 through which elbow exit port 32 passes out of the backside of bladder 12. Elbow exit port 32 is connected to drink tube 34 which sits within tube channel 36. Tube channel 36 is formed on the backside of stabilizing plate 28 and is shaped like a "Y" allowing drink tube 34 to be routed either left or right, or both. Drink tube 34 exits tube channel 36 and terminates in quick disconnect fitting 35, which provides easy bladder removal from the hydration pack as the drink tube can be disconnected at the top of the bladder.

Figure 5A:
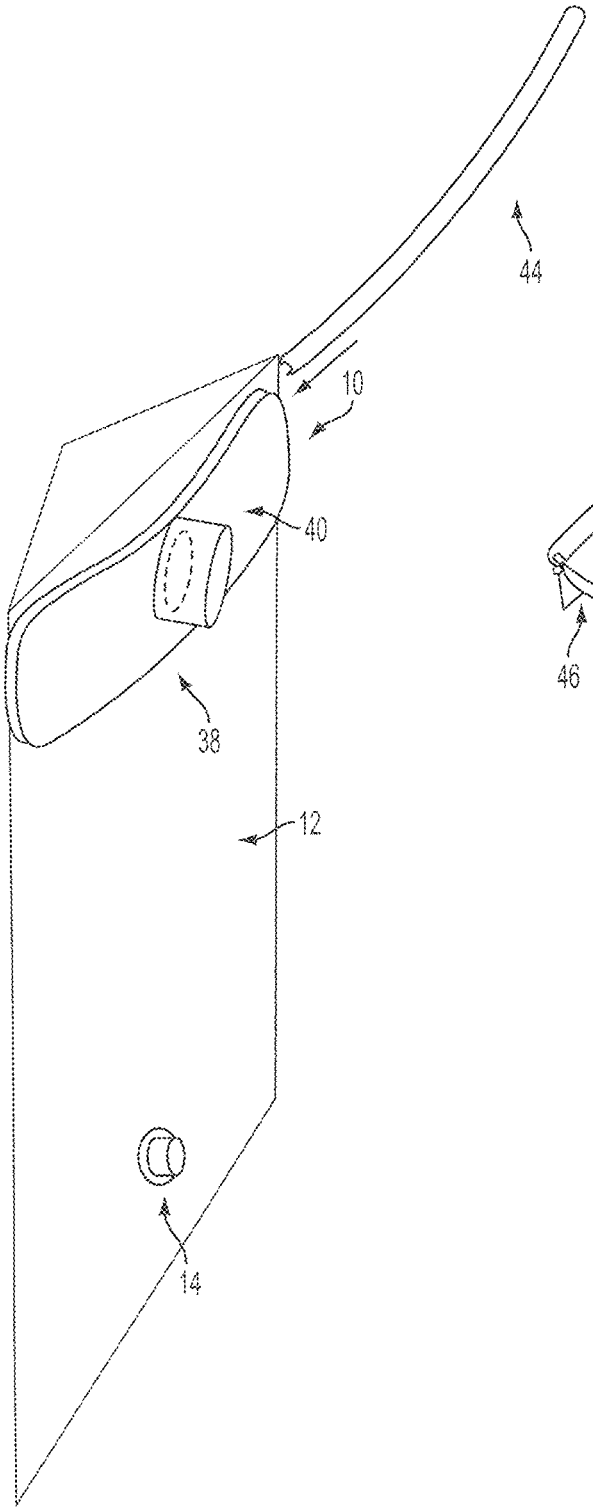
FIGS. 5A and 5B a dual port closure for a fluid bladder.

FIG. 5A shows another bladder closure embodiment. In this design, bladder assembly 10 comprises bladder 12, exit port 14 and dual port closure 38. Dual port closure 38 features top plate 40, fill port 42, and keeper member 44. FIG. 5A shows dual port closure 38 opened to allow filling, cleaning, or drying. Top plate 40 can be sealed on its underside to one side of bladder 12 towards the top of the bladder. Top plate 40 can be located on bladder 12 such that the top of bladder 12 may be folded over. Top plate 40 can be curved slightly to allow bladder 12 to expand outward for filling. Fill port 42 features a passageway that extends through top plate 40 and one side of bladder 12 in the area where it is bonded to top plate 40.

Figure 5B:
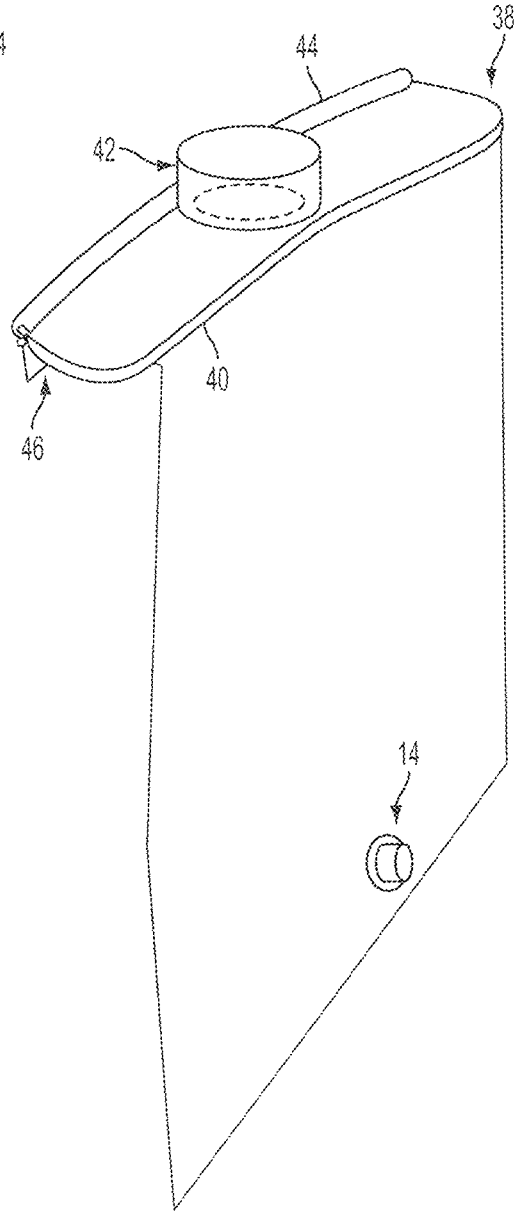

In FIG. 5B, dual port closure 38 is show in its sealed state. Bladder 12 is folded at fold 46 and keeper member 44 is slid over fold 46 and the edge of top plate 40 to lock and seal the top of bladder 12. Keeper member 44 may be configured as a hinged piece which can fold over and lock bladder fold 46 in place. A gasket may be added to top plate 40 along fold 46 to further enhance bladder sealing. Fill port 42 may be a screw top port or other design that allows quick filling and draining with or without removal of the bladder from the hydration pack. For cleaning, drying, or adding of ice, keeper member 44 can be released and the top end of bladder 12 fully opened.

Figure 6A:
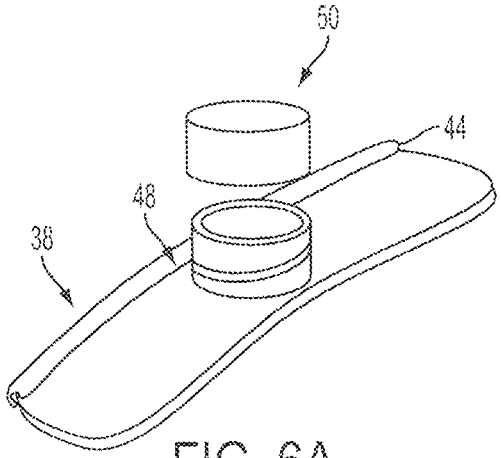
FIGS. 6A-6D show alternative fill port designs for a dual port closure.
Figure 6B:
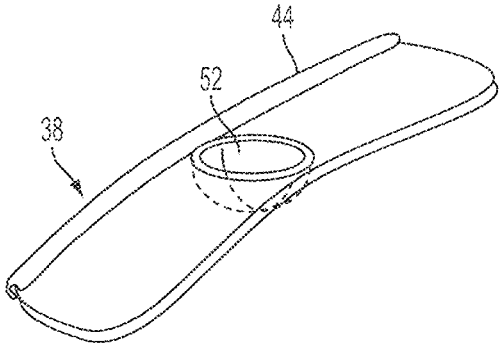
Figure 6C:
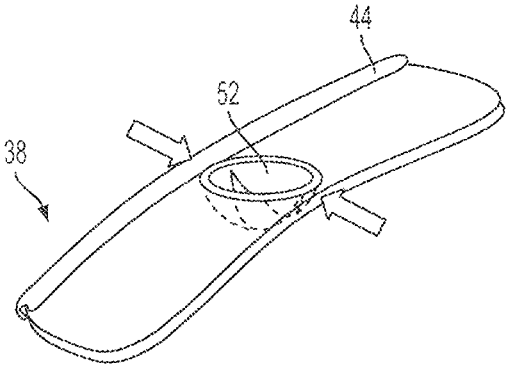
Figure 6D:
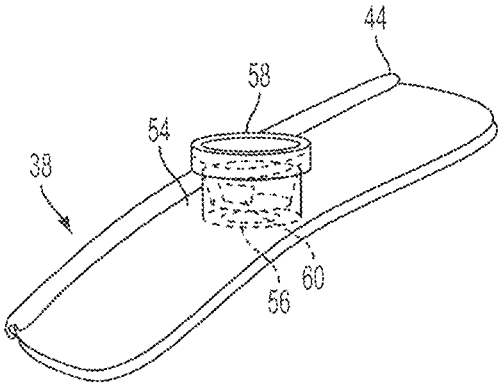

FIGS. 6A, 6B, 6C, and 6D show alternative fill port designs for dual port closure 38. FIG. 6A shows screw top spout 48 and cap 50. FIG. 6B shows elastomeric fill port 52 first in a closed position and in FIG. 6C squeezed to an open position. Elastomeric fill port 52 may be configured as a concave dome as shown or similar to a duckbill valve or other configuration where a slit that is normally pressed closed by internal pressure can be manually opened via external deformation. FIG. 6D features capless fill port 54 which includes hole 56 and plug 58. Plug 58 is threaded onto fill port 54 and tapers as it extends to hole 56. Plug 58 features side hole 60 in its tapered segment. When tightened down, plug 58 seals hole 56. When unscrewed slightly, fluid is directed into the hollow center of plug 58 where it then passes through side hole 60 and hole 56 into the bladder's interior, thus allowing bladder filling without the need for a separate port cap.

Figure 7A:
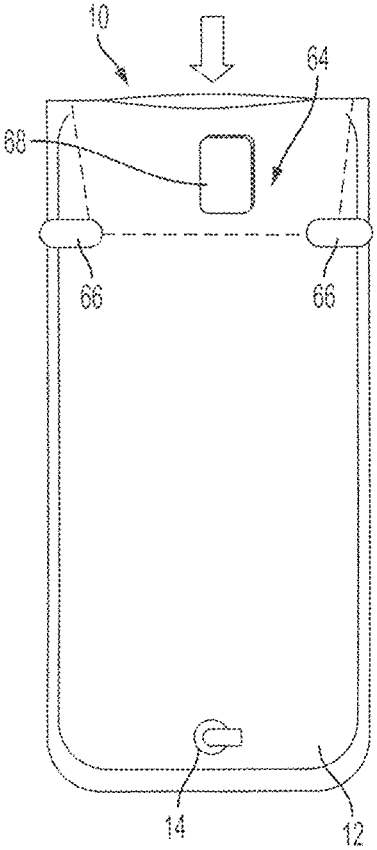
FIGS. 7A and 7B show another exemplary fluid bladder having a fold-over upper closure.
Figure 7B:
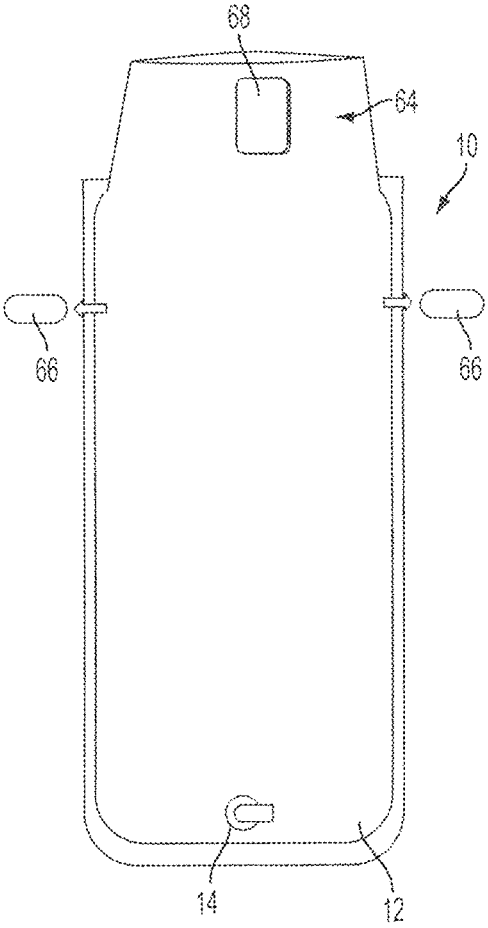

FIG. 7A shows another embodiment of bladder assembly 10 that includes flattened conduit 64 attached to the top end of bladder 12 and folded inwardly inside of the top of the bladder. FIG. 7B shows the conduit 64 unfolded from within bladder 18 and projecting upward for cleaning and drying. In the configuration of FIG. 7A, the conduit 64 forms a duck-bill check valve that allows fluid to readily enter the top of the bladder 12 but collapses to restrict fluid from flowing out of the bladder. The conduit 64 can be an integrated extension of the rest of the bladder 12 or can be a separate components that is attached to the top end of the bladder. Integrated or removable clamps or clips 66 or similar fasteners can help seal the free end of conduit 64 between the walls of the bladder 12 in the closed position of FIG. 7A. In some embodiments, a rigid spacer 68 is hingedly coupled within conduit 64 and is operable to be pivoted from a closed position lying flat between the internal walls of the conduit 64 to an open position generally perpendicular to the walls of the conduit to hold the conduit open for filling. The hinged spacer 68 can pivot about a generally vertical axis relative to one wall of the conduit, for example, to minimize obstruction to fluid flow through the conduit along the axial direction.

Figure 8A:
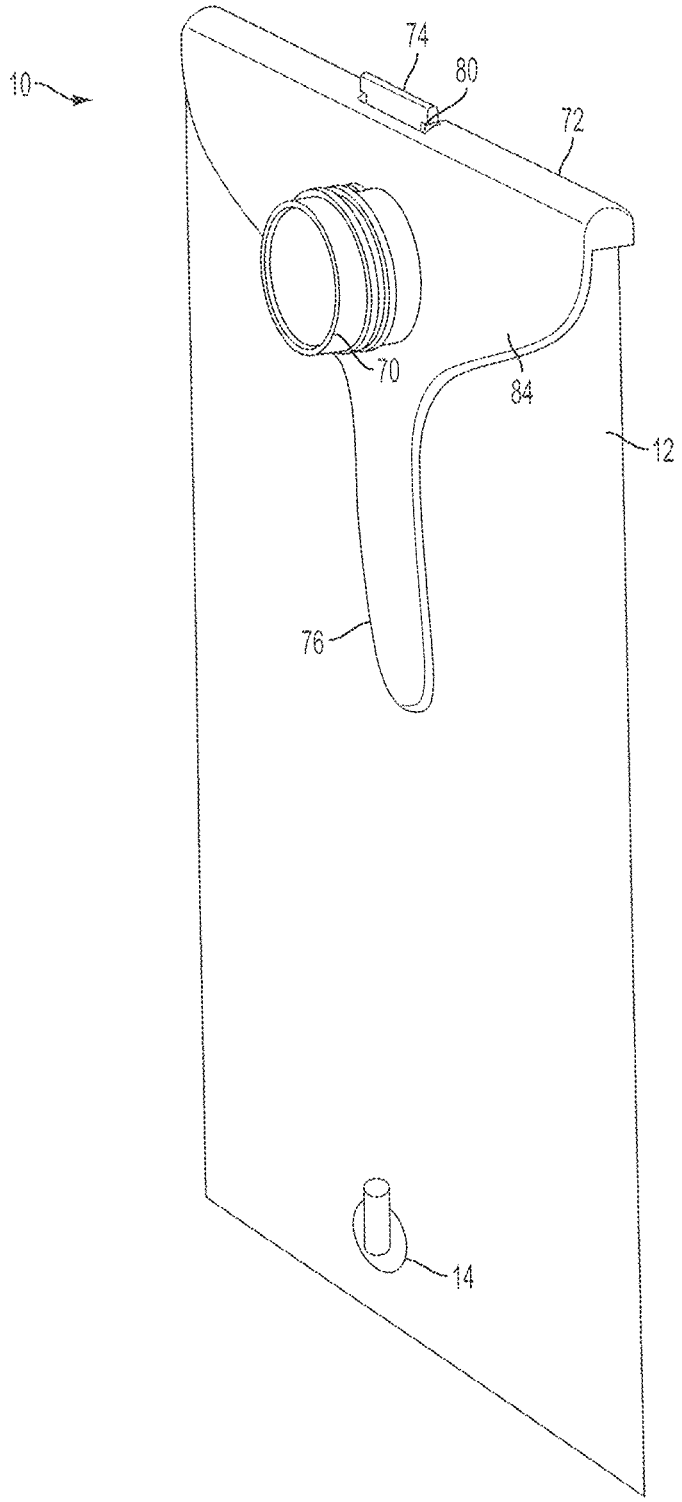
FIG. 8A is a front perspective view of another exemplary fluid bladder with an upper closure.

FIG. 8A shows yet another bladder embodiment. In this embodiment, bladder assembly 10 includes a dual port closure 72 which can include screwport 70, cam tab 74, handle 76, and/or a screw port cap (not shown). An exit port 14 allows connection to a fluid conduit for bladder emptying.

Figure 8B:
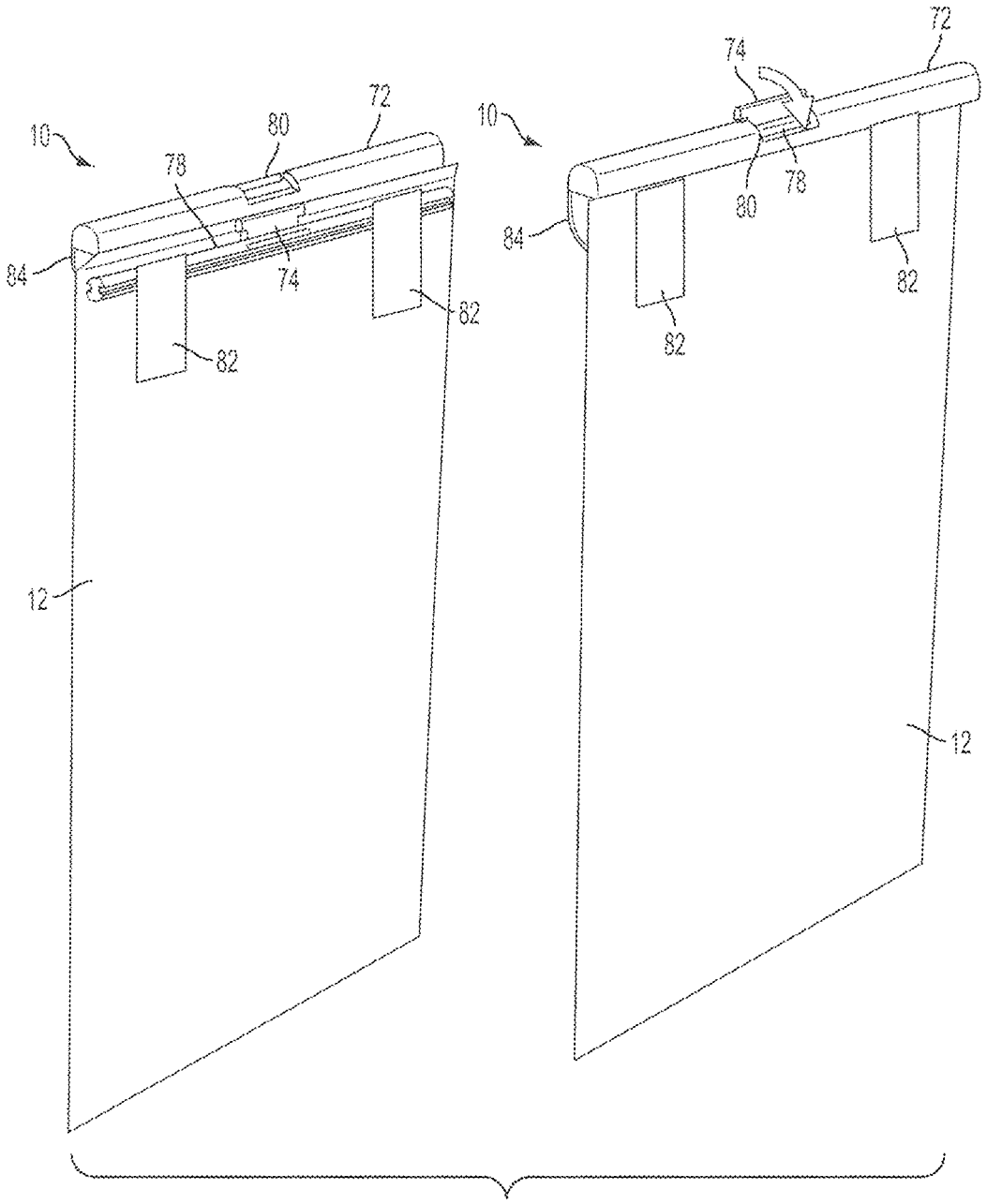
FIG. 8B shows rear perspective views of the fluid bladder of FIG. 8A, in both an unlocked position (left) and a partially locked position (right).

FIG. 8B depicts bladder assembly 10 of FIG. 8A with the unsealed bladder top in its open (left) and closed (right) positions. In the open position, cam 78, which connects to the back sheet of the bladder such as via loops or similar structures 82, is pulled down and out to separate the front bladder sheet from the back bladder sheet along the bladder's unsealed top edge. The front sheet of the bladder is sealed along its top edge to the dual port closure 72 body. In the closed and seal position, cam 78 is inserted back into dual port closure 72. Cam tab 74 is positioned within cut-out 80 and rotated such that cam 78 exerts pressure along the top edge of the bladder and seals its contents.

Figure 8C:
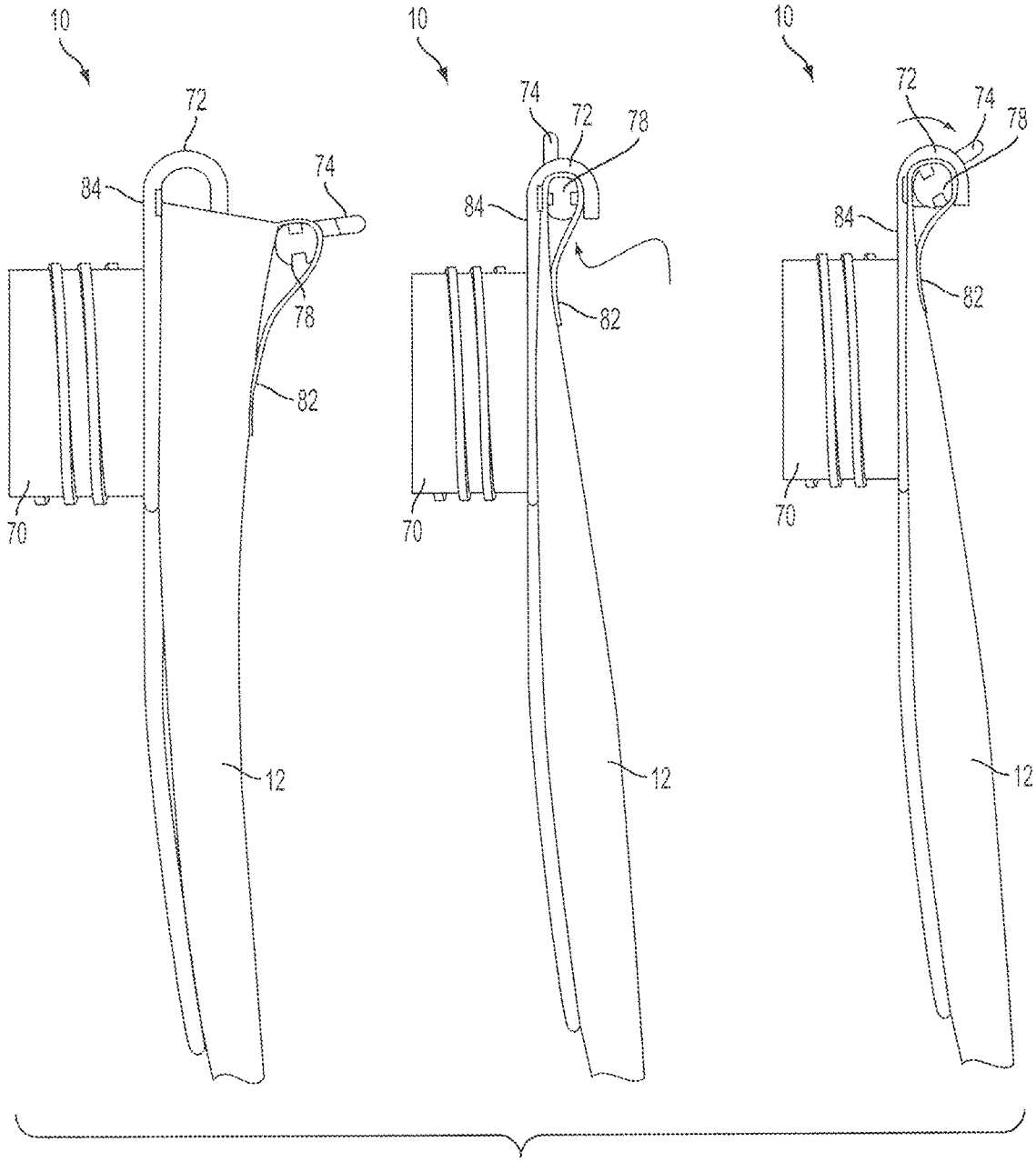
FIG. 8C shows side elevations views of the fluid bladder of FIG. 8A, in an open position (left), a closed but unlocked position (middle) and a closed and locked position (right).

FIG. 8C shows a closure of the bladder assembly 10 of FIGS. 8A and 8B in side elevation view. In the configuration shown at the left-hand side of FIG. 8C, cam 78 is pulled away to open bladder 12. Next, as shown in the center image of FIG. 8C, cam tab 74 is brought up into cut-out 80 and is then rotated, as shown in the right-hand image of FIG. 8C, so that ribs on the cam 78 apply pressure along the top edge of the bladder against the closure 72. An optional elastomeric strip can run along the length of the top edge of the bladder and provide a sealing seat for cam ribs. Cam tab 74 and cut-out 80 can include locking and/or indexing features so that cam tab 74 is secured in its closed position.

Figure 9:
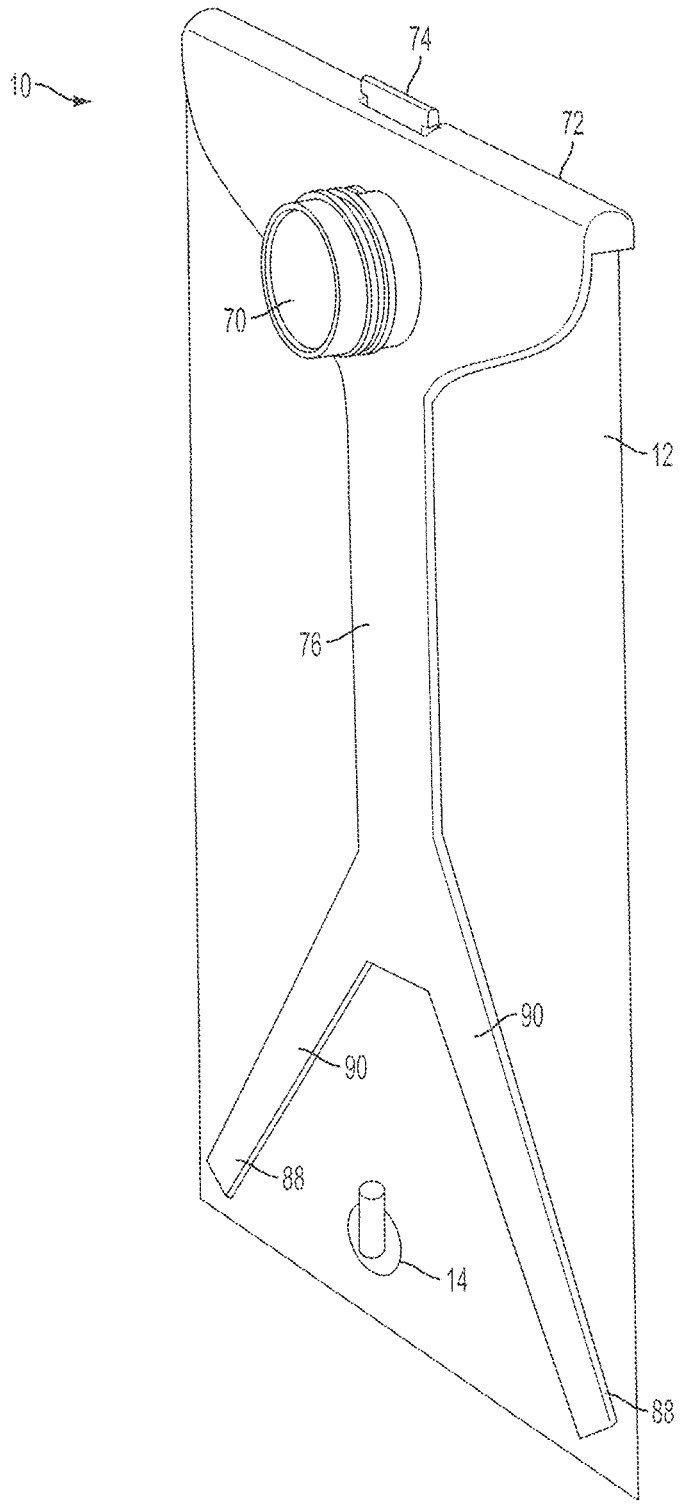
FIG. 9 shows an alternative embodiment of the fluid bladder shown in FIGS. 8A-8C, including a handle.
Figure 10:
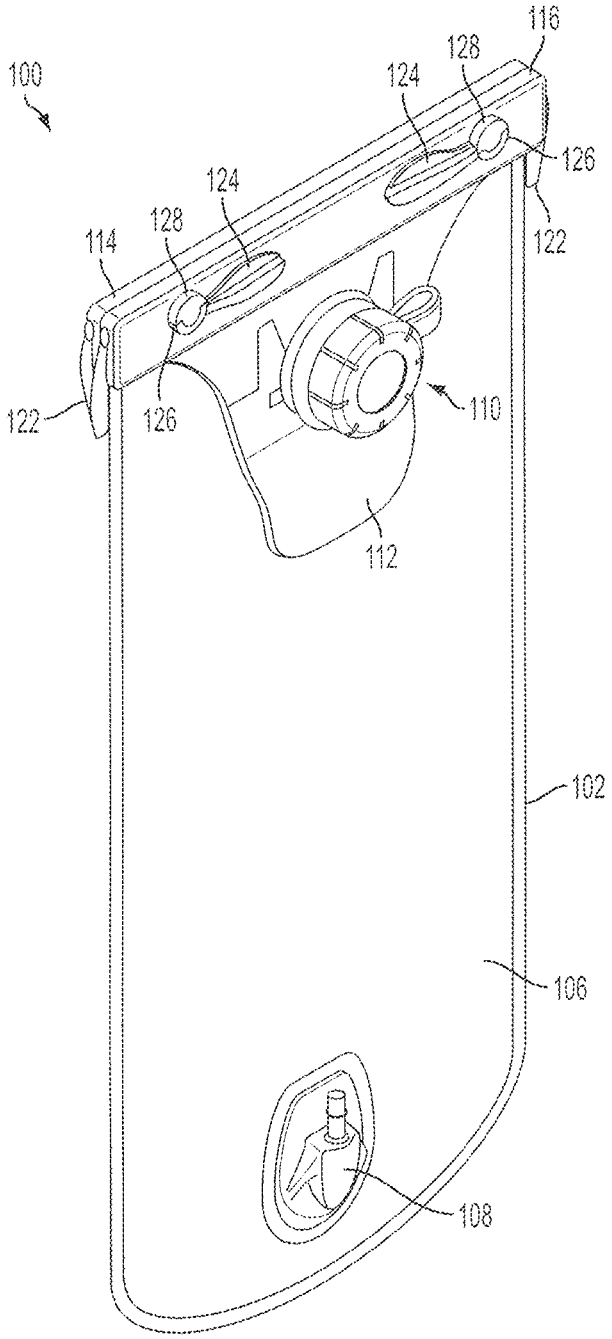
FIG. 10 is a perspective front view of another exemplary fluid bladder having an upper closure.
Figure 11:
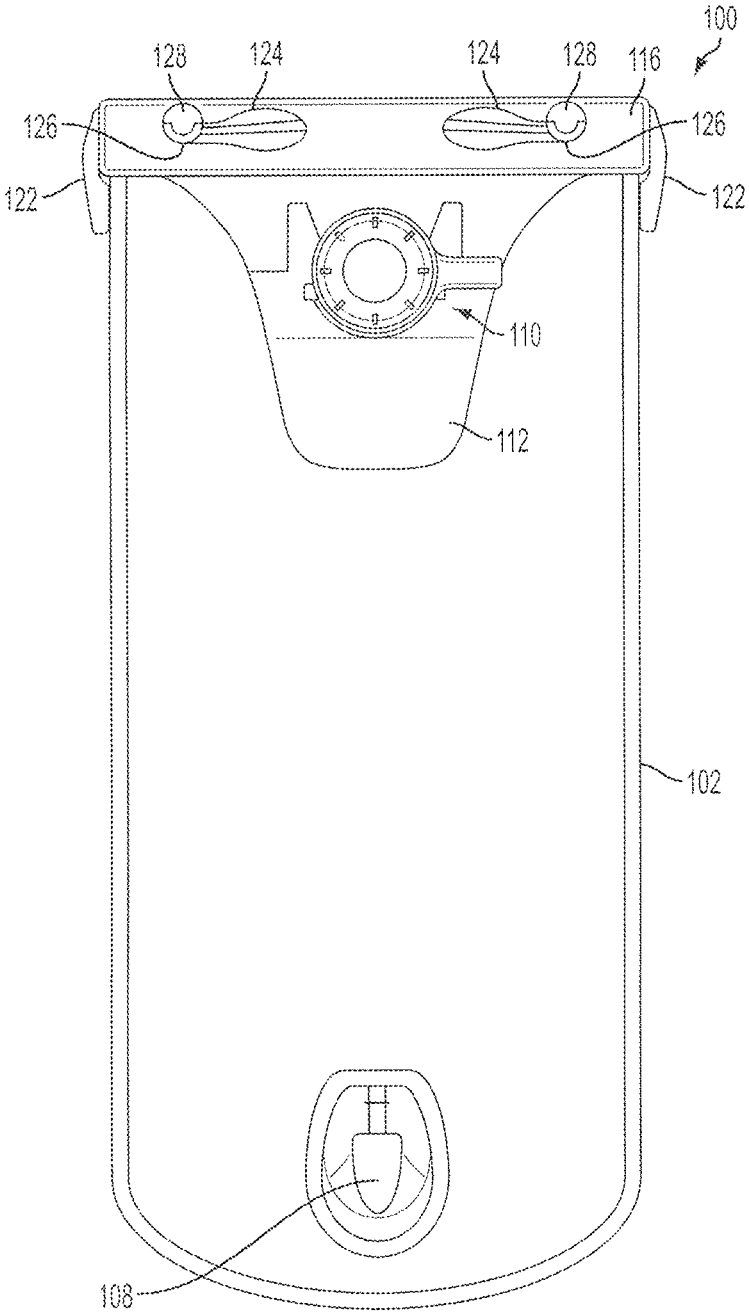
FIG. 11 is a front elevation view of the fluid bladder of FIG. 10.
Figure 12:
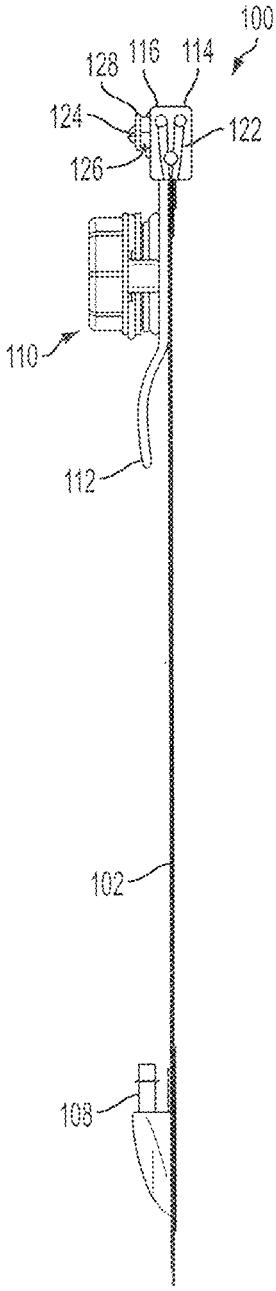
FIG. 12 is a side elevation view of the fluid bladder of FIG. 10.
Figure 13:
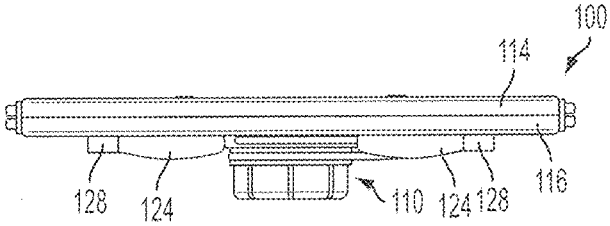
FIG. 13 is a top view of the fluid bladder of FIG. 10.

FIG. 9 shows an alternative embodiment of the bladder assembly 10 of FIG. 8. In this embodiment, handle 76 extends along the vertical length of the bladder and bifurcates struts 90 which are removeably attached to bladder 12 at corners 88. Handle 76 and struts 90 help stretch bladder 12 to maintain a flat shape as the bladder fills with fluid.

FIGS. 10-22 show various views of another bladder assembly 100. The bladder assembly comprises a bladder 102 having a rear sheet 104 and a front sheet 106 that are sealed together around their lower and lateral edges, leaving an upper opening. The assembly 100 can include a lower outlet port 108 and an inlet port 110 that is sealable with a cap. A handle 112 can be coupled to the front sheet 106 of the bladder adjacent to the inlet port 110, such as for holding the bladder horizontally to fill through the inlet port 110, such as under a faucet.

The upper opening of the bladder 102 is attached to a closure assembly for sealing and unsealing the upper opening. The closure assembly comprises a rear rigid member 114 coupled to the upper edge of the rear sheet 104 and a front rigid member 116 coupled to the upper edge of the front sheet 106. The rigid members 114, 116 extend across the width of the upper opening. In some embodiments, the upper edge of the rear sheet 104 can be coupled to the rear member 114 with an intermediate rear liner 118 and the upper edge of the front sheet 106 can be coupled to the front member 116 with an intermediate front liner 120 (see FIGS. 15, 16, and 21). In this way, the sheets 104, 106 need not be welded or otherwise attached directly to the rigid members 114, 116. The liners 118, 120 can be attached to the rigid members 114, 116, respectively, using screws, welds, and other secure means.

Figure 15:
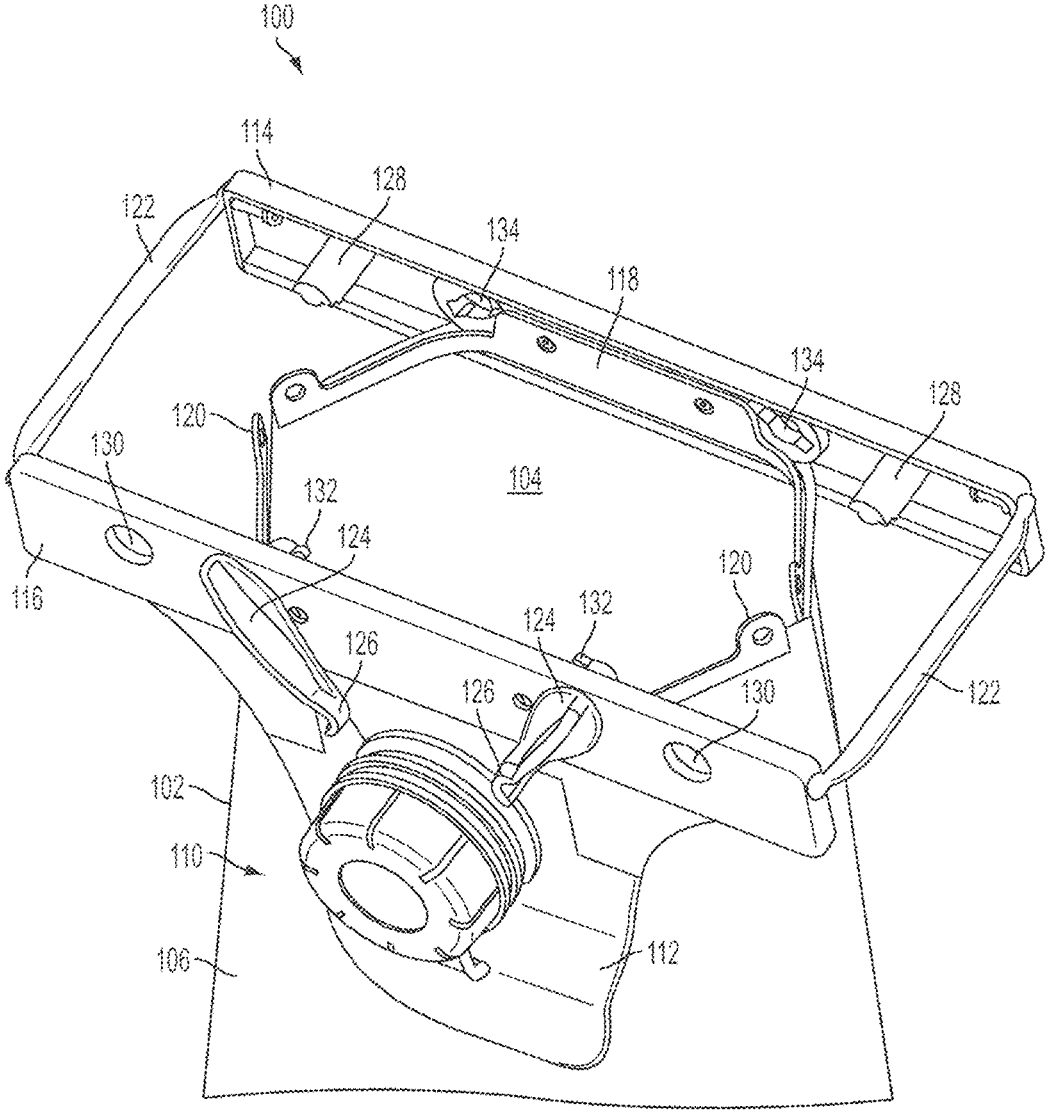
FIGS. 15 and 16 are perspective views of the closure of FIG. 10 in an open position.
Figure 16:
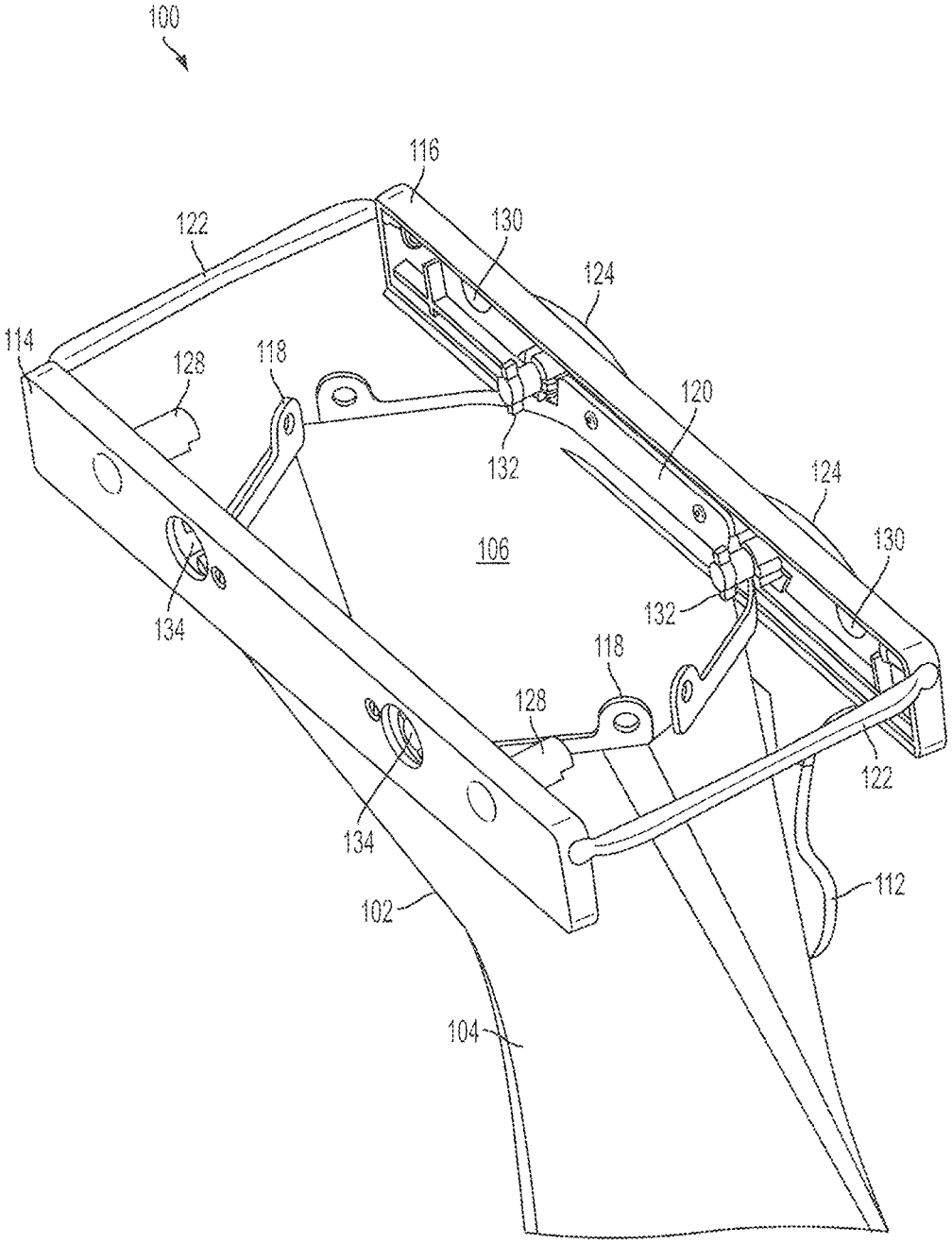

The rigid members 114, 116 can be coupled together at their lateral ends with flexible and/or hinged links, or linkages, 122 that can hold the members 114, 116 in lateral alignment, can guide them into proper sealing alignment, and can provide a limit to the separation distance between the rigid members when the upper opening is open (as shown in FIGS. 15 and 16). In other embodiments, the links 122 can be located inward from the lateral ends of the rigid members 114, 116, or can be located on the liners 118, 120, or can have other forms, such as springs, cords, etc.

Figure 14:
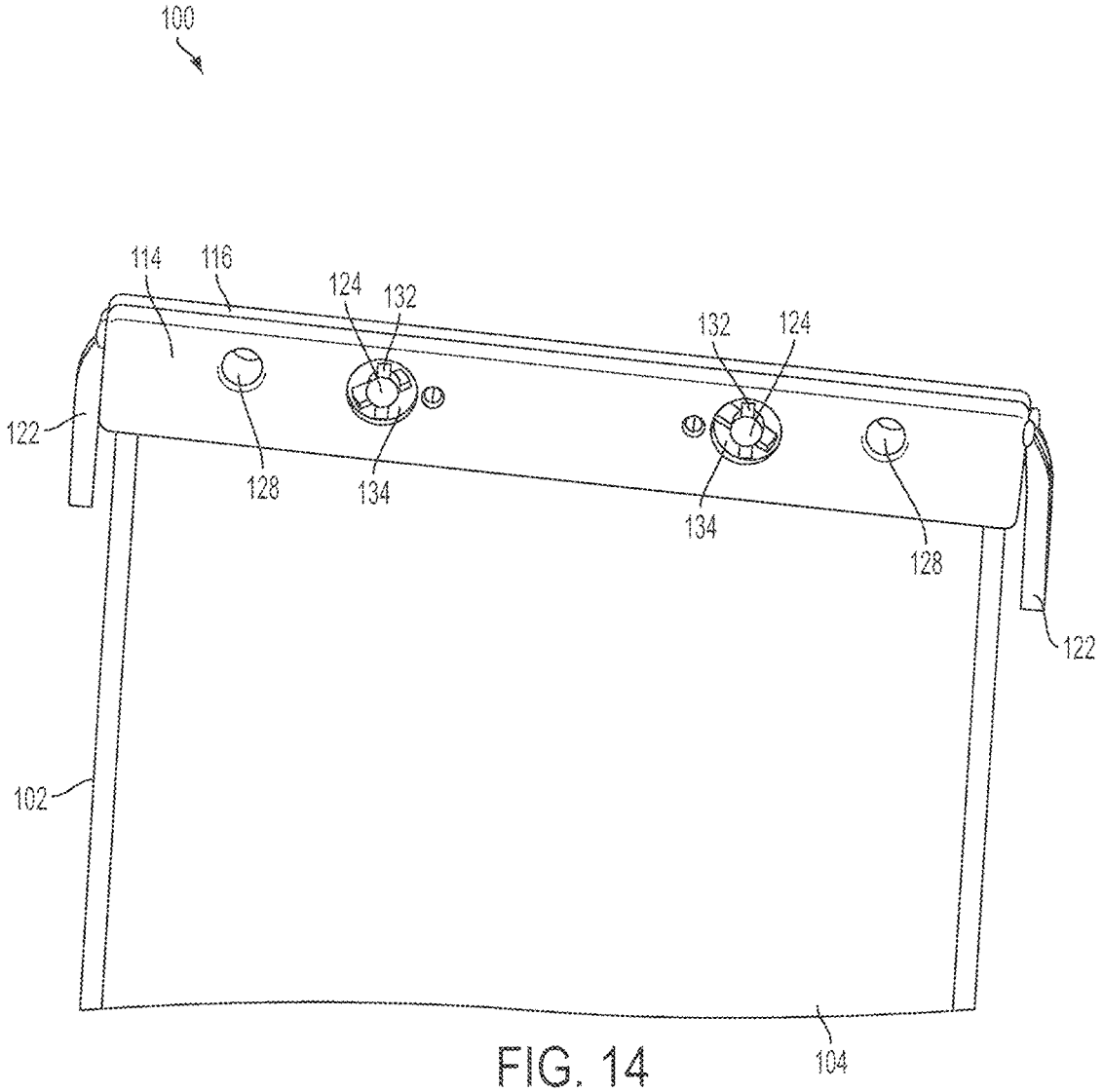
FIG. 14 is a perspective rear view of the closure of FIG. 10 in a closed position.
Figure 21:
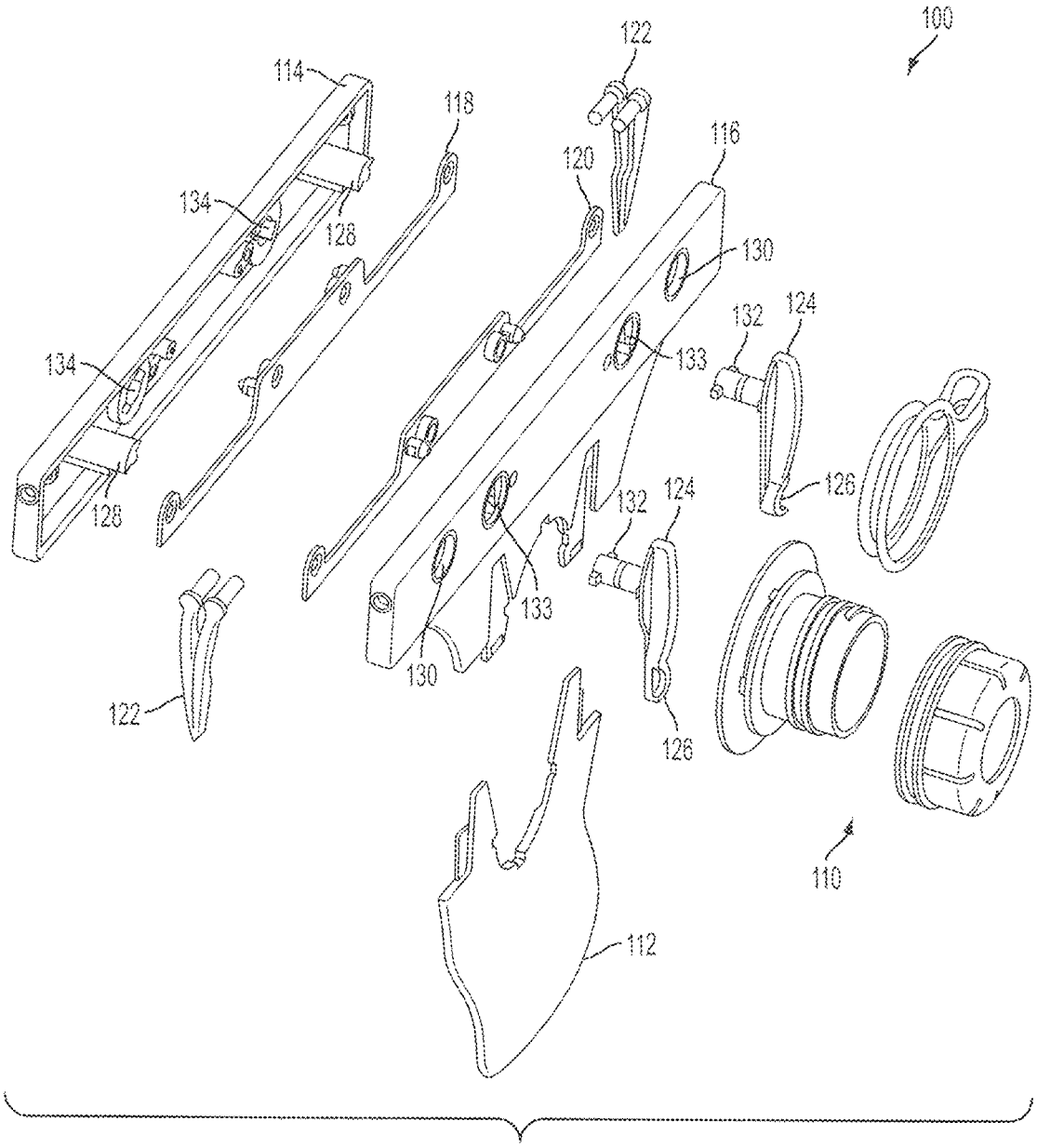
FIGS. 21 and 22 are exploded perspective views of the closure of FIG. 10.
Figure 22:
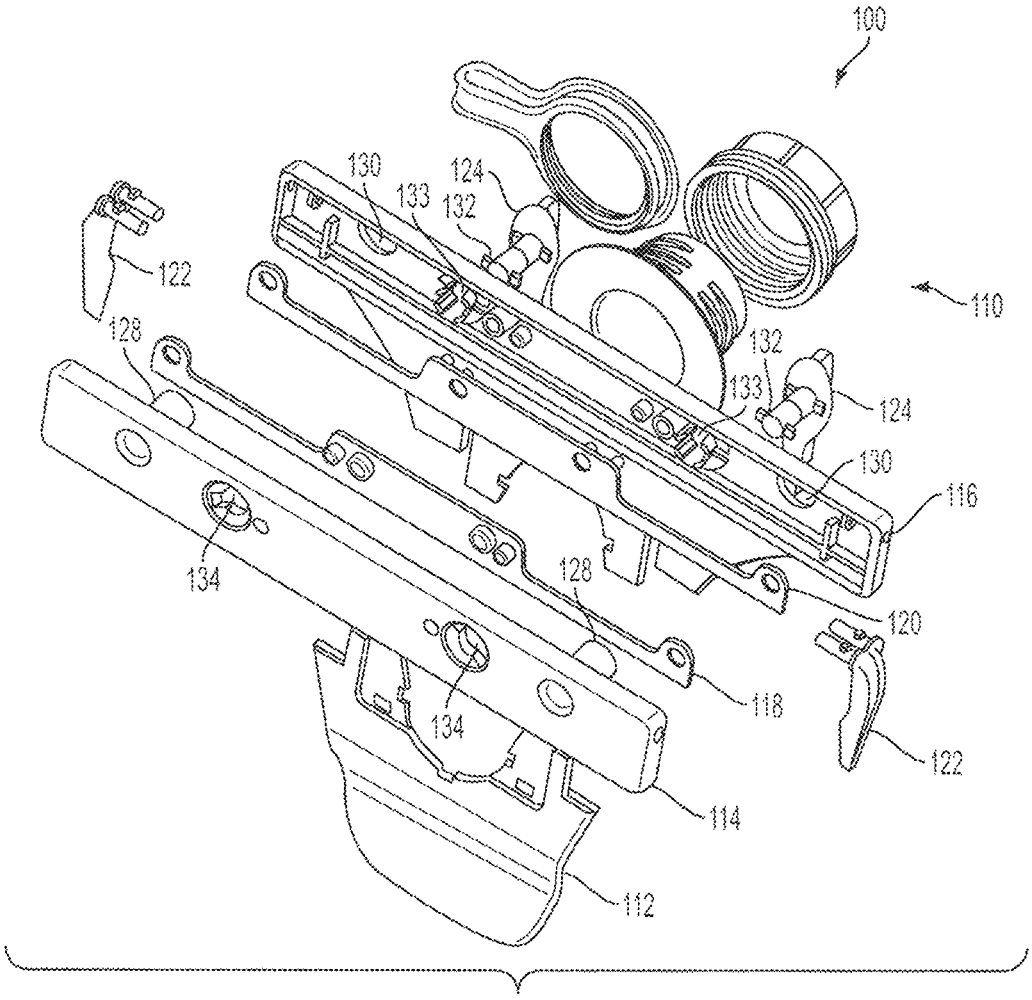

The closure can further comprise one or more fasteners, such as the two fasteners 124 that operate to selectively lock the closure closed to seal off the upper opening of the bladder 102. As shown in FIG. 21, the fasteners 124 extend through openings 133 in the front member 116 and into or through openings 134 in the rear member 114. The fasteners 124 can include tabs, flanges, or cams, 132 on their rear end portions that engage with ramp-like surfaces on rear surfaces of the openings 134 (see FIG. 14), such that rotating the fasteners 124, such as about 90°, can cause the tabs 132 to slide along the ramp-like surfaces of the openings 134 to a closed and/or locked position and create compression between the rigid members 114, 116 that seals the upper opening. FIG. 14 shows such a closed configuration from the rear.

In the closed configuration, the liners 118, 120 and/or the upper ends of the bladder sheets 104, 106 can provide a water-tight seal between the rigid members 114, 116, which are held compressed together by the fasteners 124. In some embodiments, the inner surfaces of the rigid members 114, 116 can form a tongue-and-groove type engagement, such as over the liners 118, 120, in the closed position that further pinches the rear and front sheets 104, 106 together to improve the seal.

Figure 17A:
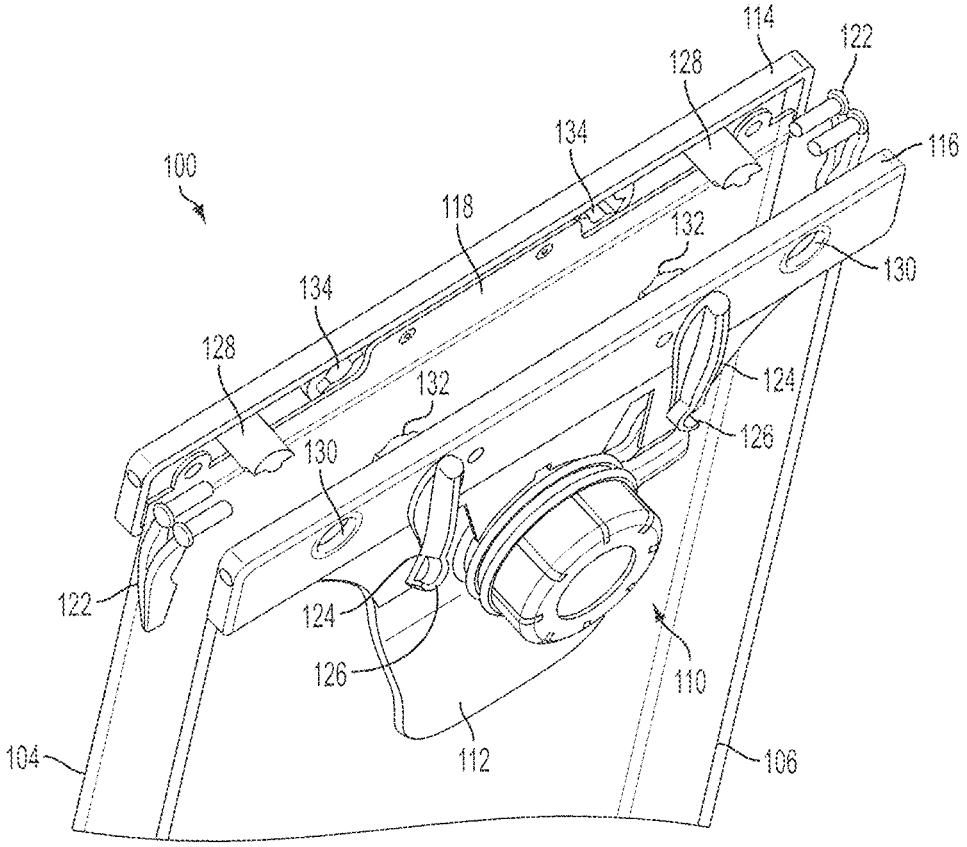
FIG. 17A is a partially exploded perspective view of the closure of FIG. 10 showing the closure components in a partially open position.
Figure 17B:
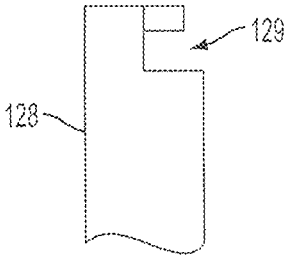
FIG. 17B is a side view of an exemplary projection extending from a rear rigid member of the closure.
Figure 17C:
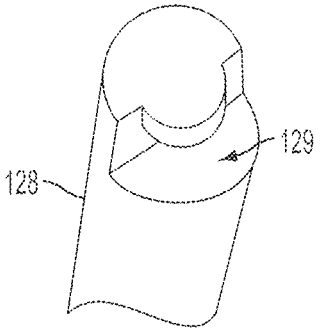
FIG. 17C is a perspective view of the projection of FIG. 17B.
Figure 17D:
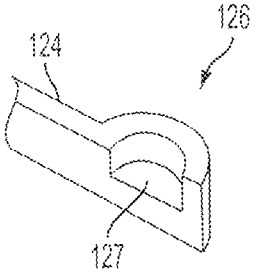
FIG. 17D is a perspective view of an exemplary latch of the closure that mates with the projection of FIG. 17C.
Figure 18:
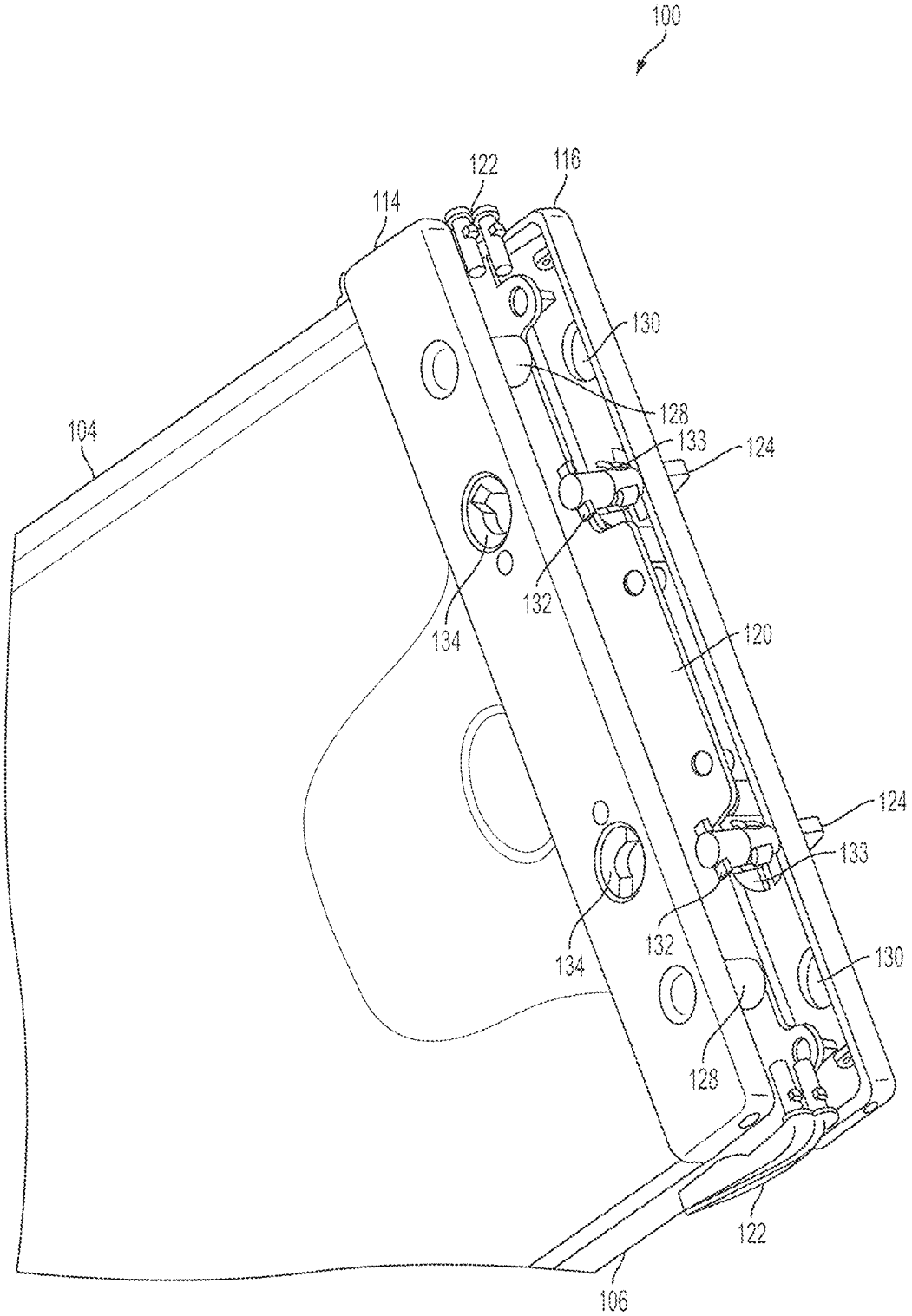
FIG. 18 is another partially exploded perspective view of the closure of FIG. 10 showing the closure components in a partially open position.
Figure 19:
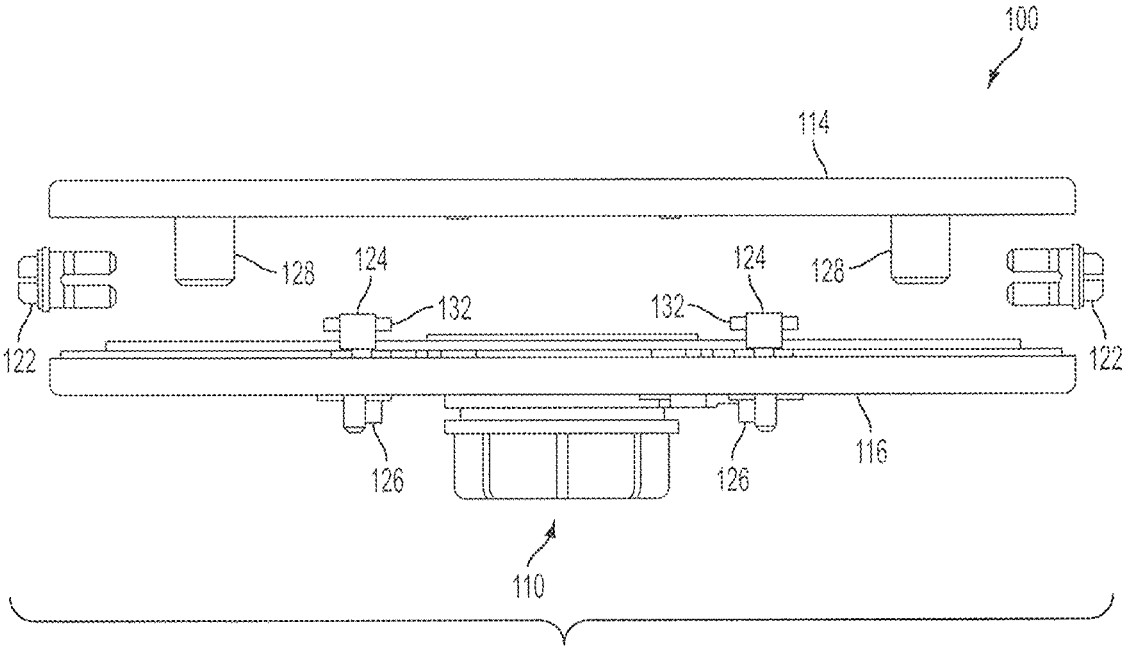
FIGS. 19 and 20 are partially exploded top views of the closure of FIG. 10 showing the closure components in the partially open position.
Figure 20:
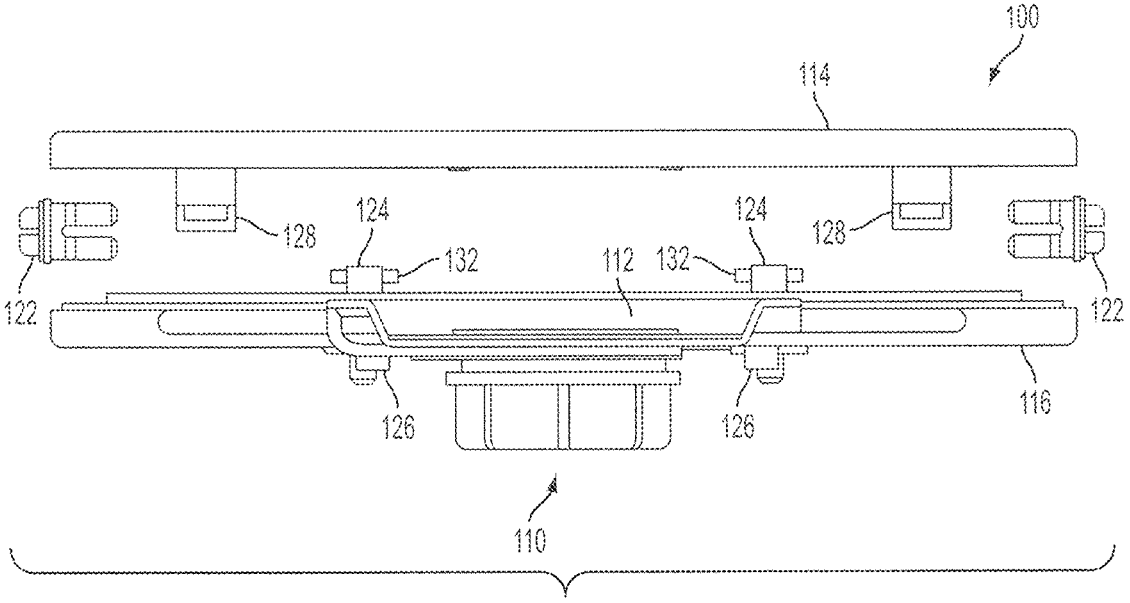

The fasteners 124 can further include latches 126 on the front side or outer side of the front member 116 that extend radially from the rotation axes of the fasteners. An exemplary latch 126 is shown in detail in FIG. 17C. As the fasteners 124 are rotated toward the closed position, each latch 126 can engage with protrusions or projections 128 that extend forward from the rear member 114 and through holes 130 in the front member offset laterally from the openings 133. An exemplary end of a protrusion 128 is shown in FIGS. 17B and 17C. When a fastener 124 is rotated to the closed position (see FIG. 10), an engagement surface 127 of the latch 126 engages with a recess 129 in the projection 128 to lock the fastener in the closed position and maintain the seal. In some embodiments, the locking engagement between the latch 126 and the protrusion 128 can include a snap-fit or friction-fit type engagement such that the engagement surface 127 is secured in the recess 129 and cannot exit the recess without overcoming substantial resistance, thereby preventing the latch from accidentally pivoting away from the protrusion. In some embodiments, the surface 127 and the recess 129 can include corresponding ridges, bumps, or grooves that align in the locked position to enable a snap-fit engagement that resists separation. When the surface 127 is positioned in the recess 129, the protrusion 128 is prevented from pulling out through the hole 130 and thus creates, along with the engagement between the tabs 132 and openings 134, a double-locking configuration for each fastener that secures the closure 100 in the closed position.

This double-locking configuration also provides additional points of compression along the interface between the rear and front rigid member 114, 116, complementing the compression caused by the tabs 132 and the ramp-like surfaces of the openings 134, to more evenly distribute the compression forces along the width of the upper opening of the bladder 102. Furthermore, a single rotation of the fasteners 124 by a user can be sufficient to engage both the tab-and-ramp mechanism and the latch-and-protrusion mechanism at the same time.

Figure 23:
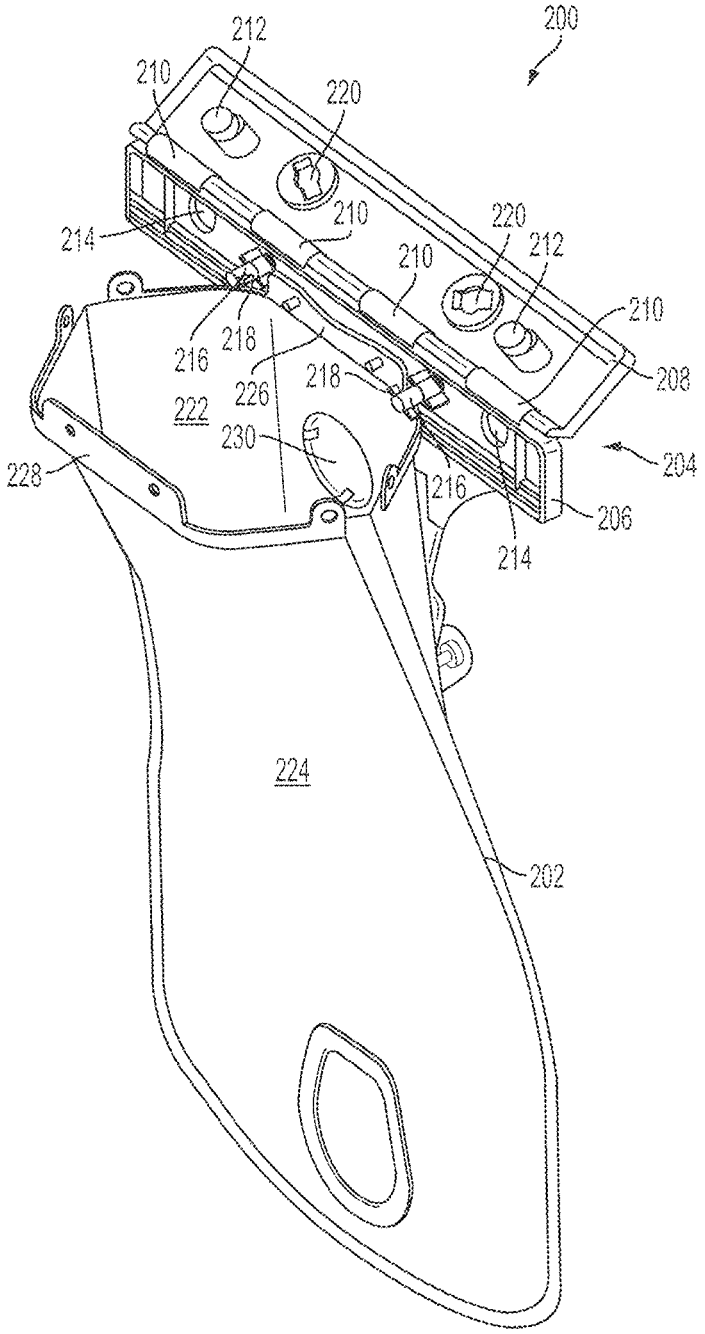
FIG. 23 shows another exemplary fluid bladder having a pivoting upper closure.

FIG. 23 shows yet another exemplary bladder assembly 200. The assembly 200 includes a bladder 202 and an upper closure 204. The upper closure 204 comprises a first rigid member 206 that is secured to rear side 222 of the bladder 202, and a second rigid member 208 that is hingedly coupled to the first rigid member 206 at hinge 210.

An open position is shown in FIG. 23. To close the bladder (not shown), the second member 208 is pivoted about the hinge(s) 210 and against the front side 224 of the upper end of the bladder 202, pinching the upper opening of the bladder between the first and second members 206, 208. Fasteners as described above with reference to assembly 100 can then be used in a similar manner to lock the closure in a closed, water-tight configuration. For example, projections 212 can extend through openings 214 while shafts 216 with cams 218 can extend through ramped openings 220. An outer latch (not shown) extending from each shaft 216 can be pivoted to cause the cams 218 to engage with the ramped openings 220 in the second rigid member 208 and/or to engage the outer latches with the projections 212 behind the first rigid member 206, as described above with embodiment 100. Liners 228 and 226 can also be provided at the top edge of the bladder to provide a more fluid tight seal between the rigid members 206, 208. A lateral fill port 230 can also be included, such as built into a handle portion extending from the first rigid member 206.

Figure 24B:
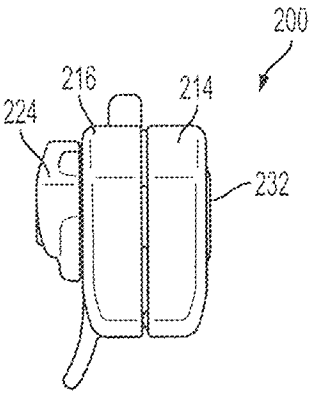
FIG. 24B is a side view of the closure of FIG. 24A in the closed position.
Figure 24A:
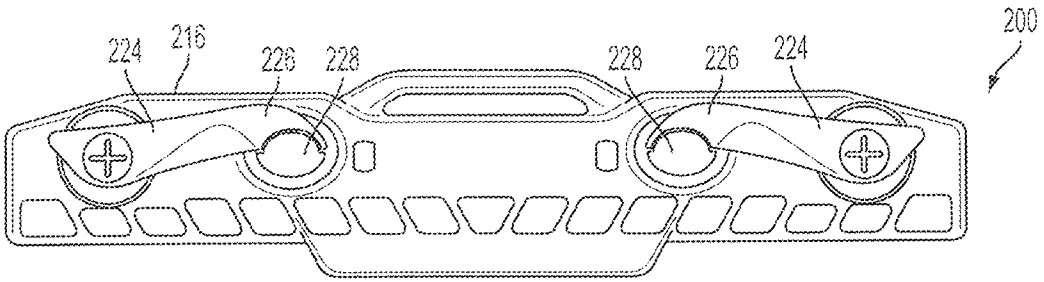
FIG. 24A is a front view of another exemplary closure, shown in a closed position.
Figure 24C:
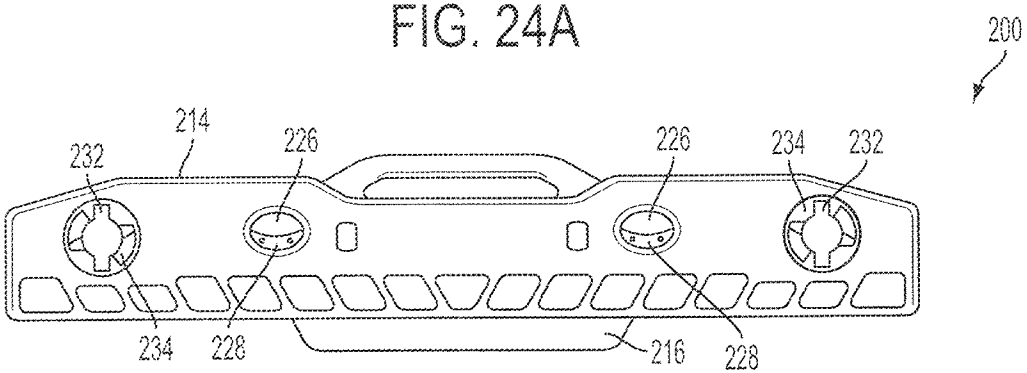
FIG. 24C is a rear view of the closure of FIG. 24A in the closed position.
Figure 24D:
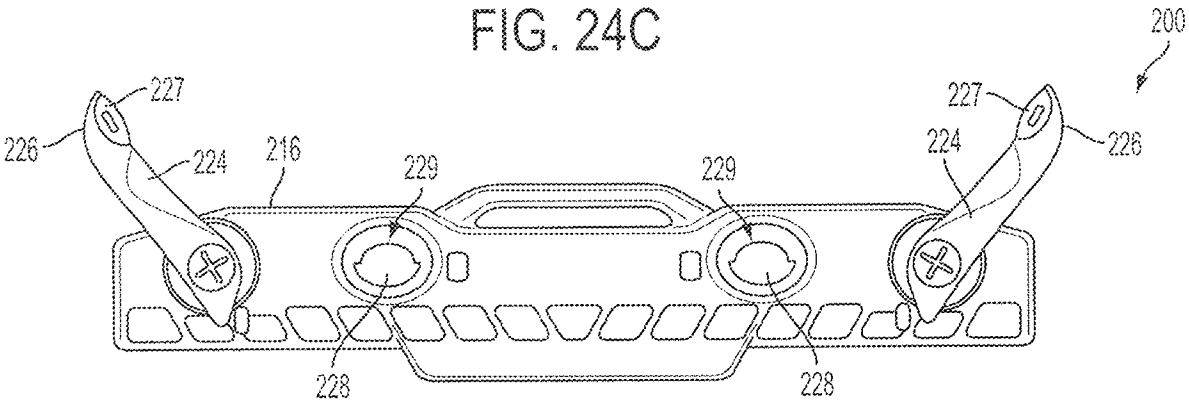
FIG. 24D is a front view of the closure of FIG. 24A in an unlocked or open position.
Figure 27:
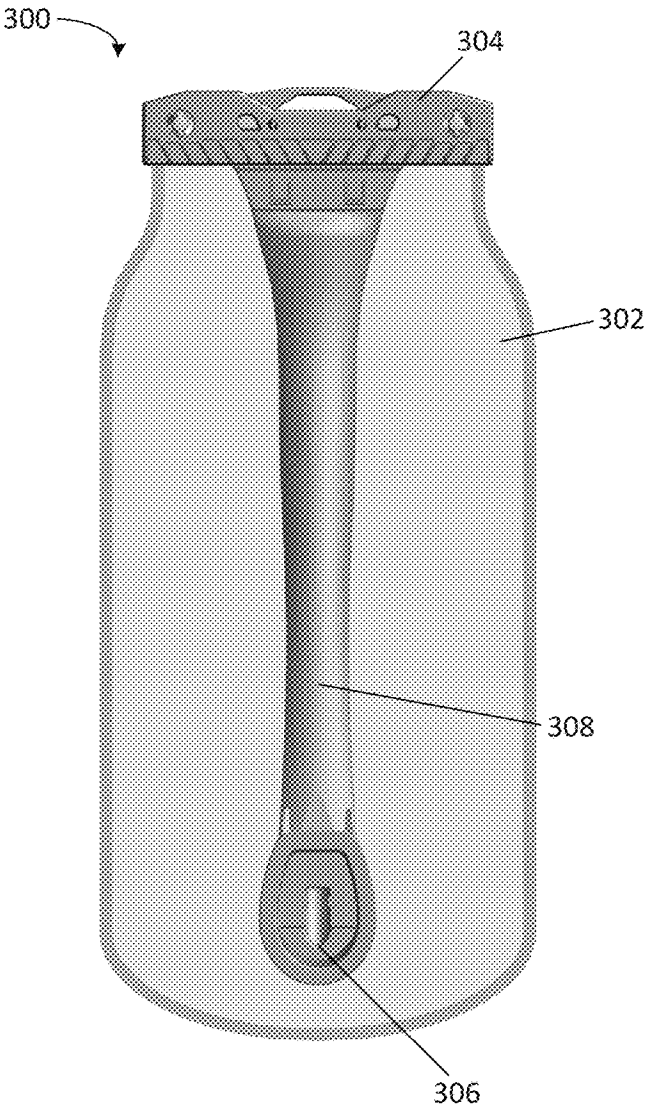
FIGS. 25-27 are front, side, and rear views of an exemplary fluid container with a top closure, a lower exit port, and a handle extending therebetween.
Figure 26:
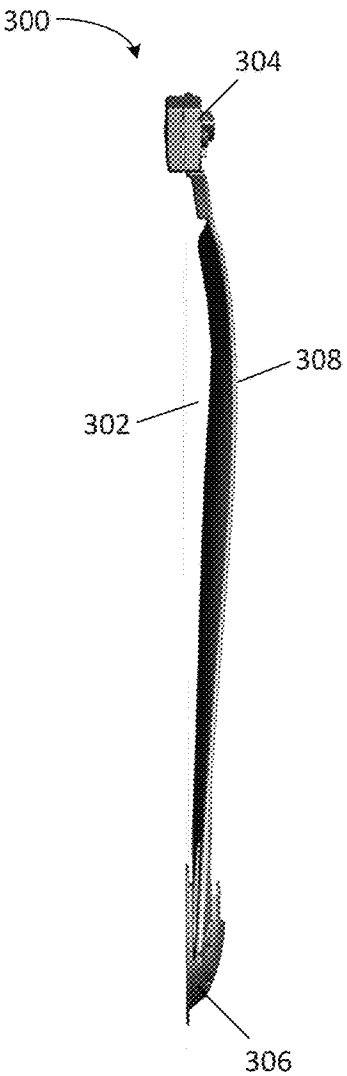
Figure 25:
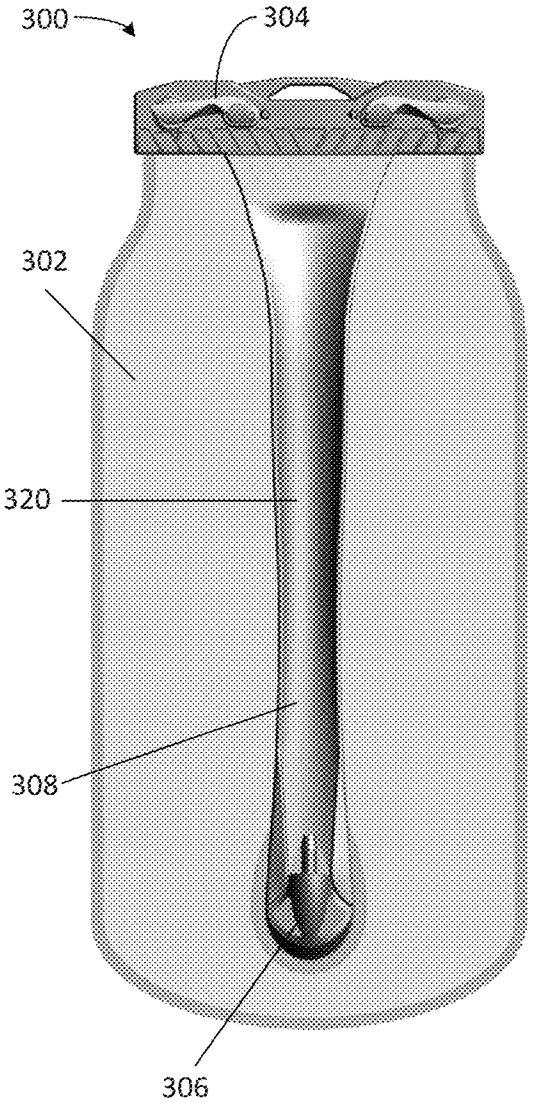
Figure 28:
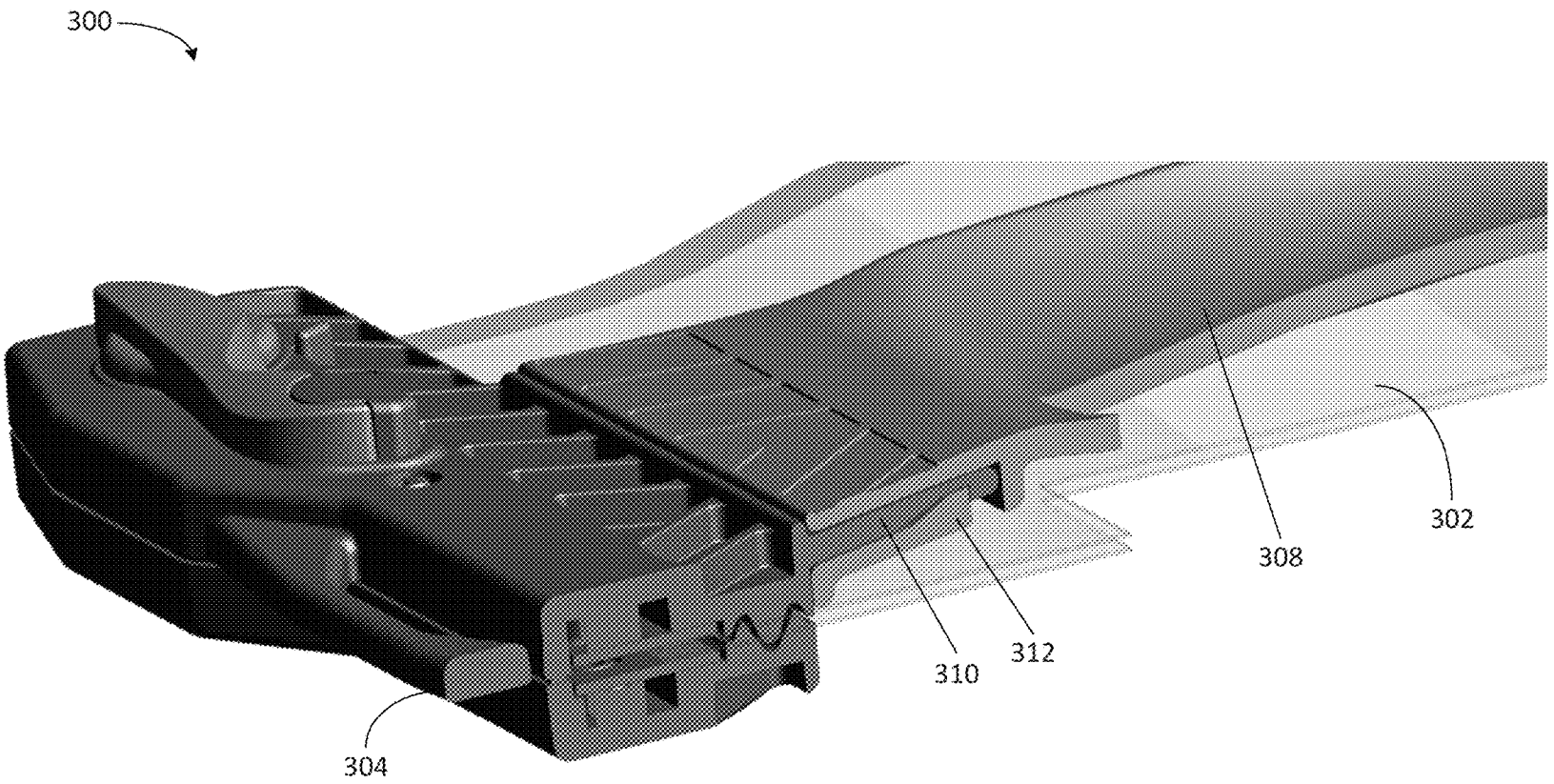
FIG. 28 is a perspective cross-sectional view of the closure and upper handle of the fluid container of FIG. 25.

FIGS. 24A-24D shows an alternative closure 200 that is similar to the closure 100 described above. FIG. 24A shows a front view of the closure 200 in the closed position, FIG. 24B shows a side view of the closure 200 in the closed position, and FIG. 24C shows a rear view of the closure 200 in the closed position. FIG. 24D shows a front view of the closure 200 in an unlatched and/or open position. The closure includes a rear plate 214, a front plate 216, and two wide set fasteners 224 that are pivotably mounted in the front plate. The rear plate 214 includes projections 228 that are positioned between the pivot axes of the fasteners 224 and that extend through openings in the front plate 214 to engage with the latches 226 of the fasteners to provide a clamping and locking mechanism. The fasteners 224 also project through the front plate 216 at their pivot axes and include tabs 232 that engage with ramped engagement openings 234 in the rear plate (FIG. 24C) to provide a clamping force between the plates. As shown in FIG. 24D, the ends of the projections can include recesses or notches 229 that receive engagement surfaces 227 of the latches 226. The recesses or notches 229 and engagement surfaces 227 can be shaped similar to as shown and described with reference to FIGS. 17B, 17C, and 17D. The closure 200 can be structured and can function similarly to the closure 100, but with the latches and the projections reversed.

Figure 30:
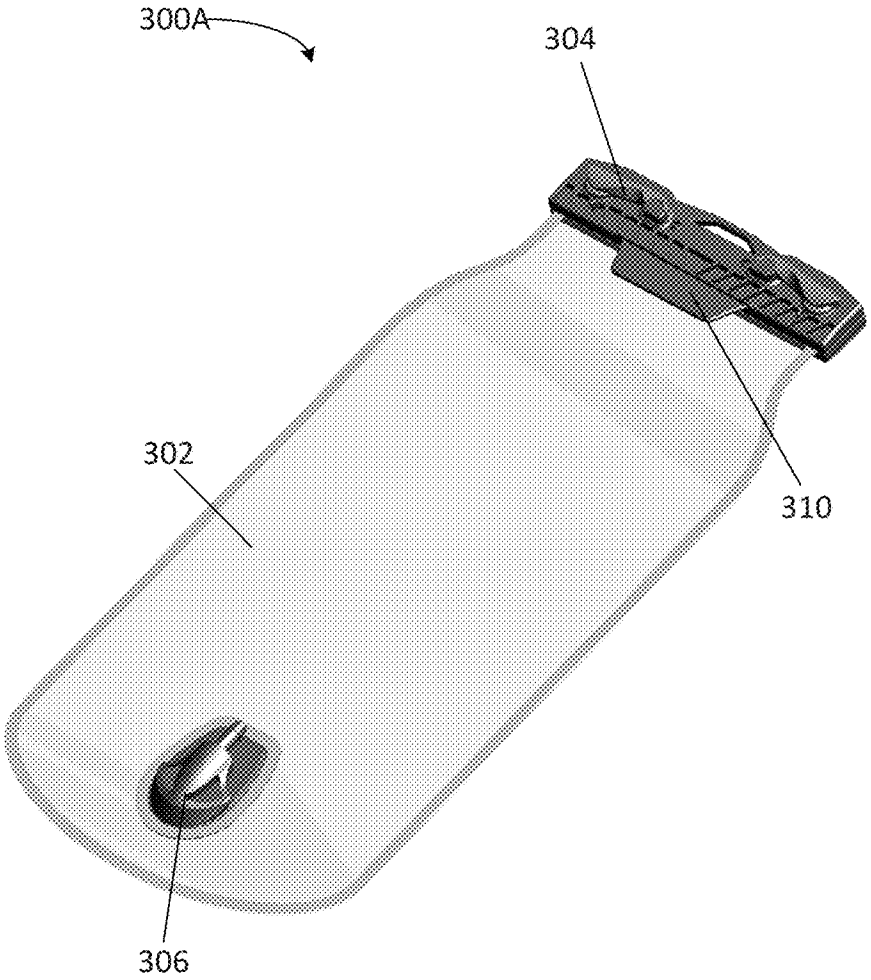
FIG. 30 is a perspective view of the fluid container of FIG. 29, without the handle.
Figure 29:
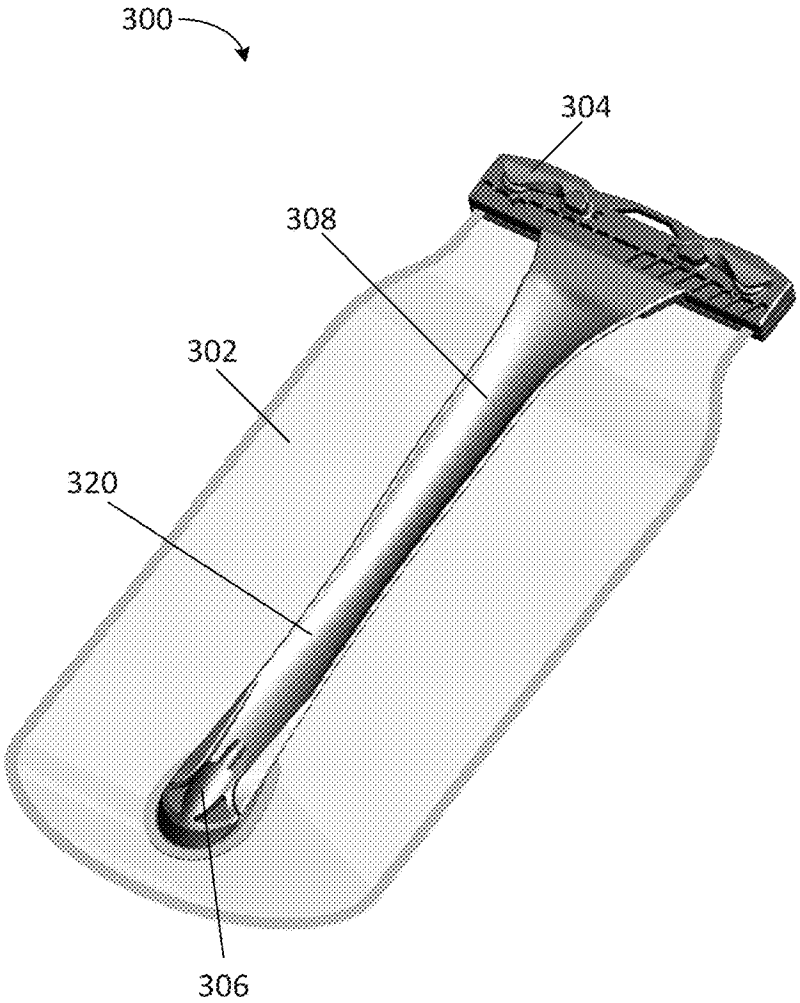
FIG. 29 is a perspective view of the fluid container of FIG. 25.
Figure 32:
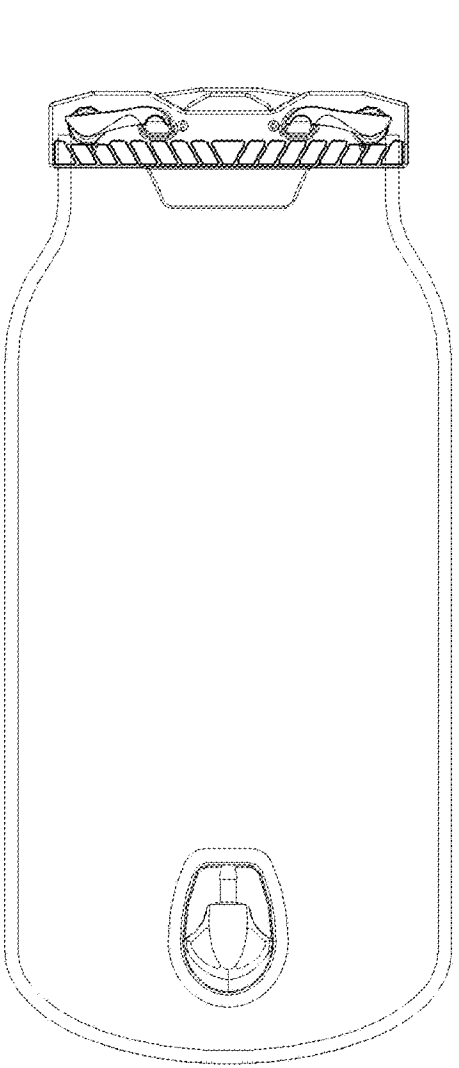
FIGS. 31 and 32 are front views of the fluid containers of FIGS. 29 and 30, with exemplary dimensions shown in millimeters.
Figure 31:
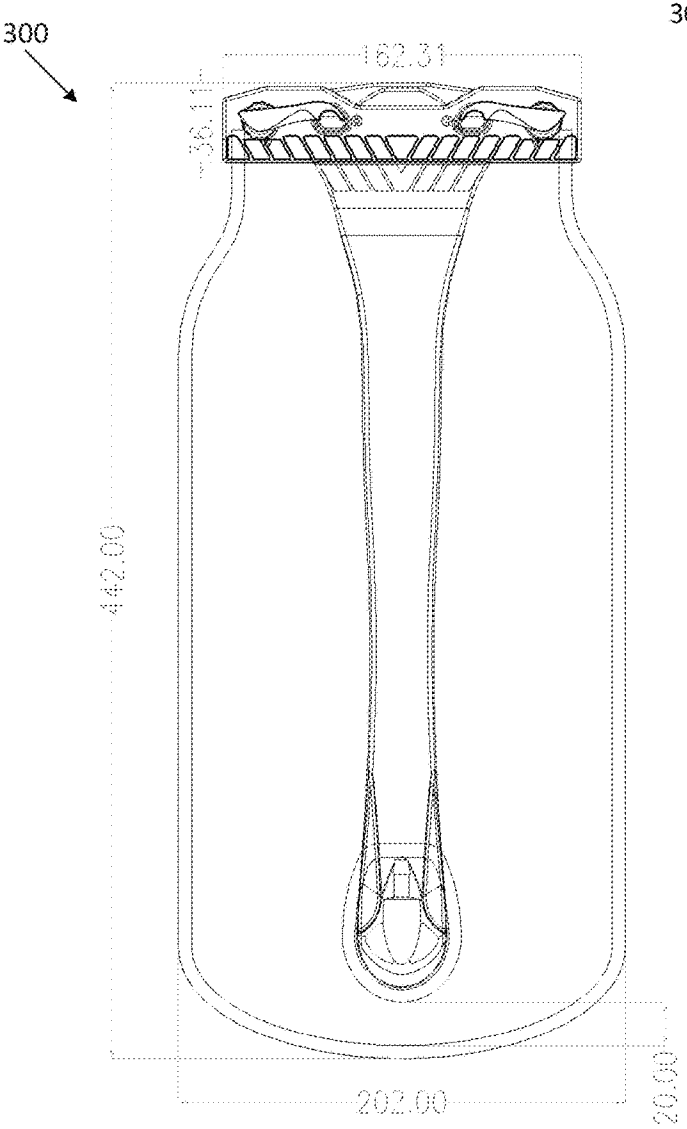

FIGS. 25-29 show another exemplary fluid container 300 comprising a flexible fluid bladder 302 having an upper opening closable with a top closure 304, a lower fluid exit port 306, and a handle 308 extending between the top closure and the exit port. The fluid bladder 302, top closure 304, and exit port 306 can be similar to other embodiments disclosed herein. For example, the top closure 304 can be similar to the closure 100 shown in FIGS. 10-22 or the closure 200 shown in FIGS. 24A-24D. In addition, the top closure 304 can include an extension or adapter 310 (FIG. 28) configured to be coupled to the handle 308. The handle 308 and the adapter 310 can comprise a snap-fit engagement mechanism, such as the coupling mechanism 312 shown in FIG. 28 that allows the handle 308 to be secured to the adapter 310 without fasteners or adhesives or welds. The handle 308 can have a curvature 320 that provides an outer recess running the vertical length of the handle 308, which can enhance the grippability of the handle 308. The lower end of the handle 308 can be coupled to the exit port 306 in any manner, and/or can be secured directly to the front panel of the flexible bladder 302. The handle 308 can be permanently secured to the top closure 304 and exit port 306, or can be readily detachable and re-attachable. FIGS. 30 and 32 show a fluid container 300A that does not include a handle. With a handle 308, the fluid bladder 302 can be more easily handled during filling, cleaning, and transportation. Even without the handle, the adapter/extension 310 projecting down from the closure 304 can provide a rigid surface for a user to hold to manipulate or support the bladder. FIGS. 31 and 32 show exemplary dimensions for the containers 300 and 300A, with dimensions shown in millimeters.

Figure 34:
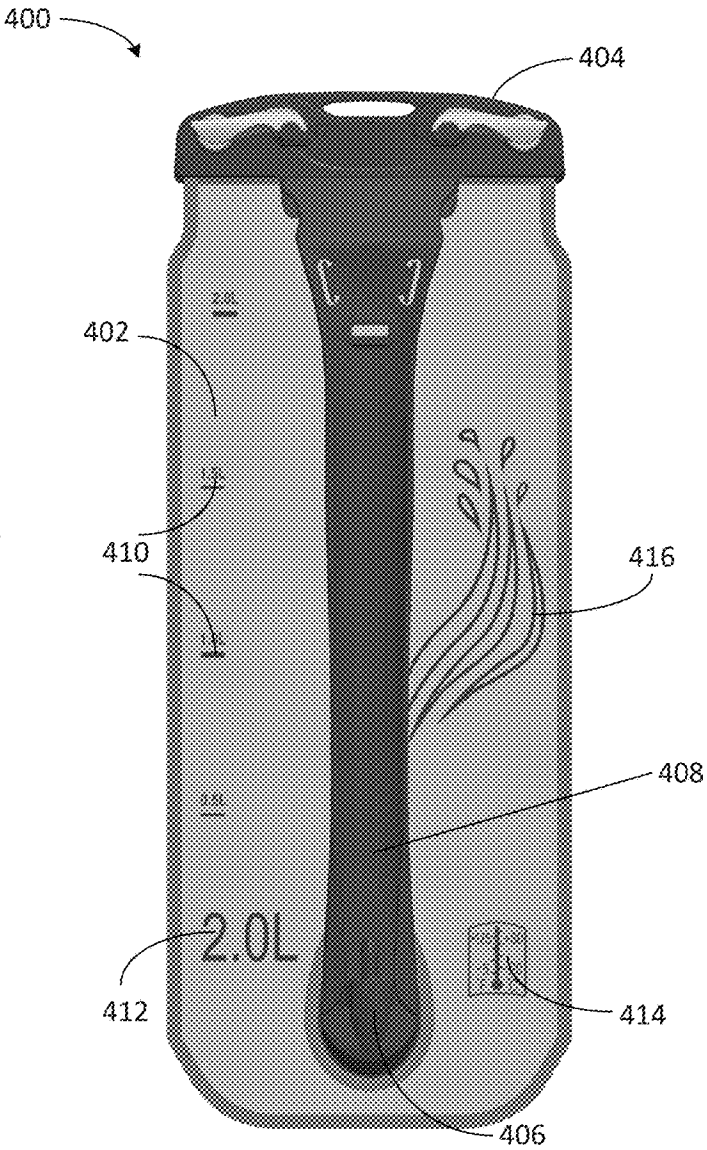
FIG. 34 is a front view of the fluid container of FIG. 33 with a handle attached.
Figure 33:
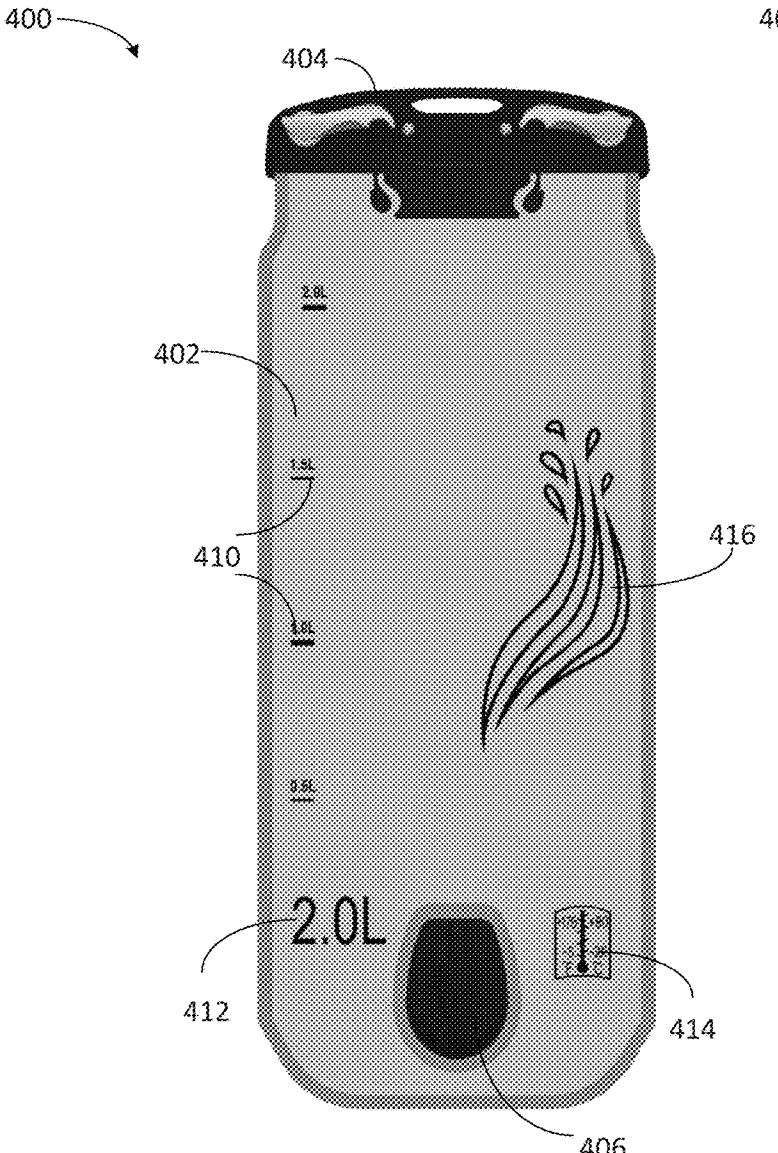
FIG. 33 is a front view of another exemplary fluid container.

FIGS. 33-34 show another exemplary fluid container 400 similar in construction to the fluid container 300 of FIGS. 25-29. The fluid container 400 can include a handle 408 that is attachable and detachable from the fluid container 400. FIG. 34 shows the bladder 402 similar in construction to the bladder 308 of FIGS. 25-29 along with a top closure 404, and an exit port 406, similar in construction to the top closure 304 and the exit port 306, respectively of FIGS. 25-29. The handle 408 can attach to the closure 304 and the exit port 306 with manual release mechanism.

The fluid container 400 additionally can comprise volume markings 410, a maximum volume marking 412, a temperature indicator 414, and/or ornamental marking 416. The volume markings 410 can indicate the volume of liquid contained in fluid bladder 402 when the bladder 402 is partially filled. In the illustrated embodiment of FIGS. 33-34, the volume markings 410 are indicated in liters. In other embodiments, the volume markings 410 can be indicated in other units of measurement. The maximum volume marking 412 can indicate the maximum volume of liquid that can fill the bladder 402. In the illustrated embodiment of FIGS. 33-34, the maximum volume is 2 liters. In other embodiments, the maximum volume can be any other volume. The temperature indicator 414 can indicate the temperature of a liquid in the bladder 402. The ornamental marking 416 can indicate a brand name, model type, and/or can contain decorative ornamentation or any other type of marking. The volume markings 410, the maximum volume marking 412, the temperature indicator 414, and the ornamental marking 416 can be located anywhere on the outer surface of the bladder 402.

FIGS. 35-39 show various views of a buckle 500 that can be used to secure a fluid container such as fluid container 300 to a pack, such as a backpack, waist pack, or other receptacle. As used herein, the term buckle can be used to describe any fastening member that can couple two objects together in a releasable and re-attachable manner. This can include a single piece or component such as the buckle 500 of FIGS. 35-39. The term buckle can also be used to refer to either one part of two fastening members that can couple together, such as male buckle 602 or female buckle 604 of FIG. 40. Alternatively, the term buckle can refer to two fastening members together, such as both male buckle and female buckle 602, 604.

Figure 39:
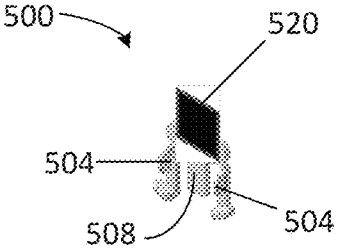
Figure 36:
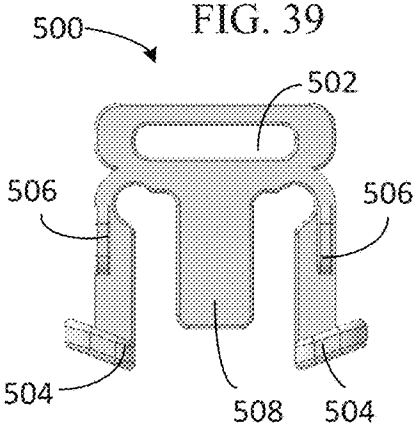
Figure 35:
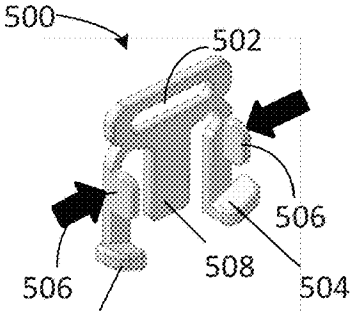

Referring to FIGS. 35-39, the buckle 500 can secure a fluid container such as fluid container 300 to pack such that the fluid container can be easily carried. One portion of the buckle 500 can include an opening 502 or other attachment feature. In some examples, a strap such as strap 520 of FIG. 39 can be passed through opening 502. In the example of FIG. 39, the buckle 500 can be attached to a fluid container that is then hung from the strap 520. In other examples, the opening 502 can be used to pass a button, screw, or other securing device to secure a fluid container to a pack. The buckle 500 can further comprise angled locking pieces 504 on either side of the buckle 500 and straight locking pieces 506 on either side of the buckle 500. The locking pieces 504, 506 can be used to secure the buckle 500 to an opening in a handle such as opening 702 of handle 700 as discussed in connection with FIGS. 41-42. The buckle can further comprise a strip 508 to reinforce the securement of the buckle 500 to a pack. The buckle 500 can be made of plastic or any other material.

Figure 40:
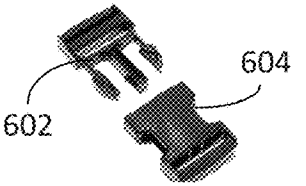
FIG. 40 is a view of another example buckle.
Figure 38:
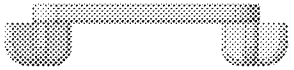
FIGS. 35-39 are views of an example buckle.
Figure 37:
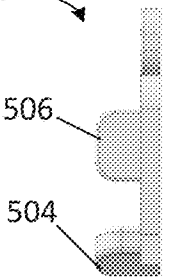

FIG. 40 shows another example securing device 600 that can be used to secure a fluid container to a pack. The securing device 600 can comprise a side release male buckle 602 and a side release female buckle 604. The male buckle 602 can be inserted into the female buckle 604 to securely couple the male buckle 602 to the female buckle 604. Once coupled together, pressing the sides of the male buckle 602 inwards will allow the male buckle 602 to be removed from the female buckle 604. The male buckle 602 and the female buckle 604 can be secured to a fluid container and a pack, respectively, or vice versa. The male and female buckle 602, 604 can then be coupled together to secure the fluid container to the pack to allow for easy carrying and/or transport of the fluid bladder.

Figure 42:
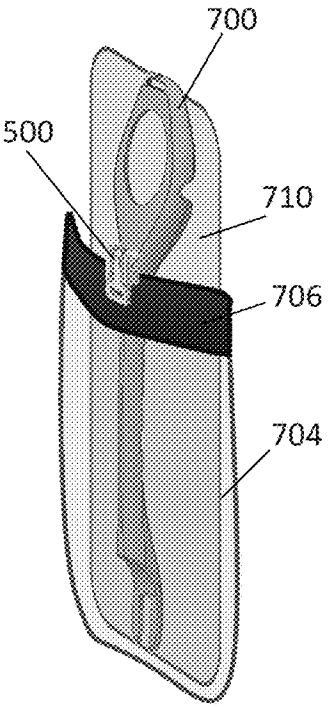
FIGS. 41-42 are views of another example fluid container.
Figure 41:
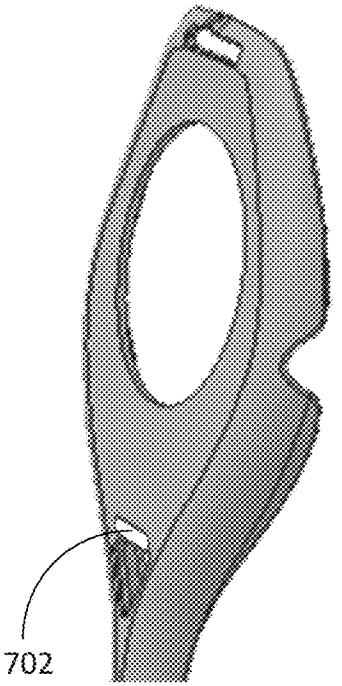

FIGS. 41-42 show an example handle 700 that can be secured to a fluid container such as fluid container 302. The example handle 700 includes a connecting slot 702 that a buckle such as buckle 500 can be connected to. FIG. 41 shows the handle 700 and the connecting slot 702 without a buckle attached thereto. FIG. 42 shows the handle 700 with buckle 500 connected to the connecting slot 702. In the example of FIG. 42, the handle 700 can be secured to a closure and an exit port (not shown in FIG. 42), which can be constructed in a similar manner to closure 404 and exit port 406, respectively. The closure and exit port can be secured to a fluid bladder 710, which can be constructed similarly to fluid bladder 302. The buckle 500 can be tightly secured to the connecting slot 702 with the locking pieces 504, 506 locking the buckle 500 in place in the connecting slot 702. The example of FIG. 42 also includes a reservoir sleeve 704. The reservoir sleeve 704 can be used to hold the bladder 710. In some examples, the reservoir sleeve 704 can be sewn or otherwise secured to a pack. The reservoir sleeve 704 can be made of fabric or any other suitably flexible material. An upper edge portion of the reservoir sleeve 704 can include a reinforcing strip 706. In the illustrated example of FIG. 42, the reinforcing strip 706 is made of polymeric material. In other examples, the reinforcing strip 706 can be made of any other suitably strong material. The buckle 500 can be secured to the reservoir sleeve 704 or the reinforcing strip 706 such that the handle 700 and the bladder 710 are secured to the reservoir sleeve 704 for easy carrying and transport.

Figure 44:
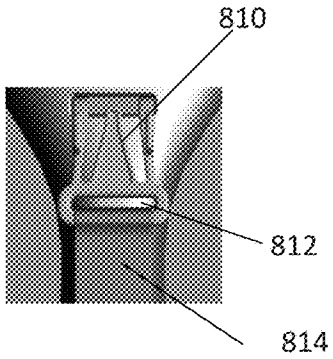
FIGS. 43-46 are views of another example fluid container.
Figure 43:
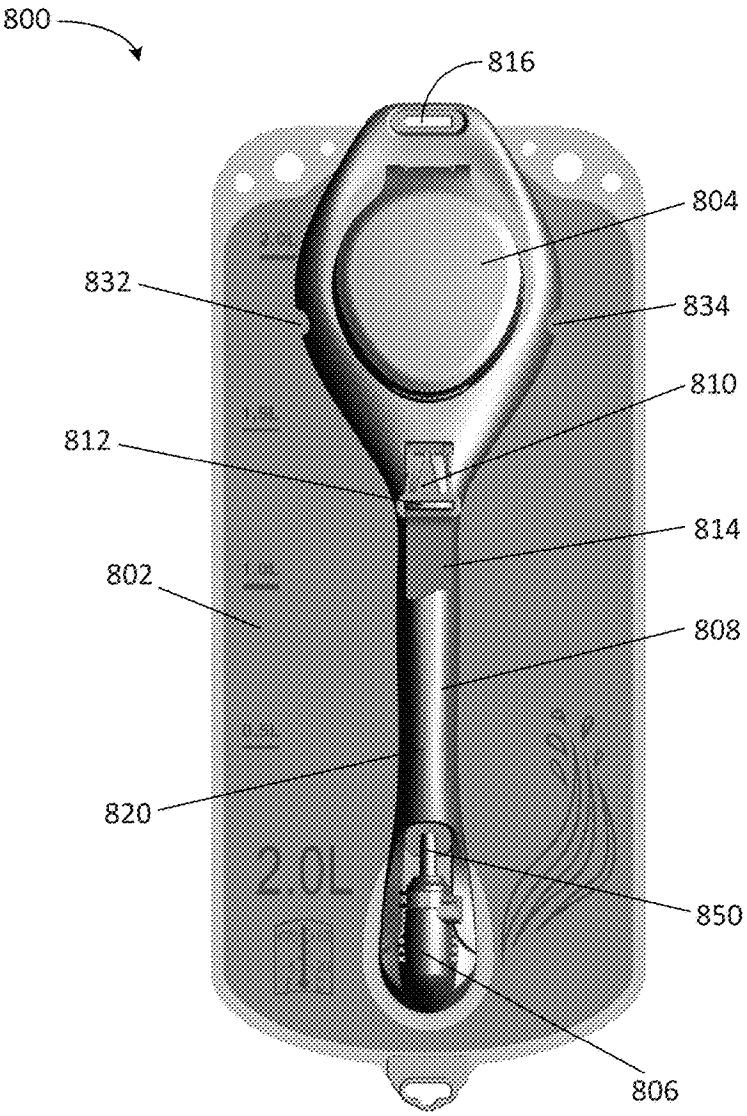
Figure 46:
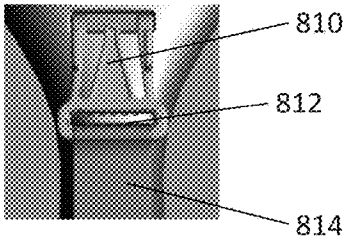
Figure 45:
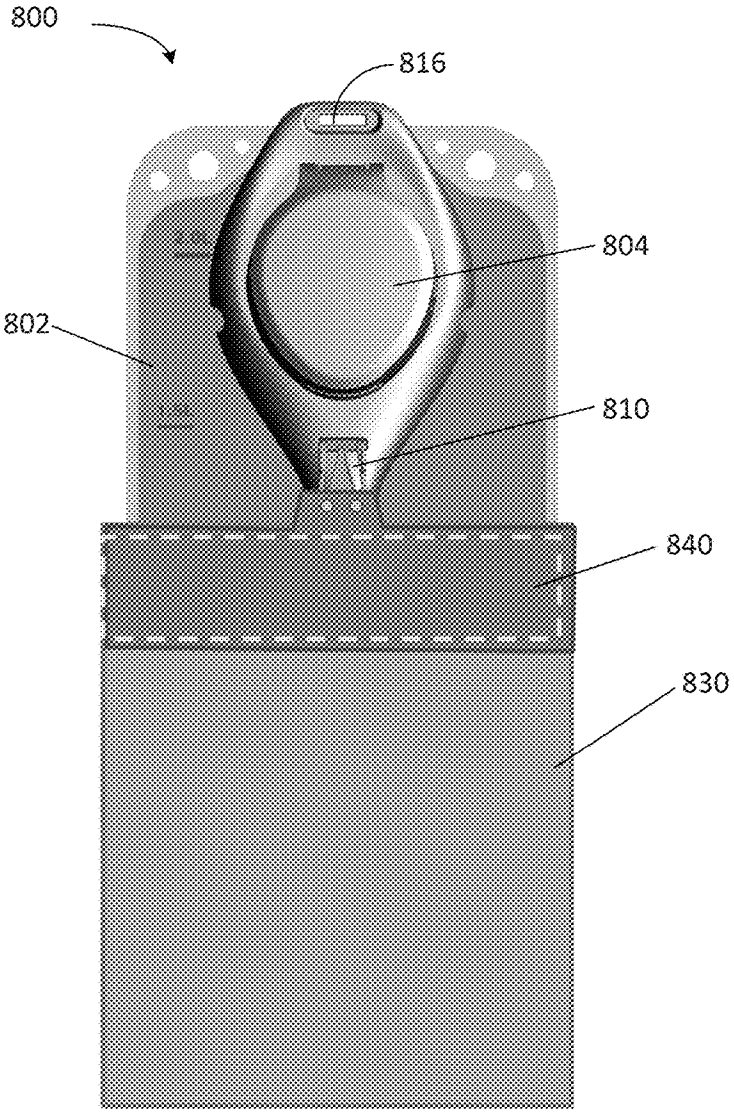
Figure 47:
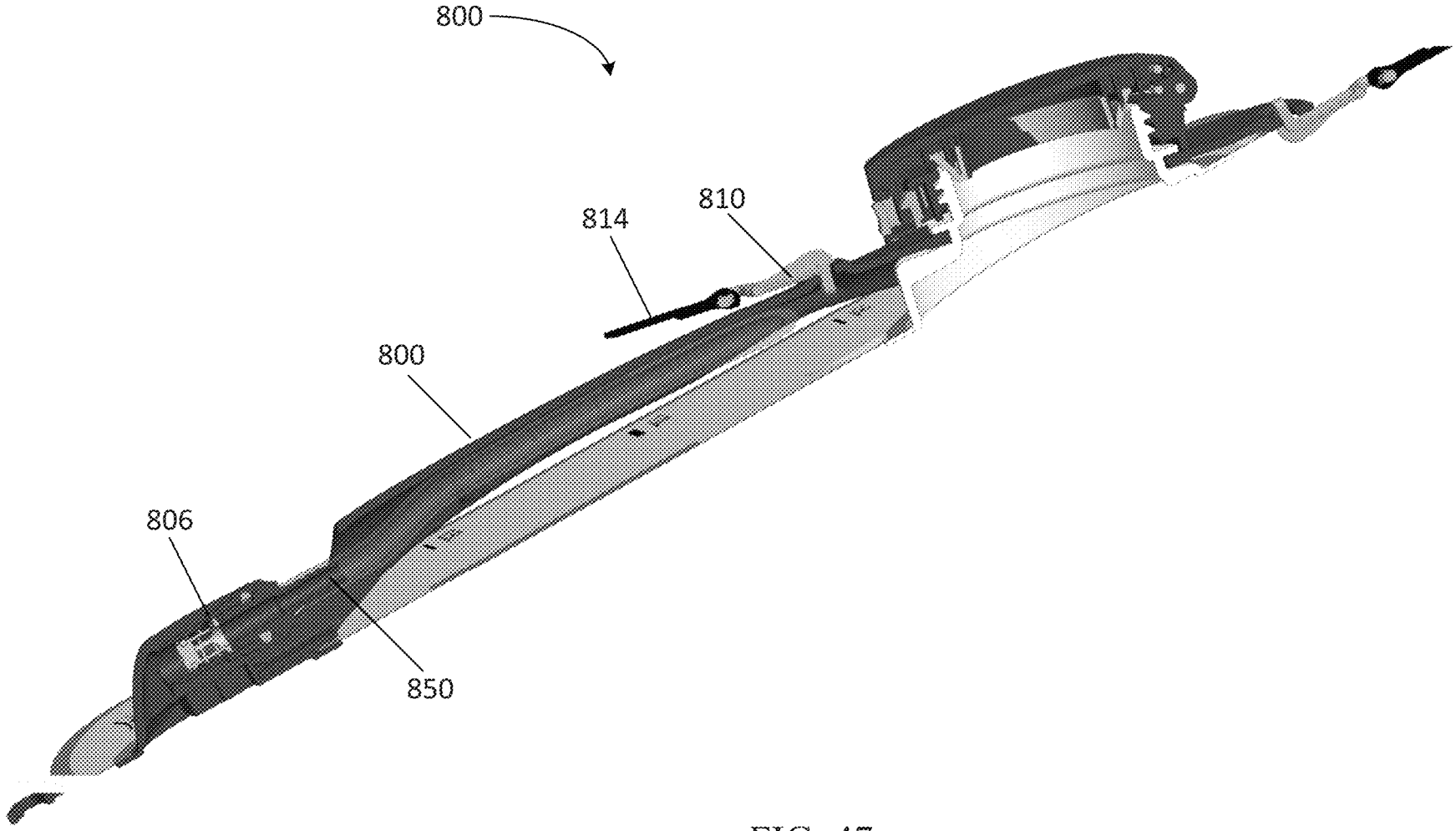
FIGS. 47-48 are views of another example fluid container.
Figure 48:
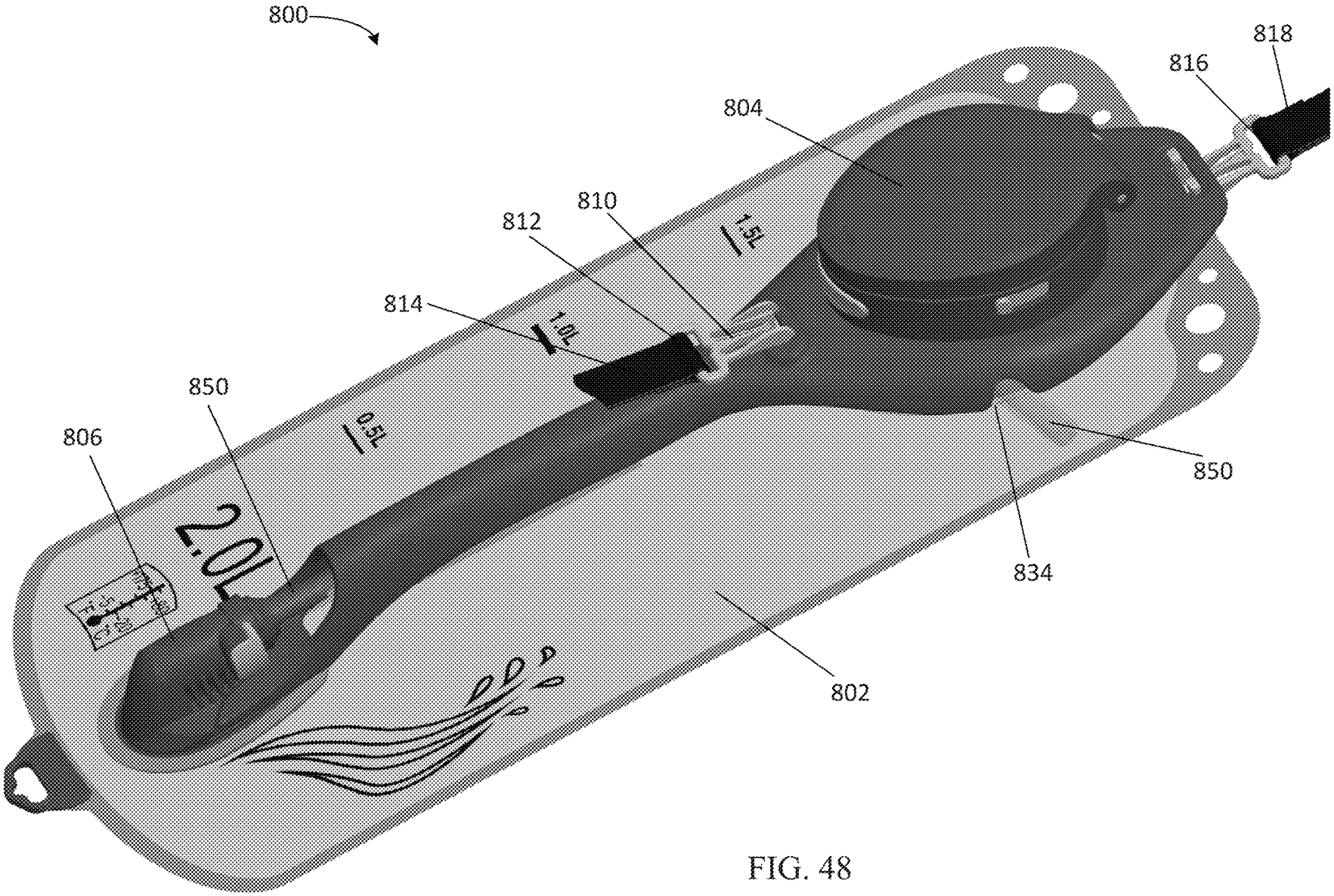

FIGS. 43-48 show various views of another example fluid container 800. The fluid container 800 includes a flexible fluid bladder 802 similar in construction to fluid bladder 302 of FIGS. 25-29. The fluid container 800 can further comprise an exit port 806 similar to exit port 306, a rigid, detachable handle 808, and a closure 804 that can be secured to an upper portion of the bladder 802. The closure 804 can be constructed in a similar manner to the dual opening cap described in US Patent Publication 2016/0362229, published Dec. 15, 2016, which is hereby incorporated by reference in its entirety. The closure 804 can be opened to allow for access to the inside of the bladder 802 for filling, cleaning, etc. The handle 808 can have a curvature 820 similar to the curvature 320 of handle 308. A straw or fluid exit tube 850 can be coupled to the exit port 806. The curvature 820 of the handle 808 can allow the straw 850 to sit between an inner surface of the handle 808 and the bladder 802. The straw 850 can extend along the length of the handle 808 and the straw 850 can protrude out of straw opening 832 or straw opening 834. The end of the straw 850 protruding out of one of the openings 832, 834 can be used to drink liquid from the bladder 802. A buckle 810 can be secured to the handle 808. The buckle 810 can be similar in construction to the buckle 500 of FIGS. 35-39. The buckle 810 can contain an opening 812 and a strap 814 can be secured to the buckle 810 through the opening 812 as shown in FIGS. 43-44 and 46. The strap 814 can be a strap of a pack used to secure the fluid container 800 to the pack. The illustrated embodiment of FIG. 45 includes a reservoir sleeve 830 similar to reservoir sleeve 704 and a reinforcing strip 840 similar to reinforcing strip 706. Referring to FIG. 45, the buckle 810 is secured to the reinforcing strip 840. In some embodiments, the buckle 810 is detachably connected to the reinforcing strip 840. In other embodiments, the buckle 810 can be fixedly connected to the reinforcing strip 840 with rivets or other means. The closure 804 can further comprise a second opening 816 near its upper end. In the illustrated embodiment of FIG. 48, a second strap 818 is secured to the closure 804 through the second opening 816.

Figure 50:
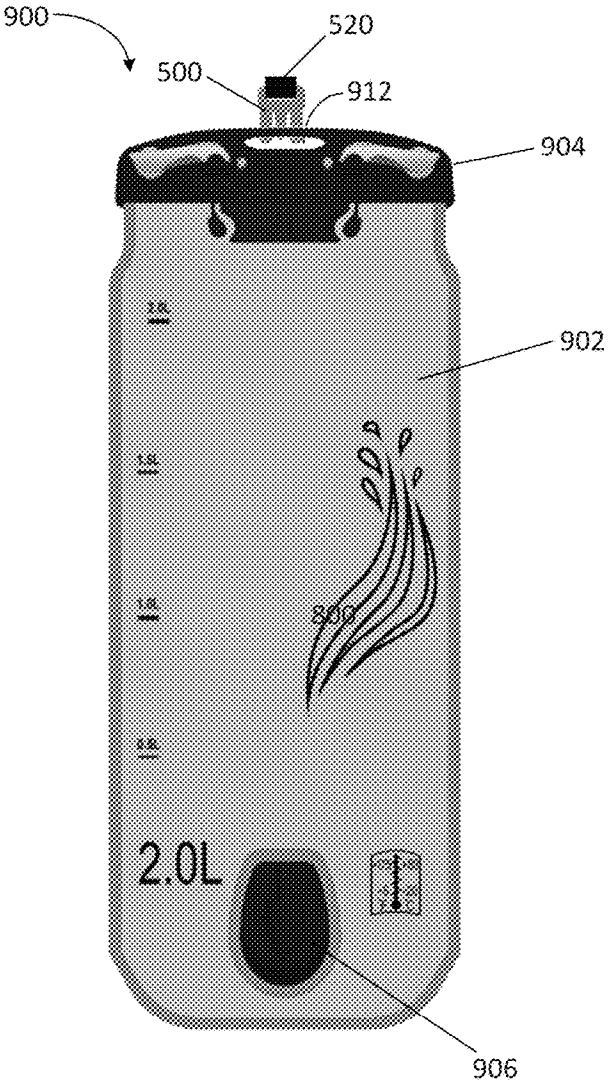
FIG. 50 is a front view of the example fluid container of FIG. 49 without a handle attached.
Figure 49:
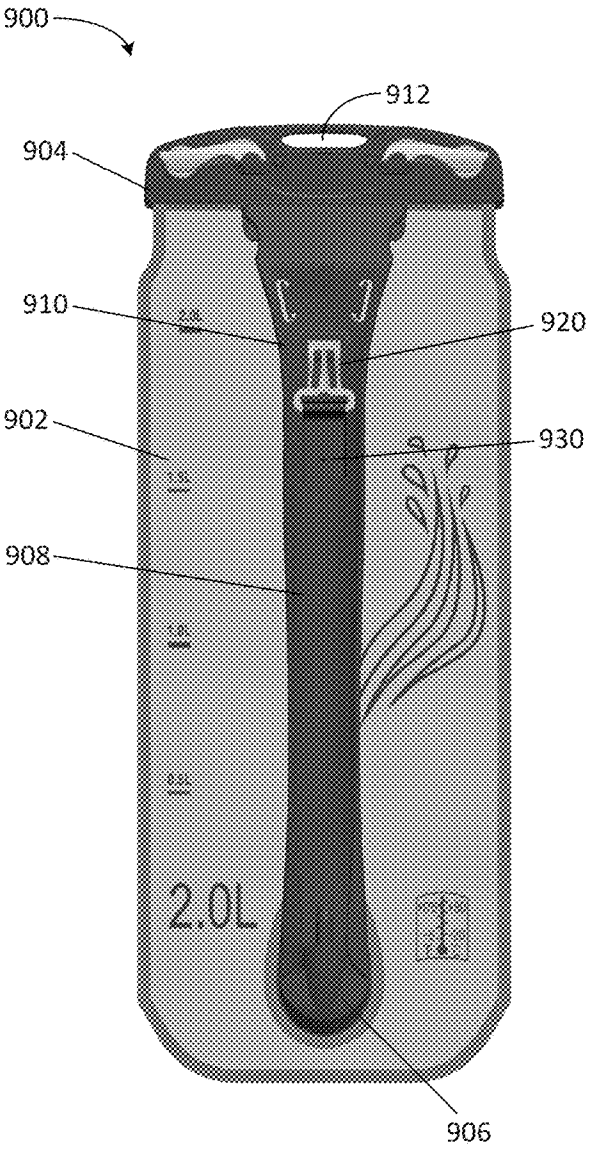
FIG. 49 is a front view of another example fluid container.

FIGS. 49-50 show various views of an example fluid container 900. The example fluid container 900 can comprise a flexible bladder 902 similar to the bladder 402 of FIGS. 33-34. The fluid container 900 can further comprise a closure 904 and an exit port 906 similar to the closure 404 and the exit port 406 of FIGS. 33-34. In the illustrated embodiment of FIG. 49, the fluid container 900 can further comprise a removable handle 908 similar to handle 408 of FIG. 34 that can couple to the closure 904 and the exit port 906. The handle 908 can have an opening 910. In the example of FIG. 49, the buckle 500 of FIGS. 35-39 can be coupled to the opening 910 and the strap 520 of FIG. 39 can be secured to the buckle 500. The closure 904 can comprise an upper opening 912. In the illustrated embodiment of FIG. 50, a buckle 920 can be coupled to the upper opening 912 and a strap 930 of FIG. 39 can be secured to the buckle 920.

Figure 52:
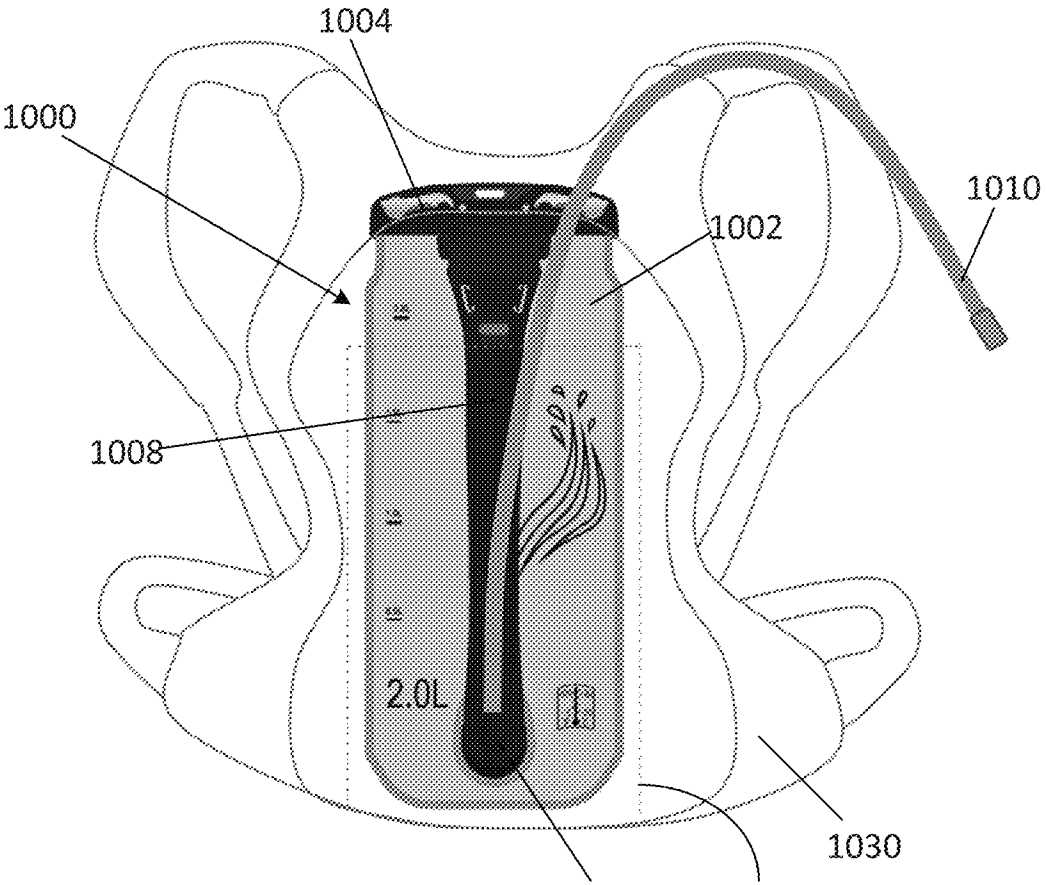
FIGS. 51-52 are views of another example fluid container and an example pack.
Figure 51:
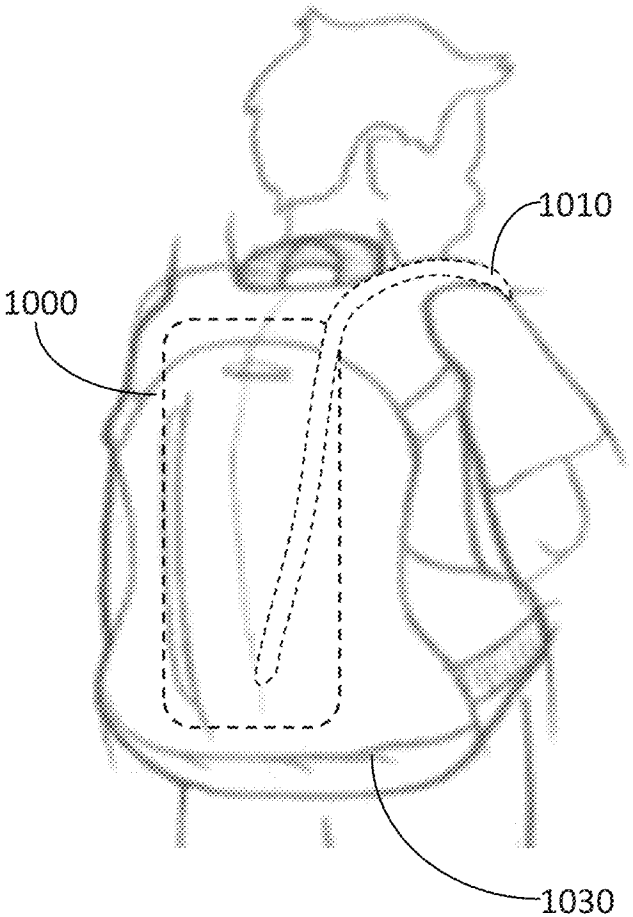

FIGS. 51-52 show various views of a fluid container 1000. In the illustrated embodiments of FIGS. 51-52, the fluid container 1000 is similar in construction to fluid container 400 of FIGS. 33-34. The fluid container 1000 can comprise a flexible bladder 1002 similar to bladder 402, a closure 1004 similar to bladder 404, an exit port 1006 similar to exit port 406, and a handle 1008 similar to handle 408. The handle 1008 can be coupled to the closure 1004 and the exit port 1006. The exit port 1006 can be coupled to one end of a straw 1010 and the other end of the straw 1010 can be used to drink liquid from the bladder 1002. The fluid container 1000 can be placed in a reservoir sleeve 1000, which can be sewn or otherwise secured to the back of a pack 1030. The straw 1010 can extend out of the pack 1030 such that it can be used to drink liquid from the bladder 1002 while the fluid container 1000 is in the reservoir sleeve 1000.

Figure 53:
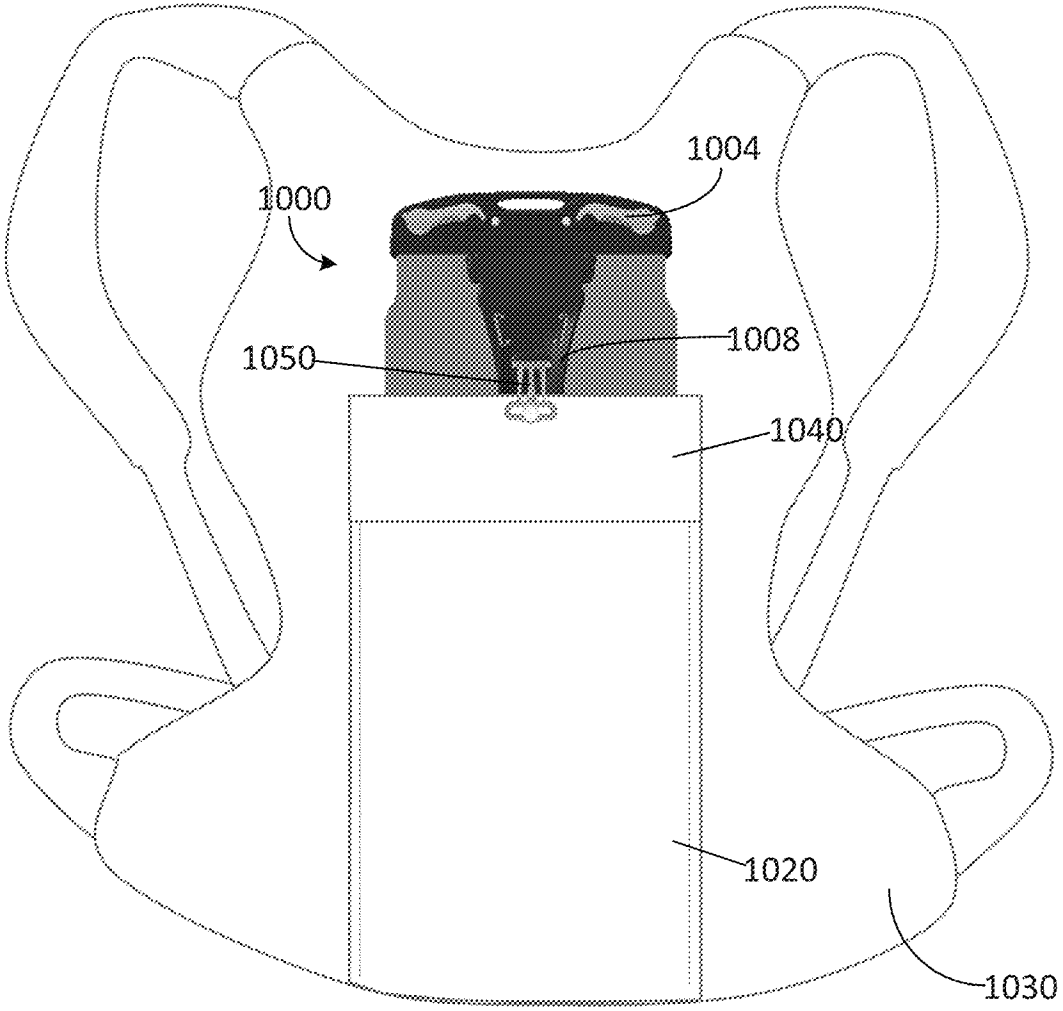
FIGS. 53-55 are views of another example fluid container and an example pack.
Figure 60:
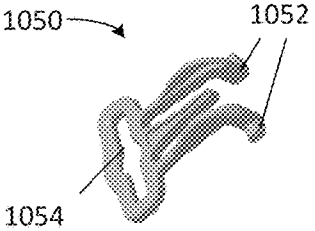
FIGS. 57-60 are views of another example buckle.
Figure 59:
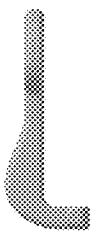
Figure 58:
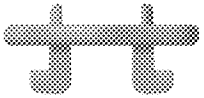
Figure 57:
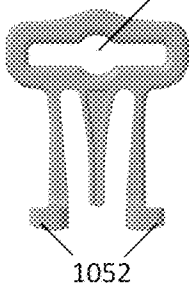

FIG. 53 shows another view of the fluid container 1000, reservoir sleeve 1020 and pack 1030 of FIGS. 51-52. In the illustrated example of FIG. 53, a top edge portion of the reservoir sleeve 1020 can comprise a flexible reinforcing strip 1040. In the illustrated embodiment, the reservoir sleeve 1020 is made of fabric and the reinforcing strip 1040 is made of plastic. In other embodiments, the reservoir sleeve 1020 and the reinforcing strip 1040 can comprise other materials. Referring to FIG. 53, a side release buckle 1050 can be coupled to the handle 1008 and can be secured to reservoir sleeve 1020 as more fully discussed below in connection with FIGS. 54-60.

Figure 55:
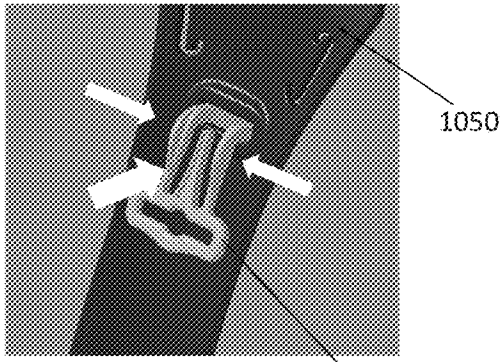
Figure 54:
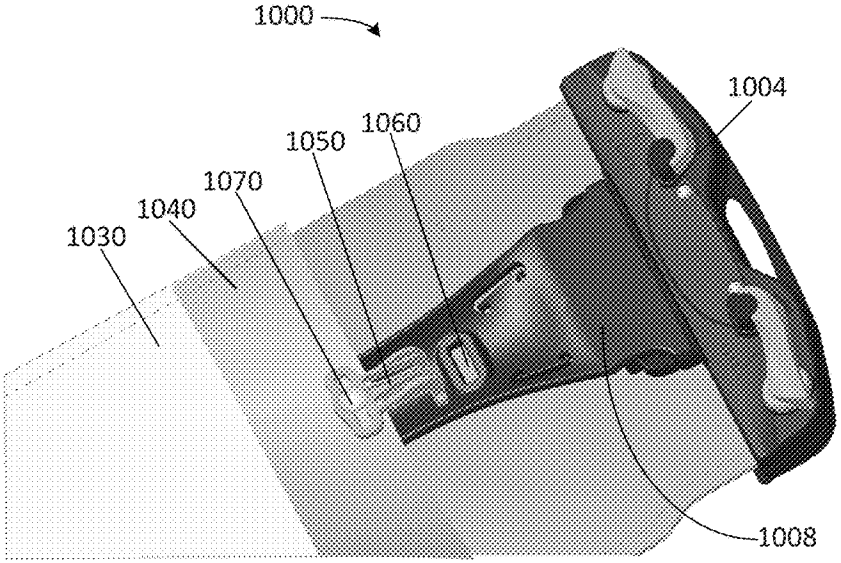

FIG. 54 shows an expanded view of the fluid container 1000. FIG. 55 shows an expanded view of the handle 1008 and the buckle 1050. FIGS. 57-60 show various views of the buckle 1050. Referring to FIGS. 54-60, the buckle 1050 can comprise two flexible, opposing locking members 1052. The handle 1008 can comprise a connecting slot 1060. The buckle 1050 can couple to the connecting slot 1060 by squeezing the opposing locking members 1052 towards each other and inserting the locking members 1052 into the slot 1060. The locking members 1052 can then be released, causing them to retract to their original position such that the buckle 1050 is securely coupled to the slot 1060. The buckle 1050 can be de-coupled from the connecting slot 1060 by squeezing the locking members 1052 towards each other and removing the buckle 1050 from the slot 1060. The buckle 1050 can also comprise an upper opening 1054 that can be secured to the reinforcing strip 1040 as shown in FIG. 54. Referring to FIG. 54, a securing member 1070 can be secured to the outside of the buckle 1050 and the reinforcing strip 1040 through the upper opening 1054. As such, when the buckle 1050 is coupled to the slot 1060, the fluid container 1000 is held in place in the reservoir pack 1030.

Figure 62:
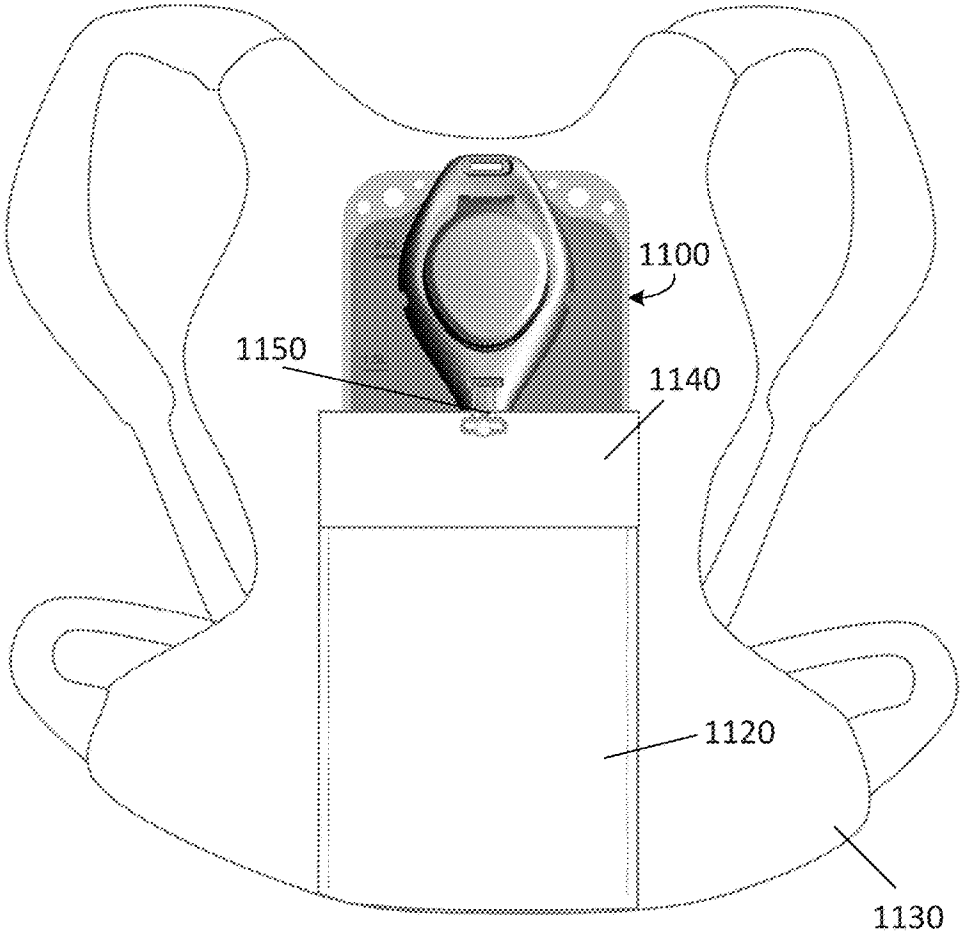
FIG. 62 is a view of the fluid container of FIG. 61 and an example pack.
Figure 61:
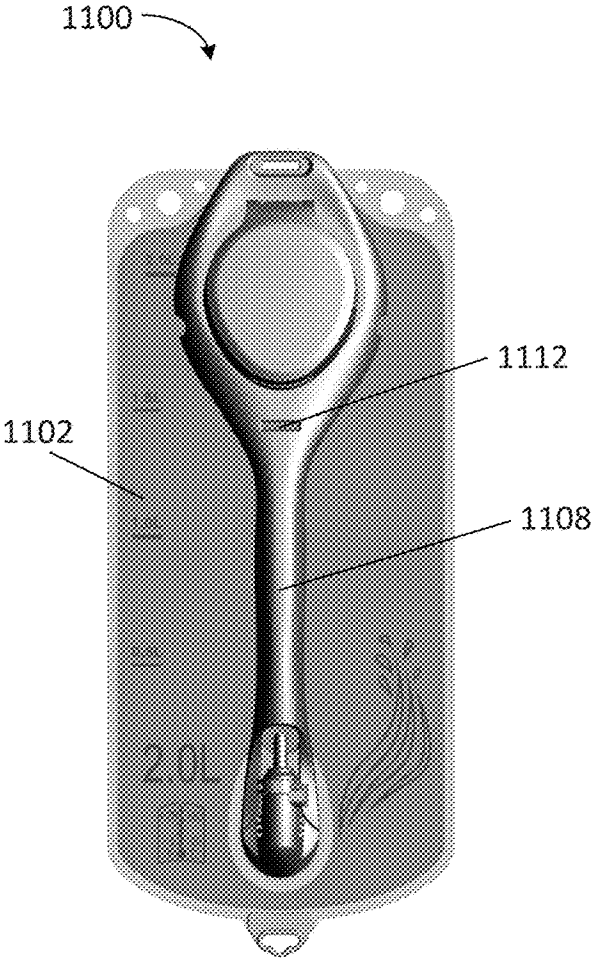
FIG. 61 is a front view of another example fluid container.

FIGS. 61-62 show various views of a fluid container 1100, which is similar in construction to fluid container 800 of FIG. 43. The fluid container 1100 can include a bladder 1102, a handle 1108, and a connecting slot 1112, similar to the bladder 802, handle 808, and connecting slot 812 of FIG. 43. Referring to FIG. 62, side release buckle 1150, which can be similar to buckle 1050, can be connected to connecting slot 1112. Buckle 1150 can be secured to a reinforcing strip 1140, which can be similar to reinforcing strip 1049 of FIG. 53. The reinforcing strip 1140 can comprise an upper portion of a reservoir sleeve 1120, which can be similar to reservoir sleeve 1020 of FIG. 53. The reservoir sleeve 1120 can be sewn or otherwise affixed to a pack 1130, which can be similar to pack 1030 of FIG. 53. The buckle 1150 can be coupled to the connecting slot 1112 in the same manner in which buckle 1050 can be coupled and uncoupled to connecting slot 1060 as discussed in connection with FIGS. 54-60. The side release buckle 1150 allows for easy connection and release for a user.

Figure 64:
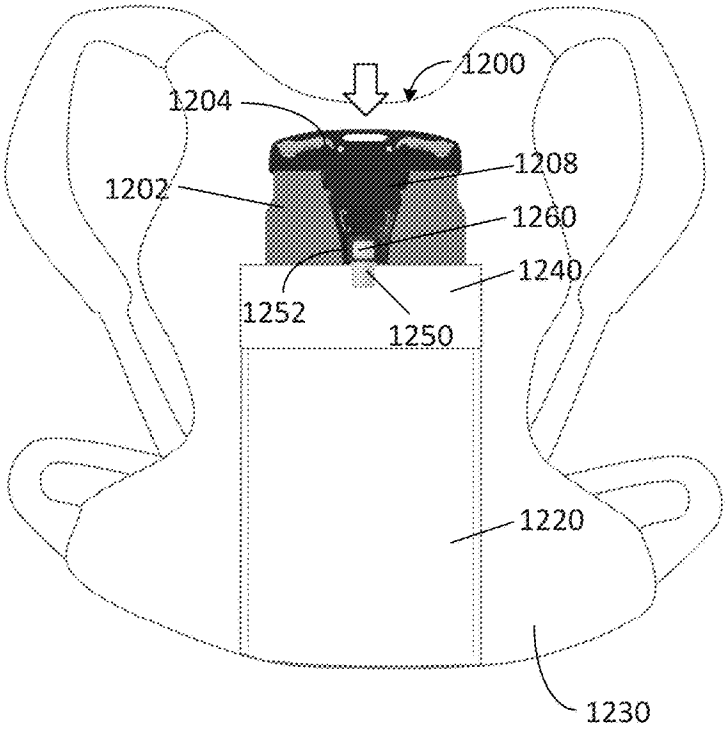
FIG. 64 is a view of the fluid container of FIG. 63 and an example pack.
Figure 63:
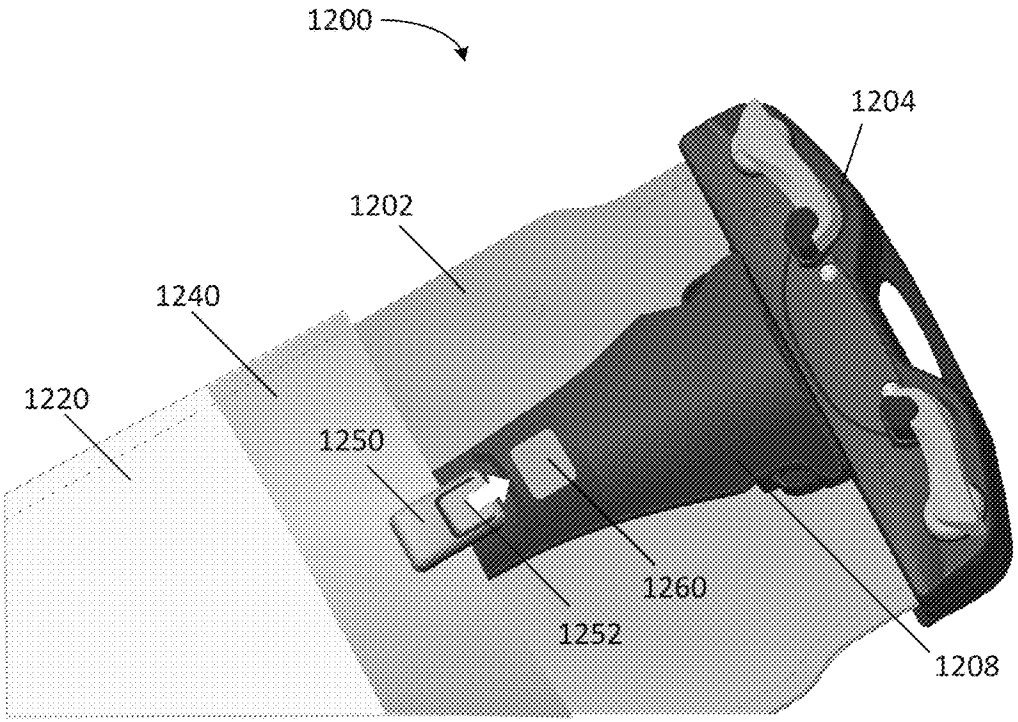
FIG. 63 is a front view of another example fluid container.

FIGS. 63-64 show various views of an example fluid container 1200, which is similar in construction to the fluid container 1000 of FIG. 54. The example fluid container 1200 can include a flexible bladder 1202, a closure 1204 and a rigid handle 1208. The handle 1208 can have a rectangular shaped connecting slot 1260. A reservoir sleeve 1220, including a reinforcing strip 1240 at an upper edge portion of the reservoir sleeve 1220 can be used to hold, carry or store the fluid container 1200. A button latch 1250 having a button 1252 can be secured to the reinforcing strip 1250. The button latch 1250 can be coupled and un-coupled to the connecting slot 1260 by pressing the button 1252 and inserting or removing the latch 1250 from the slot 1260. In alternative embodiments, a magnetic latch can be used in placed of button latch 1250. The button latch 1250 allows for easy connection and release for a user.

Figure 68:
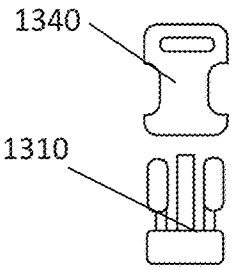
FIG. 68 is a view of an example buckle that can be used with the fluid container of FIGS. 65-66 and the pack of FIG. 67.
Figure 66:
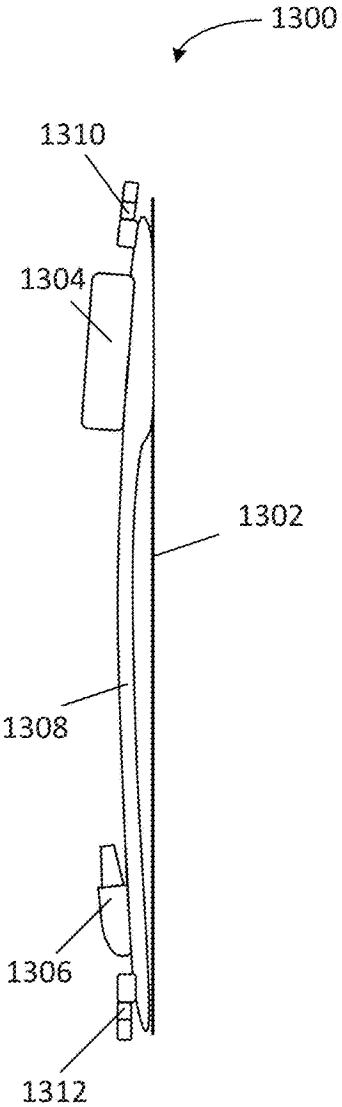
FIGS. 65-66 are front and side views of another example fluid container.
Figure 65:
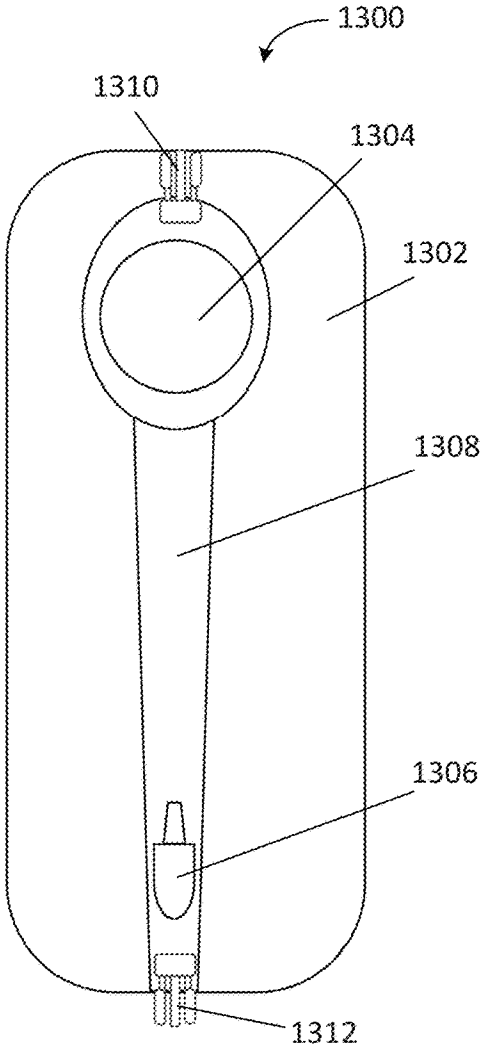

FIGS. 65-66 show various views of another example fluid container 1300. The fluid container 1300 can comprise a flexible bladder 1302, a closure 1304, an exit port 1306, a handle 1308, an upper male side release buckle 1310 and a lower male side release buckle 1312. The closure 1304 can be opened to access the inside of the bladder 1302 and can be closed to seal the bladder 1302. The handle 1308 can be coupled to the closure 1304 and the exit port 1306. The male side release buckles 1310, 1312 can be secured to the closure 1310 and the exit port 1306. The male side release buckles 1310, 1312 can couple with corresponding female buckles, such as female buckle 1340 as shown in FIG. 68.

Figure 67:
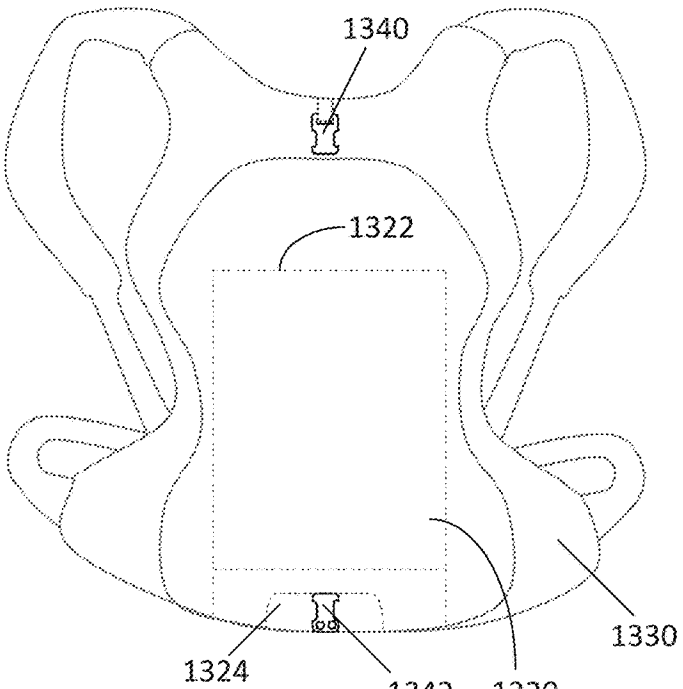
FIG. 67 is a view of an example pack that can be used with the fluid container of FIGS. 65-66.

FIG. 67 shows a pack 1330 configured to hold and/or carry fluid container 1300. The pack 1330 can have a reservoir sleeve 1320 sewn or otherwise affixed to pack 1330. The reservoir sleeve 1320 can have an opening 1322 at the top such that the fluid container 1300 can be placed in the reservoir sleeve 1320. The top and bottom of the pack 1330 can have upper female buckle 1340 and lower female buckle 1342 secured thereto. The upper and lower female buckles 1340, 1342 can couple to the male buckles 1310, 1312 to hold the fluid container 1300 in place in the reservoir sleeve 1320 and prevent excessive movement of the fluid container 1300 while it is secured in the reservoir sleeve 1320. A side release buckle access pocket 1324 can be cut in the bottom of reservoir sleeve 1320 such that the lower male buckle 1312 and lower female buckle 1342 can couple and be accessed through the reservoir sleeve 1320.

Figure 70:
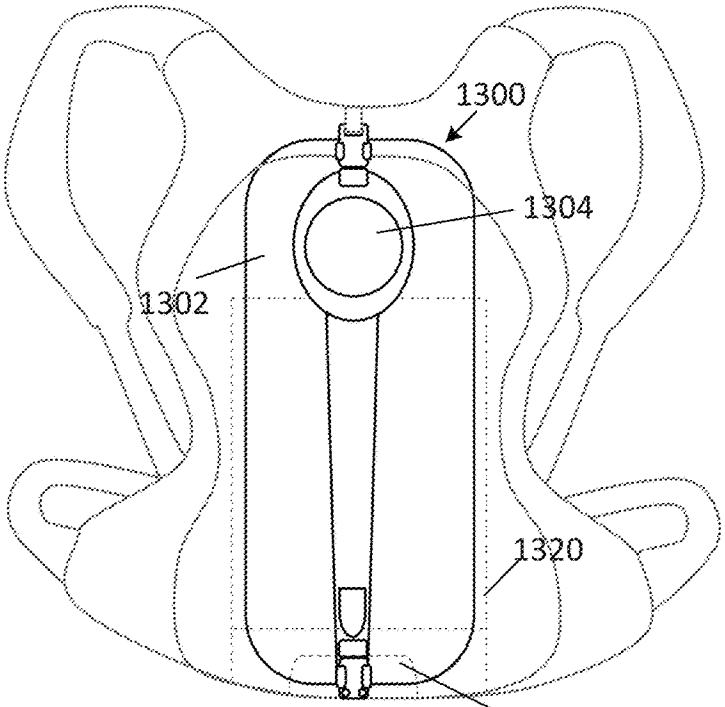
FIGS. 69-70 are additional views of the fluid container of FIGS. 65-66 and the pack of FIG. 67.
Figure 69:
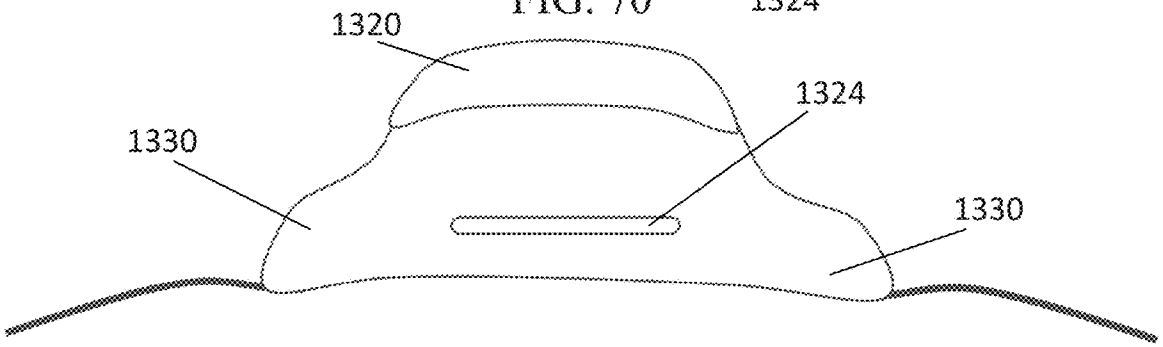

FIGS. 69-70 show various views of the pack 1330 and the fluid container 1300 when the fluid container 1300 is placed in the reservoir sleeve 1324 and the male buckles 1310, 1312 are coupled to the female buckles 1340, 1342. In this configuration, the fluid container 1300 is prevented from vertical, lateral, and/or twisting movement with respect to the pack 1330.

Figure 72:
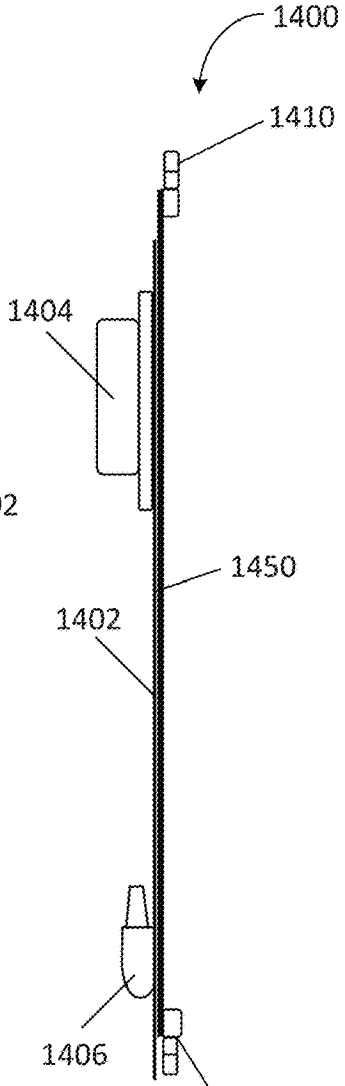
FIGS. 71-72 are front and side views of another example fluid container.
Figure 71:
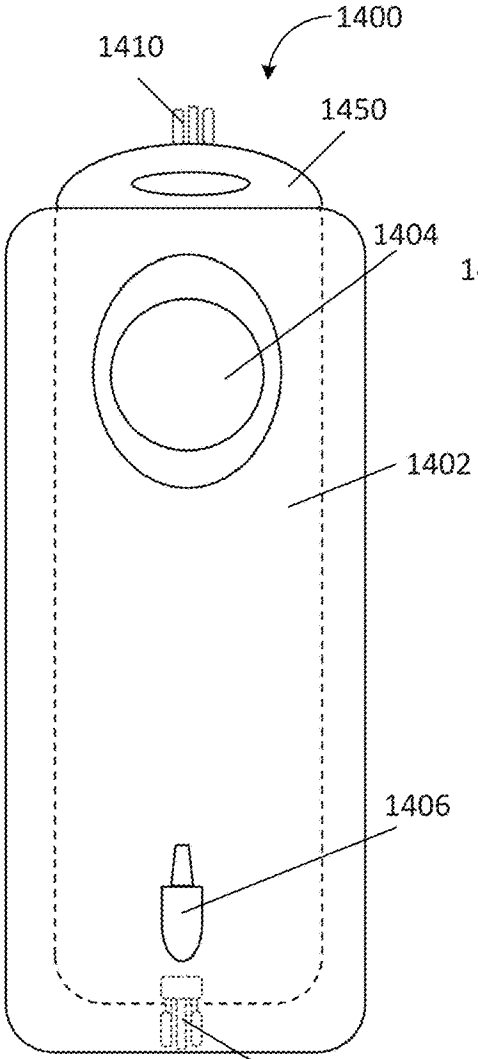

FIGS. 71-72 show various views of another example fluid container 1400. The fluid container 1400 can comprise a flexible bladder 1402, a closure 1404, an exit port 1406, a handle 1408, an upper male side release buckle 1410, a lower male side release buckle 1412, and a back plate 1450. The closure 1404 can be opened to access the inside of the bladder 1402 and can be closed to seal the bladder 1402. The handle 1408 can be coupled to the closure 1404 and the exit port 1406. The back plate 1450 is affixed to the back side of the bladder 1402. The male side release buckles 1410, 1412 can be secured to the back plate 1450. The male side release buckles 1410, 1412 can couple with corresponding female buckles, such as female buckle 1440 as shown in FIG. 73.

Figure 73:
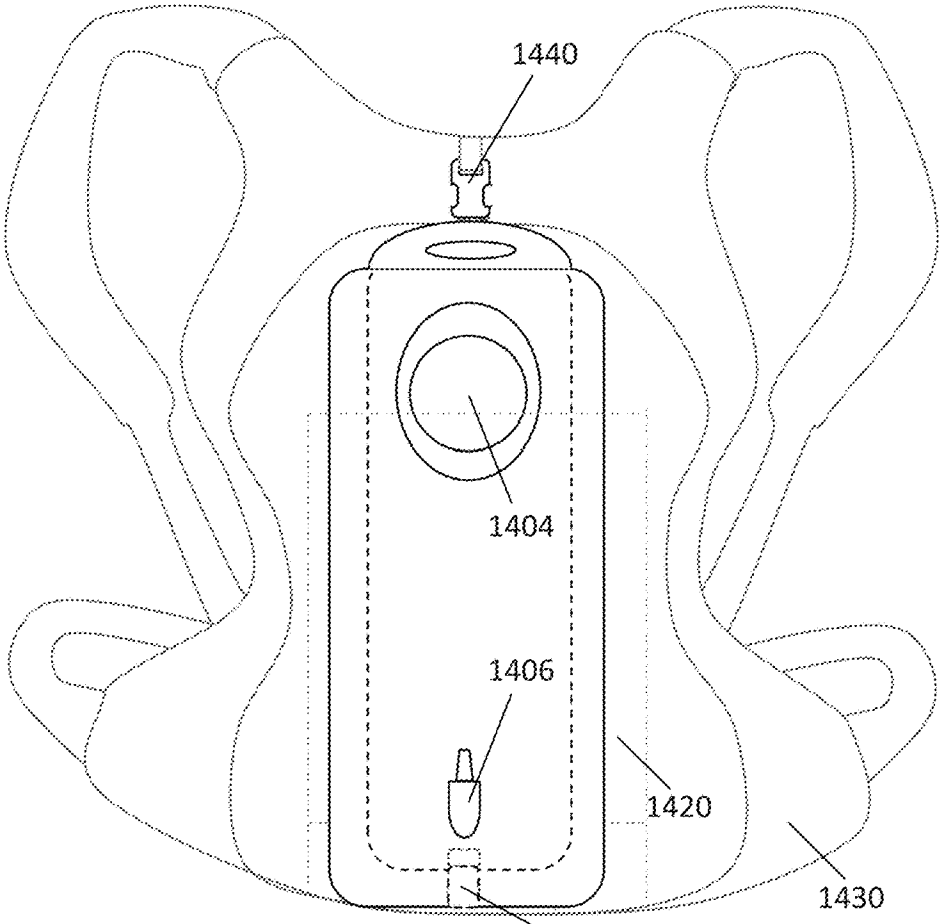
FIG. 73 is a view of an example pack and the fluid container of FIGS. 71-72.

FIG. 73 shows a pack 1430 configured to hold and/or carry fluid container 1400. The pack 1430 can have a reservoir sleeve 1420 sewn or otherwise affixed to pack 1430. The reservoir sleeve 1420 can have an opening 1422 at the top such that the fluid container 1400 can be placed in the reservoir sleeve 1420. The top and bottom of the pack 1430 have upper female buckle 1440 and lower female buckle 1442 secured thereto. The upper and lower female buckles 1440, 1442 can couple to the male buckles 1410, 1412 on the back plate 1450 to hold the back plate 1450 and the fluid container 1400 in place in the reservoir sleeve 1420.

Figure 75:
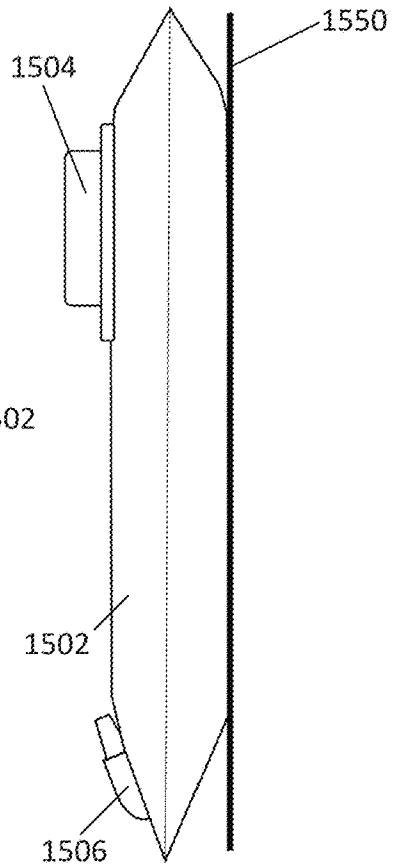
FIGS. 74-75 are front and side views of another example fluid container.
Figure 74:
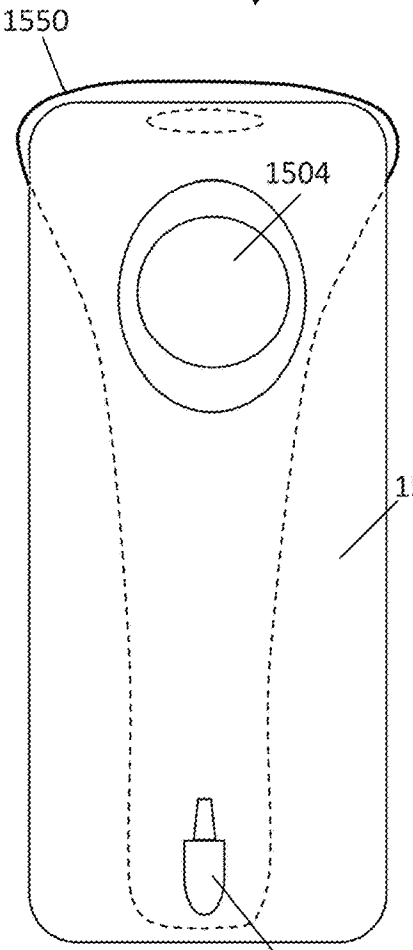

FIGS. 74-75 show various views of another example fluid container 1500. The fluid container 1500 can comprise a flexible bladder 1502, a closure 1504, an exit port 1506, and a back plate 1550. The closure 1504 can be opened to access the inside of the bladder 1502 and can be closed to seal the bladder 1502. The back plate 1550 can be affixed to the back side of the bladder 1502.

Figure 76:
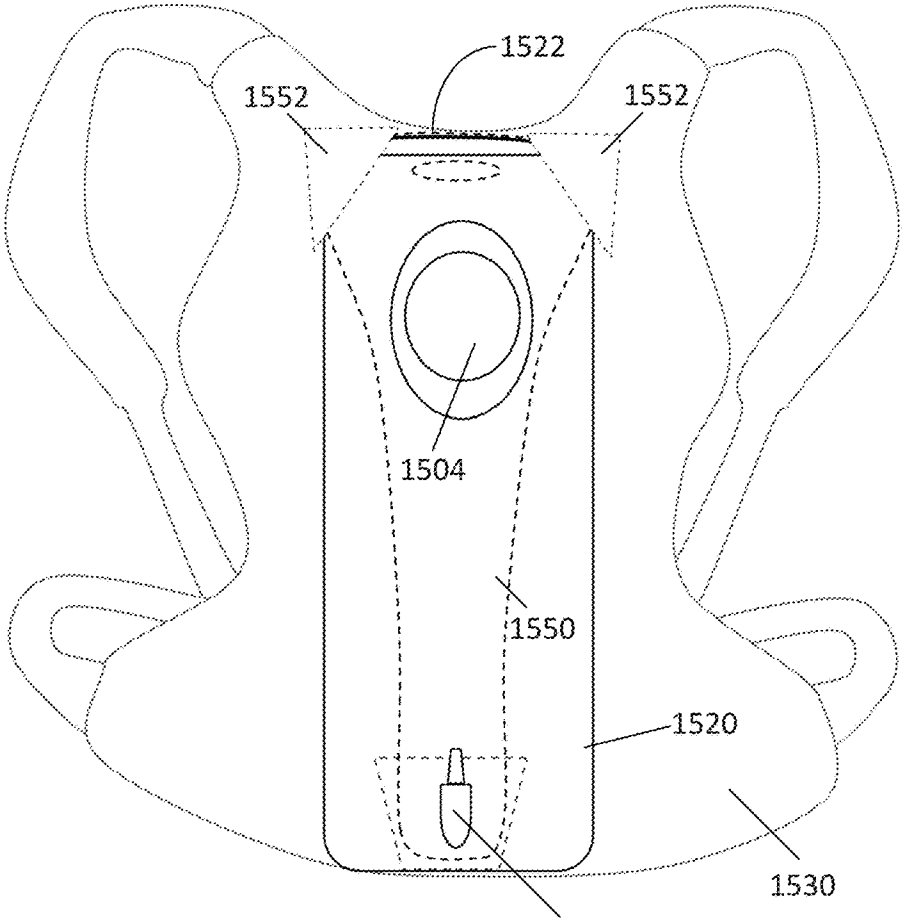
FIG. 76 is a view of an example pack and the fluid container of FIGS. 74-75.

FIG. 76 shows a pack 1530 configured to hold and/or carry fluid container 1500. The pack 1530 can have a reservoir sleeve 1520 sewn or otherwise affixed to pack 1530. The reservoir sleeve 1520 can have an opening 1522 at the top such that the fluid container 1500 can be placed in the reservoir sleeve 1520. The reservoir sleeve 1520 can have pockets 1552 in its upper corners such that the upper corners of the back plate 1550 can be tucked into the pockets 1552.

Figure 79:
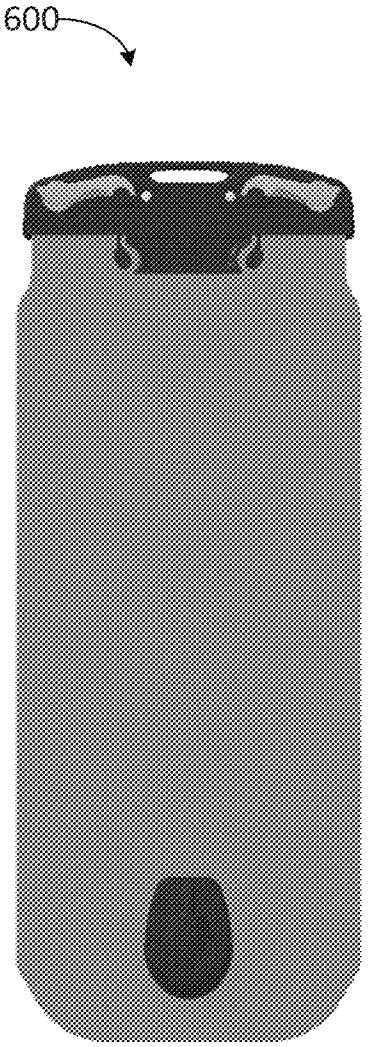
FIGS. 77-79 are various views of another example fluid container and a detachable handle.
Figure 78:
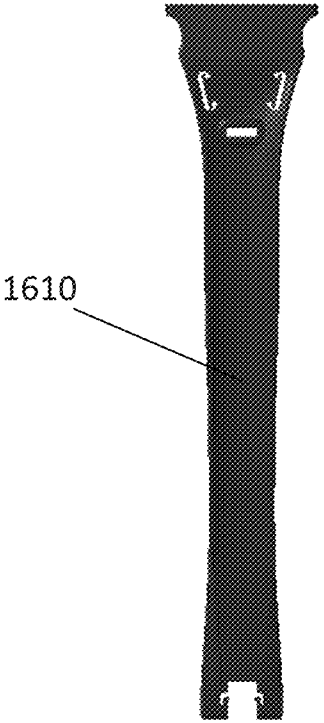
Figure 77:
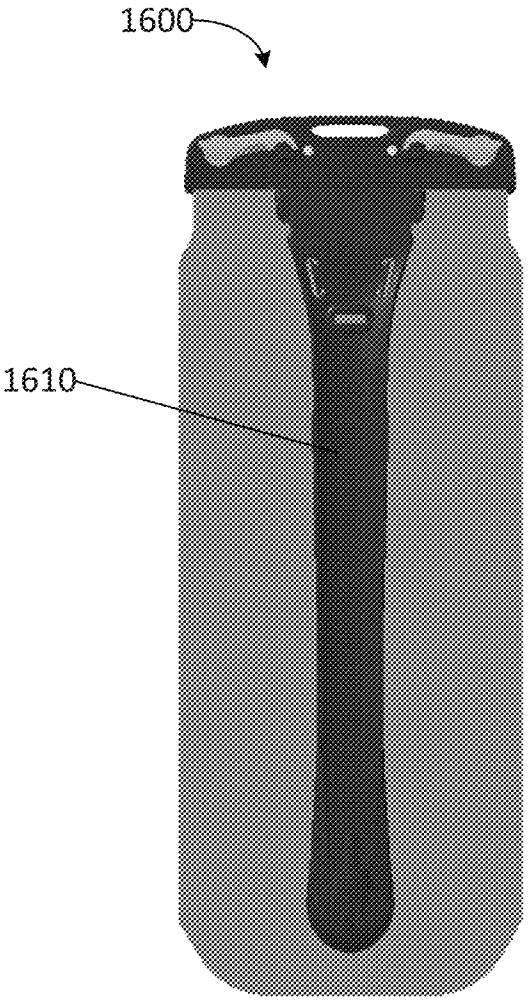

FIG. 77 shows an example fluid container 1600, similar to fluid container 400, with a detachable handle 1610, similar to handle 408. FIG. 78 shows the detachable handle 1610 of FIG. 77 detached from the fluid container 1600. FIG. 79 shows fluid container 1600 without the handle 1610 attached.

Figure 80:
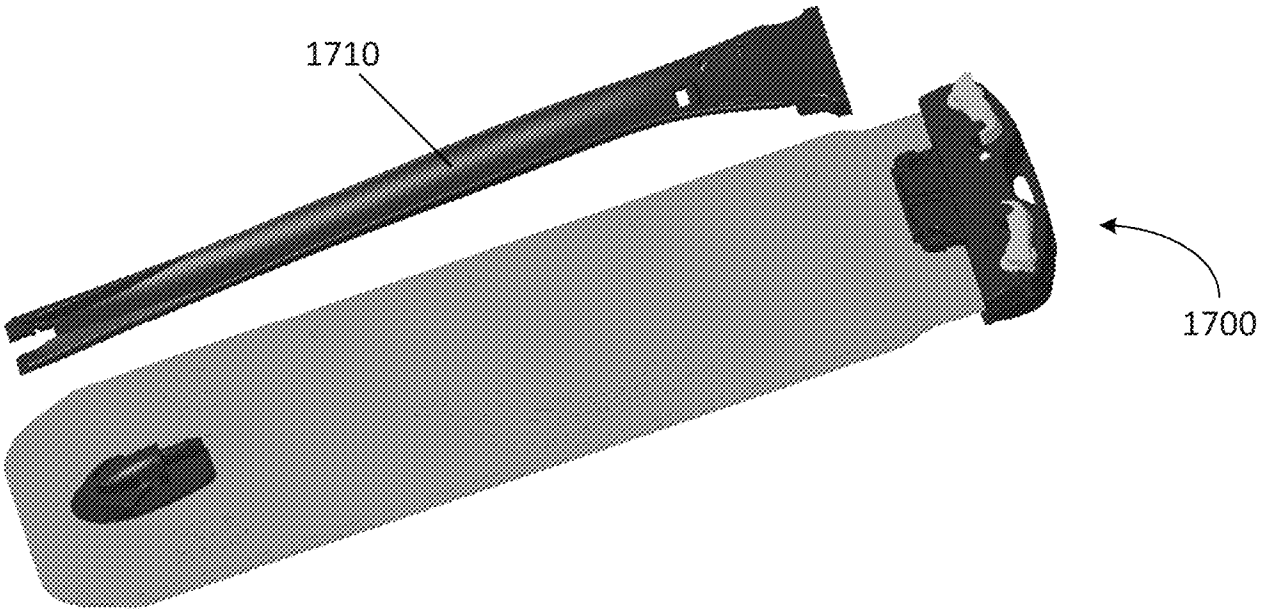
FIG. 80 is a view of another example fluid container and detachable handle.

FIG. 80 shows an example fluid container 1700 and detachable handle 1710. Fluid container 1700 is similar to fluid container 1600 with an elongated body. Handle 1710 is similar to handle 1610 with a longer length to fir the elongated body of fluid container 1700.

Figure 82:
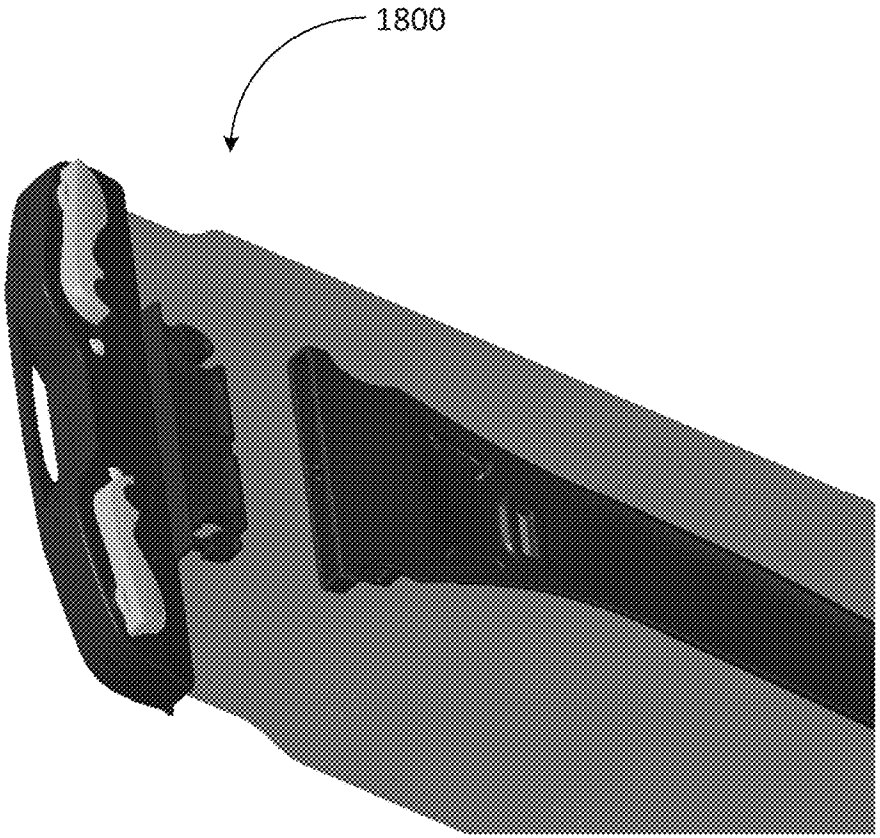
FIGS. 81-82 are views of another example fluid container.
Figure 81:
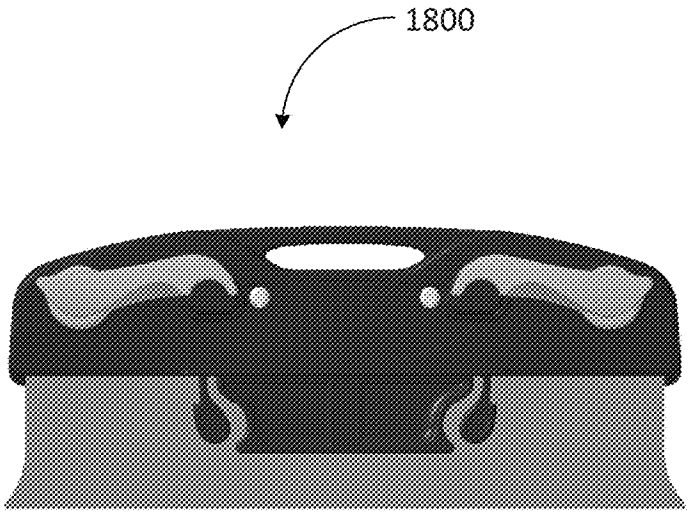

FIGS. 81-82 show another example fluid container 1800.

Figure 84:
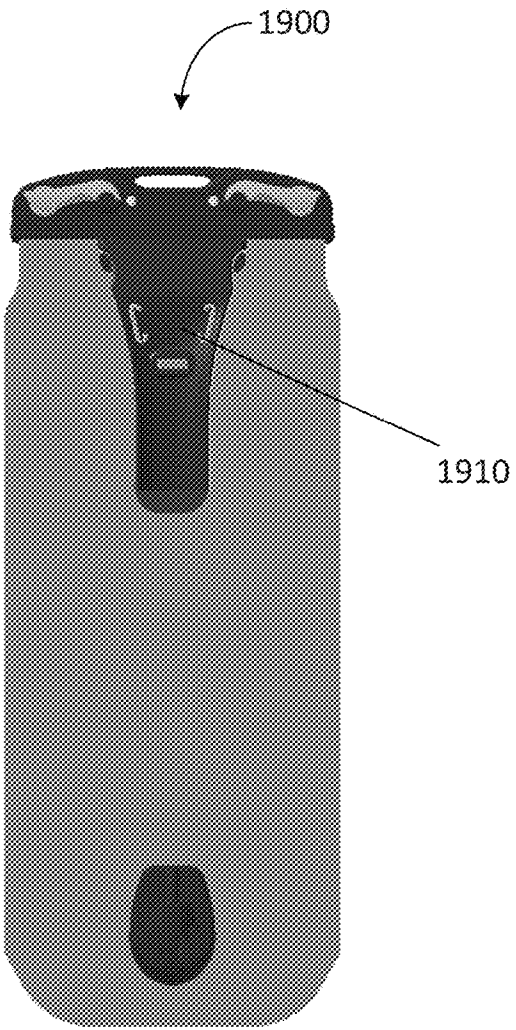
FIGS. 83-84 are views of another example fluid container.
Figure 83:
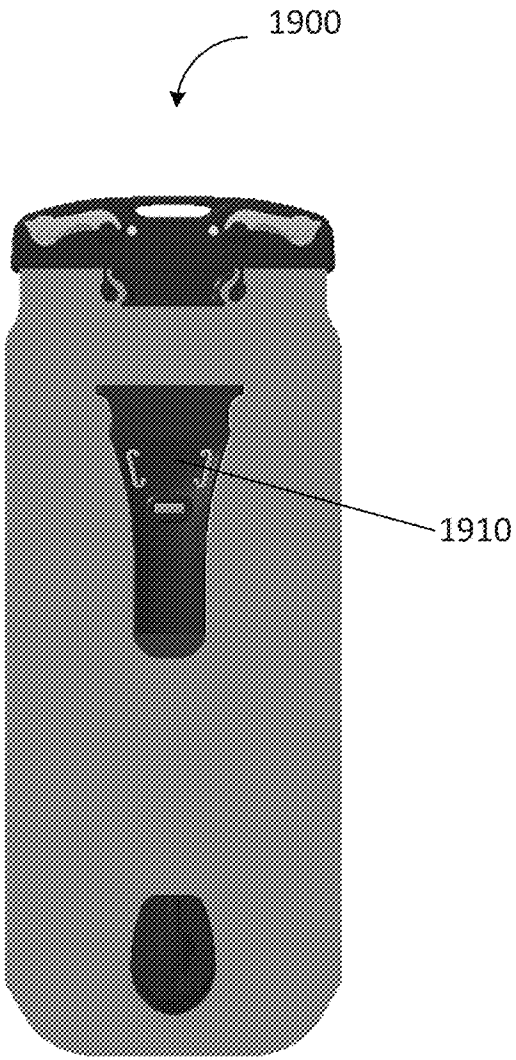

FIGS. 83-84 show another example fluid container 1900. The fluid container 1900 is similar to fluid container 1600. The fluid container 1900 comprises a handle 1910, which is similar to handle 1610 with a shorter length that such that the handle 1910 does not extend across the entire length of the fluid container 1900.

The various closures described herein may be integrated with a hydration pack's bladder compartment opening so that the bladder interior can be accessed via a single opening step.

The embodiments disclosed may be utilized with various sizes and types of bladders including soft-sided and semi-flexible versions as well as bladders made from a variety of materials, including, PVC, polyurethane, polyethylene, silicone, and/or others.

The singular terms "a", "an", and "the" include plural referents unless context clearly indicates otherwise. The term "comprises" means "includes without limitation." The term "coupled" means physically linked and does not exclude intermediate elements between the coupled elements. The term "and/or" means any one or more of the elements listed. Thus, the term "A and/or B" means "A", "B" or "A and B."

Although methods and materials similar or equivalent to those described herein can be used in the practice or testing of the present technology, only certain suitable methods and materials are described herein. In case of conflict, the present specification, including terms, will control. In addition, the materials, methods, and devices are illustrative only and not intended to be limiting.

In view of the many possible embodiments to which the principles of the disclosed technology may be applied, it should be recognized that the illustrated embodiments are only examples and should not be taken as limiting the scope of the disclosure. Rather, the scope of the disclosure is at least as broad as the following claims. I therefore claim all that comes within the scope the these claims and their equivalents.

The invention claimed is:

1. A fluid container comprising:

a flexible bladder having an internal region for storing a fluid;

a bladder opening at an upper end portion of the bladder for allowing passage of fluid in or out of the internal region;

a lower handle coupling member secured to an outer surface of the bladder at a lower end portion of the bladder;

an upper closure secured to the bladder over the bladder opening for selectively closing and opening the bladder opening; and a removable handle, wherein the handle has an upper end portion that is detachably coupled to the upper closure and a lower end portion that is detachably coupled to the lower handle coupling member;

wherein the upper closure comprises:

a first closure member adapted to be secured to a first side of the bladder opening, the first closure member comprising at least one fastener mounting opening and at least one hole spaced from the fastener mounting opening;

a second closure member adapted to be secured to a second side of the bladder opening opposite from the first side, the second closure member comprising at least one fastener engagement opening and at least one projection spaced from the fastener engagement opening;

at least one fastener for securing the first and second closure members together to seal the bladder opening, the fastener being rotatably mounted in the fastener mounting opening of the first closure member, the fastener comprising a latch positioned on an outer side of the first closure member and a shaft that passes through the fastener mounting opening and extends from an inner side of the first closure member, wherein the shaft includes at least one tab that projects from a portion of the shaft on the inner side of the first closure member, and wherein the latch extends radially from a portion of the shaft on the outer side of the first closure member and the latch includes a locking portion that pivots with the shaft at least partially around an axis of the shaft;

wherein when the bladder closure is in an open position, the first closure member is spaced apart from the second closure member; and wherein when the bladder closure is in a closed position, the tab that projects from the fastener shaft is engaged with the fastener engagement opening in the second closure member to provide a clamping force that clamps the first and second closure members together to seal the bladder opening, and the projection of the second closure member extends through the hole in the first closure member and the locking portion of the latch is engaged with the projection on the outer side of the first closure member to lock the bladder closure in the closed position.

2. The fluid container of claim 1, wherein the upper closure comprises a first coupling feature and the upper end portion of the handle comprises a second coupling feature, wherein the first coupling feature and the second coupling feature are operable to couple together to secure the upper closure to the handle.

3. The fluid container of claim 1, wherein the handle has a convex surface that faces the bladder.

4. The fluid container of claim 1, wherein the handle has a concave surface that faces the bladder.

5. The fluid container of claim 1, wherein the lower handle coupling member comprises a fluid exit port.

6. The fluid container of claim 5, further comprising a straw having a first end that is operable to be detachably coupled to the fluid exit port, wherein the straw is disposed between the bladder and the handle.

7. The fluid container of claim 6, wherein the straw runs under the handle and the handle comprises a straw opening such that a second end of the straw opposite the first end protrudes out of straw opening.

8. The fluid container of claim 1, wherein the upper closure comprises:

a base secured to the bladder around the bladder opening, the base having a port to allow passage of fluid through the base in or out of the bladder through the bladder opening;

an annular cap retainer secured to the base around the port; and a cap hingedly coupled to the cap retainer and pivotable between a closed position where the cap seals the port closed and an open position where the port is open for passage of fluid in or out of the bladder.

9. The fluid container claim 1, wherein the handle comprises a connecting slot that is operable to couple to a buckle.

10. The fluid container of claim 9, further comprising a buckle coupled to the connecting slot and a strap secured to a first end portion of the buckle.

11. The fluid container of claim 9, further comprising a buckle that is coupled to the connecting slot and that is securable to a pack to secure the fluid container to the pack.

12. The fluid container of claim 1, further comprising a first buckle secured to the upper closure and a second buckle secured to the lower end portion of the handle.

13. The fluid container of claim 12, wherein the first buckle couples to a third buckle secured to a pack and the second buckle couples to a fourth buckle secured to the pack to secure the fluid container to the pack.

14. The fluid container of claim 1, further comprising a back plate secured to a rear side of the bladder, wherein the handle is secured to a front side of the bladder.

15. A system comprising:

a fluid container comprising:

a flexible bladder having an internal region for storing a fluid;

a bladder opening at an upper end portion of the bladder for allowing passage of fluid in or out of the internal region;

an upper closure secured to the bladder over the bladder opening for selectively closing and opening the bladder opening; and a first buckle; and a pack comprising:

a second buckle or a securing member, wherein the first buckle and the second buckle or the securing member are operable to couple together to secure the fluid container within the pack;

wherein the upper closure comprises:

a first closure member adapted to be secured to a first side of the bladder opening, the first closure member comprising at least one fastener mounting opening and at least one hole spaced from the fastener mounting opening;

a second closure member adapted to be secured to a second side of the bladder opening opposite from the first side, the second closure member comprising at least one fastener engagement opening and at least one projection spaced from the fastener engagement opening;

at least one fastener for securing the first and second closure members together to seal the bladder opening, the fastener being rotatably mounted in the fastener mounting opening of the first closure member, the fastener comprising a latch positioned on an outer side of the first closure member and a shaft that passes through the fastener mounting opening and extends from an inner side of the first closure member, wherein the shaft includes at least one tab that projects from a portion of the shaft on the inner side of the first closure member, and wherein the latch extends radially from a portion of the shaft on the outer side of the first closure member and the latch includes a locking portion that pivots with the shaft at least partially around an axis of the shaft;

wherein when the bladder closure is in an open position, the first closure member is spaced apart from the second closure member; and wherein when the bladder closure is in a closed position, the tab that projects from the fastener shaft is engaged with the fastener engagement opening in the second closure member to provide a clamping force that clamps the first and second closure members together to seal the bladder opening, and the projection of the second closure member extends through the hole in the first closure member and the locking portion of the latch is engaged with the projection on the outer side of the first closure member to lock the bladder closure in the closed position.

16. The system of claim 15, further comprising:

a third buckle secured to the fluid container; and a fourth buckle secured to the pack, wherein the third buckle and the fourth buckle are operable to couple together to further secure the fluid container within the pack.

17. The system of claim 15, wherein the fluid container further comprises:

a lower handle coupling member secured to an outer surface of the bladder at a lower end portion of the bladder;

a removable handle, wherein the handle has an upper end portion that is detachably coupled to the upper closure and a lower end portion that is detachably coupled to the lower handle coupling member; and a third buckle; and wherein the pack further comprises a fourth buckle, wherein the third buckle and the fourth buckle are operable to couple together to further secure the fluid container within the pack.

18. The system of claim 17, wherein the first buckle, the second buckle, the third buckle, and the fourth buckle are side release buckles.

19. The system of claim 15, wherein the pack further comprises a reservoir sleeve to receive the fluid container.

* * * * *